US007310596B2

(12) United States Patent
Ota et al.

(10) Patent No.: US 7,310,596 B2
(45) Date of Patent: Dec. 18, 2007

(54) METHOD AND SYSTEM FOR EMBEDDING AND EXTRACTING DATA FROM ENCODED VOICE CODE

(75) Inventors: Yasuji Ota, Kawasaki (JP); Masanao Suzuki, Kawasaki (JP); Yoshiteru Tsuchinaga, Fukuoka (JP); Masakiyo Tanaka, Kawasaki (JP); Shigeru Sasaki, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 815 days.

(21) Appl. No.: 10/357,323

(22) Filed: Feb. 3, 2003

(65) Prior Publication Data

US 2003/0154073 A1 Aug. 14, 2003

Related U.S. Application Data

(63) Continuation-in-part of application No. 10/278,108, filed on Oct. 22, 2002, now abandoned.

(30) Foreign Application Priority Data

Feb. 4, 2002 (JP) ..... 2002-026958
Jan. 24, 2003 (JP) ..... 2003-015538

(51) Int. Cl.
*G10L 19/00* (2006.01)

(52) U.S. Cl. ..... 704/201; 704/222; 704/229; 704/500

(58) Field of Classification Search ..... None
See application file for complete search history.

(56) References Cited

U.S. PATENT DOCUMENTS 5,195,137 A * 3/1993 Swaminathan ..... 704/222
5,862,260 A * 1/1999 Rhoads ..... 382/232
6,154,484 A * 11/2000 Lee et al. ..... 375/130
6,314,192 B1 * 11/2001 Chen et al. ..... 382/100

(Continued)

FOREIGN PATENT DOCUMENTS

EP 0 909 081 4/1999

(Continued)

OTHER PUBLICATIONS

Extended European Search Report dated May 21, 2007, for European Application EP 06 00 7029.

(Continued)

*Primary Examiner*—David D. Knepper
(74) *Attorney, Agent, or Firm*—Katten Muchin Rosenman LLP

(57) ABSTRACT

When a voice encoding apparatus embeds any data in encoded voice code, the apparatus determines whether data embedding condition is satisfied using a first element code from among element codes constituting the encoded voice code, and a threshold value. If the data embedding condition is satisfied, the apparatus embeds optional data in the encoded voice code by replacing a second element code with the optional data. When a voice decoding apparatus extracts data that has been embedded in encoded voice code, the apparatus determines whether data embedding condition is satisfied using a first element code from among element codes constituting the encoded voice code, and a threshold value. If the data embedding condition is satisfied, the apparatus determines that optional data has been embedded in the second element code portion of the encoded voice code and extracts this embedded data.

41 Claims, 34 Drawing Sheets

U.S. PATENT DOCUMENTS

| | | | | |
|---|---|---|---|---|
| 6,484,139 | B2 * | 11/2002 | Yajima | 704/230 |
| 6,901,209 | B1 * | 5/2005 | Cooper et al. | 386/109 |
| 6,996,522 | B2 * | 2/2006 | Chen | 704/219 |
| 2001/0002902 | A1 * | 6/2001 | Hamdi | 379/202 |
| 2004/0019480 | A1 * | 1/2004 | Sato et al. | 704/201 |
| 2004/0024594 | A1 * | 2/2004 | Lee et al. | 704/219 |

FOREIGN PATENT DOCUMENTS

| | | | |
|---|---|---|---|
| EP | 1 020 848 | | 7/2000 |
| EP | 1 049 259 | | 11/2000 |
| JP | 11-296200 | | 10/1999 |
| JP | 2000-209663 | | 7/2000 |
| WO | 9609708 | | 3/1996 |
| WO | WO9716917 | * | 5/1997 |
| WO | WO 01/67671 | | 9/2001 |

OTHER PUBLICATIONS

Notification of Reasons for Refusal dated Feb. 27, 2007 for corresponding Japanese Application 2003-015538.

* cited by examiner (1) TRANSMIT CODE

| LSP | ADAPTIVE CODEBOOK INDEX | ADAPTIVE CODEBOOK GAIN | FIXED CODEBOOK INDEX | FIXED CODEBOOK GAIN |
|---|---|---|---|---|

(2) TRANSMIT CODE

| LSP | EMBEDDED DATA (OPTIONAL) | ADAPTIVE CODEBOOK GAIN | FIXED CODEBOOK INDEX | FIXED CODEBOOK GAIN |
|---|---|---|---|---|

FIG. 15
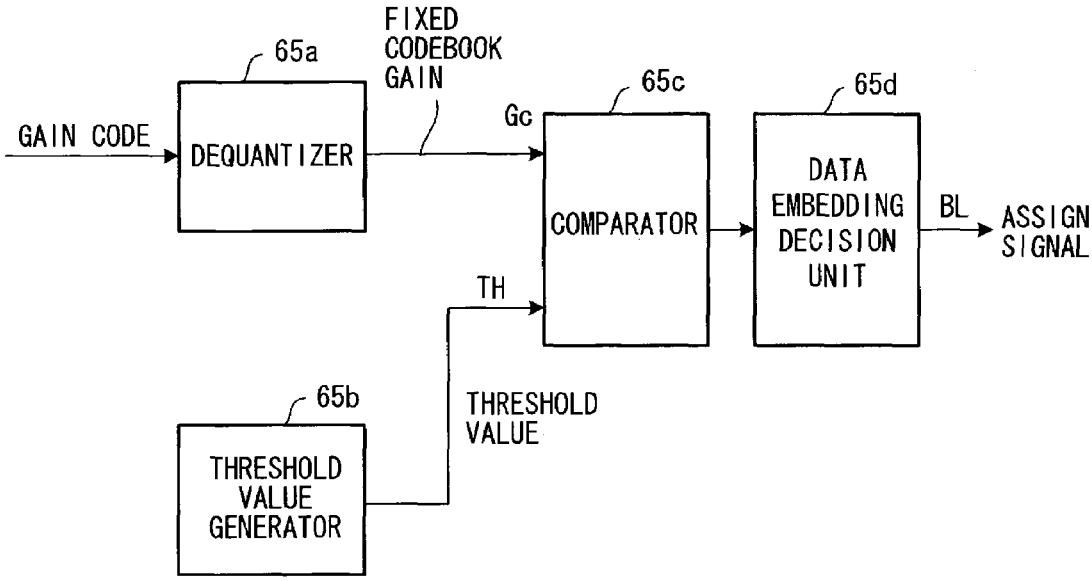
FIG. 16
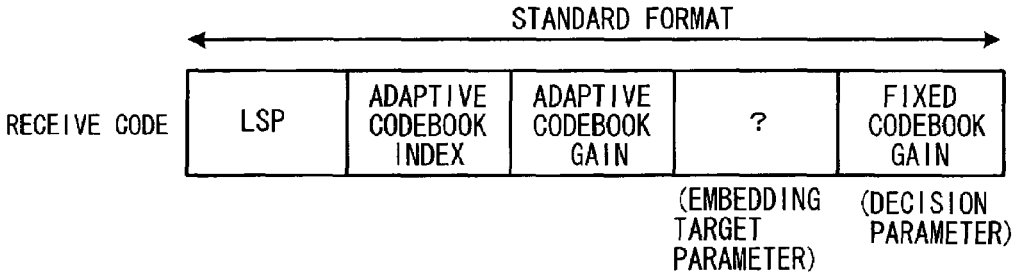
FIG. 17
| | | | | | |
|---|---|---|---|---|---|
| (1) RESULT OF DETERMINATION | LSP | ADAPTIVE CODEBOOK INDEX | ADAPTIVE CODEBOOK GAIN | FIXED CODEBOOK INDEX | FIXED CODEBOOK GAIN |
| (2) RESULT OF DETERMINATION | LSP | ADAPTIVE CODEBOOK INDEX | ADAPTIVE CODEBOOK GAIN | EMBEDDED DATA (OPTIONAL) | FIXED CODEBOOK GAIN |

| | | | | | |
|---|---|---|---|---|---|
| (1) RESULT OF DETERMINATION | LSP | ADAPTIVE CODEBOOK INDEX | ADAPTIVE CODEBOOK GAIN | FIXED CODEBOOK INDEX | FIXED CODEBOOK GAIN |
| (2) RESULT OF DETERMINATION | LSP | EMBEDDED DATA (OPTIONAL) | ADAPTIVE CODEBOOK INDEX | FIXED CODEBOOK INDEX | FIXED CODEBOOK GAIN |

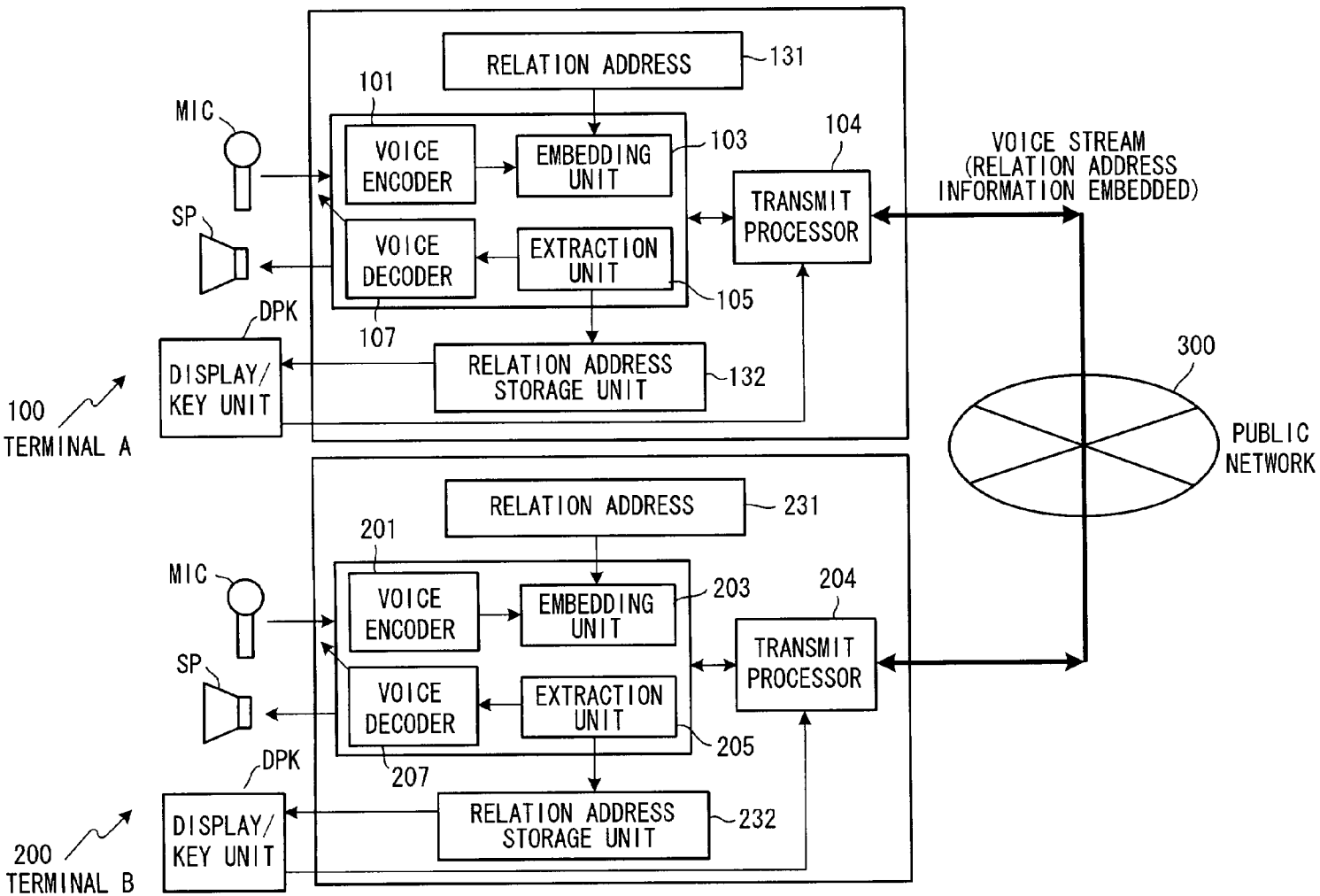
FIG. 35
VOICE STREAM (RELATION ADDRESS INFORMATION EMBEDDED)
300
PUBLIC NETWORK
RELATION ADDRESS
131
TRANSMIT PROCESSOR
104
EMBEDDING UNIT
103
EXTRACTION UNIT
105
RELATION ADDRESS STORAGE UNIT
132
VOICE ENCODER
101
VOICE DECODER
107
MIC
SP
DPK
DISPLAY/ KEY UNIT
100 TERMINAL A
RELATION ADDRESS
231
TRANSMIT PROCESSOR
204
EMBEDDING UNIT
203
EXTRACTION UNIT
205
RELATION ADDRESS STORAGE UNIT
232
VOICE ENCODER
201
VOICE DECODER
207
MIC
SP
DPK
DISPLAY/ KEY UNIT
200 TERMINAL B

| PT (PAYLOAD TYPE) VALUE | MEDIA TYPE | CODEC TYPE |
|---|---|---|
| 0 | VOICE | PCMU(μ law PCM) |
| 8 | VOICE | PCMA(A law PCM) |
| 4 | VOICE | G.723.1 |
| 18 | VOICE | G.729 |
| 34 | IMAGE | H.263 |

(a)

| Cp |
|---|
| 6, 7, 11, 12, 16, 17, 21, 22, 26, 27, 31, 32, 36, 37, 41, 42, 46, 47, 51, 52, 56, 57, 61, 62, 66, 67, 71, 72, 76, 77, 81, 82, 86, 87, 91, 92, 96, 97, 101, 102, 106, 107, 111, 112, 116, 117, 121, 122, 126, 127, 131, 132, 136, 137, 141, 142, 146, 147 |

(b)

METHOD AND SYSTEM FOR EMBEDDING AND EXTRACTING DATA FROM ENCODED VOICE CODE

CROSS-REFERENCE TO RELATED APPLICATION

This application is a continuation-in-part of our application Ser. No. 10/278,108 filed on Oct. 22, 2002 now abandoned, the disclosure of which is hereby incorporated by reference.

BACKGROUND OF THE INVENTION

This invention relates to a technique for processing a digital voice signal, in the fields of application of packet voice communication and digital voice storage. More particularly, the invention relates to a data embedding technique in which a portion of encoded voice code (digital code) that has been produced by a voice compression technique is replaced with optional data to thereby embed the optional data in the encoded voice code while maintaining conformance to the specifications of the data format and without sacrificing voice quality.

Such a data embedding technique, in conjunction with voice encoding techniques applied to digital mobile wireless systems, packet voice transmission systems typified by VoIP, and digital voice storage, is meeting with greater demand and is becoming more important as an digital watermark technique, through which the concealment of communication is enhanced by embedding copyright or ID information in a transmit bit sequence without affecting the bit sequence, and as a functionality extending technique.

The explosive growth of the Internet has been accompanied by increasing demand for Internet telephony for the transmission of voice data by IP packets. The transmission of voice data by packets has the advantage of making possible the unified transmission of different media, such as commands and image data. Until now, however, multimedia communication has mainly been transmission independently over different channels. Further, though services through which telephone rates for users are lowered by the insertion of advertisements and the like are also available, such services are provided only at the outset when the call is initiated. In addition, by transmitting voice data in the form of packets, different media such as commands and image data can be transmitted in unified fashion. Since the transmission format is well known, however, a problem arises in terms of concealment of information. With this as a background, digital watermark techniques for embedding copyright information in compressed voice data (code) have been proposed.

In order to raise the efficiency of transmission, voice encoding techniques for the highly efficient compression of voice have been adopted. In particular, in the area of VoIP, voice encoding techniques such as those compliant with G.729 standardized by the ITU-T (International Telecommunications Union-Telecommunications Standardization Sector) are dominant. Voice encoding techniques such as AMR (Adaptive Multi-Rate) standardized by 3GPP ($3^{rd}$ Generation Partnership Project) have been adopted even in the field of mobile communications. What these techniques have in common is that they are based upon an algorithm referred to as CELP (Code Excited Linear Prediction). Encoding and decoding schemes compliant with G.729 are as set forth below.

Structure and Operation of Encoder

FIG. 41 is a diagram illustrating the structure of an encoder compliant with ITU-T Recommendation G.729. In FIG. 41, an input signal (voice signal) X of a predetermined number (=N) of samples per frame is input to an LPC (Linear Predictive Coding) analyzer 1 frame by frame. If the sampling speed is 8 kHz and the duration of one frame is 10 ms, then one frame will be composed of 80 samples. The LPC analyzer 1, which is regarded as an all-pole filter represented by the following equation, obtains filter coefficients $\alpha i$ (i=1, . . . , p), where p represents the order of the filter:

$$H(z)=1/[1+\Sigma\alpha i\cdot z^{-i}](i=1 \text{ to } M) \quad (1)$$

Generally, in the case of voice in the telephone band, a value of 10 to 12 is used as p. The LPC analyzer 1 performs LPC analysis using 80 samples of the input signal, 40 pre-read samples and 120 past signal samples, for a total of 240 samples, and obtains the LPC coefficients.

A parameter converter 2 converts the LPC coefficients to LSP (Line Spectrum Pair) parameters. An LSP parameter is a parameter of a frequency region in which mutual conversion with LPC coefficients is possible. Since a quantization characteristic is superior to LPC coefficients, quantization is performed in the LSP domain. An LSP quantizer 3 quantizes an LSP parameter obtained by the conversion and obtains an LSP code and an LSP dequantized value. An LSP interpolator 4 obtains an LSP interpolated value from the LSP dequantized value found in the present frame and the LSP dequantized value found in the previous frame. More specifically, one frame is divided into two subframes, namely first and second subframes, of 5 ms each, and the LPC analyzer 1 determines the LPC coefficients of the second subframe but not of the first subframe. Using the LSP dequantized value found in the present frame and the LSP dequantized value found in the previous frame, the LSP interpolator 4 predicts the LSP dequantized value of the first subframe by interpolation.

A parameter deconverter 5 converts the LSP dequantized value and the LSP interpolated value to LPC coefficients and sets these coefficients in an LPC synthesis filter 6. In this case, the LPC coefficients converted from the LSP interpolated values in the first subframe of the frame and the LPC coefficients converted from the LSP dequantized values in the second subframe are used as the filter coefficients of the LPC synthesis filter 6. In the description that follows, the "1" in items having a subscript attached to the "1", e.g., lspi, $li^{(n)}$, . . . , is the letter "1" in the alphabet.

After LSP parameters lspi (i=1, . . . , M) are quantized by vector quantization in the LSP quantizer 3, the quantization indices (LSP codes) are sent to a decoder.

Next, excitation and gain search processing is executed. Excitation and gain are processed on a per-subframe basis. First, a excitation signal is divided into a periodic component and a non periodic component, an adaptive codebook 7 storing a sequence of past excitation signals is used to quantize the periodic component and an algebraic codebook or fixed codebook is used to quantize the non periodic component. Described below will be voice encoding using the adaptive codebook 7 and a fixed codebook 8 as excitation codebooks.

The adaptive codebook 7 is adapted to output N samples of excitation signals (referred to as "periodicity signals"), which are delayed successively by one sample, in association with indices 1 to L, where N represents the number of samples in one subframe. The adaptive codebook 7 has a buffer for storing the periodic component of the latest (L+39) samples. A periodicity signal comprising $1^{st}$ to $40^{th}$ samples is specified by index 1, a periodicity signal comprising $2^{nd}$ to $41^{st}$ samples is specified by index 2, . . . , and a periodicity signal comprising Lth to (L+39)th samples is specified by index L. In the initial state, the content of the adaptive codebook 7 is such that all signals have amplitudes of zero. Operation is such that a subframe length of the oldest signals is discarded subframe by subframe in terms of time so that the excitation signal obtained in the present frame will be stored in the adaptive codebook 7.

An adaptive-codebook search identifies the periodicity component of the excitation signal using the adaptive codebook 7 storing past excitation signals. That is, a subframe length (=40 samples) of past excitation signals in the adaptive codebook 7 is extracted while changing, one sample at a time, the point at which read-out from the adaptive codebook 7 starts, and the excitation signals are input to the LPC synthesis filter 6 to create a pitch synthesis signal $\beta AP_L$, where $P_L$ represents a past pitch periodicity signal (adaptive excitation vector), which corresponds to delay L, extracted from the adaptive codebook 7, A the impulse response of the LPC synthesis filter 6, and β the gain of the adaptive codebook.

An arithmetic unit 9 finds an error power $E_L$ between the input voice X and $\beta AP_L$ in accordance with the following equation:

$$E_L=|X-\beta AP_L|^2 \tag{2}$$

If we let $AP_L$ represent a weighted synthesized output from the adaptive codebook, Rpp the autocorrelation of $AP_L$ and Rxp the cross-correlation between $AP_L$ and the input signal X, then an adaptive excitation vector $P_L$ at a pitch lag Lopt for which the error power of Equation (2) is minimum will be expressed by the following equation:

$$PL=argmax(Rxp^2/Rpp) \tag{3}$$

That is, the optimum starting point for read-out from the codebook is that at which the value obtained by normalizing the cross-correlation Rxp between the pitch synthesis signal $AP_L$ and the input signal X by the autocorrelation Rpp of the pitch synthesis signal is largest. Accordingly, an error-power evaluation unit 10 finds the pitch lag Lopt that satisfies Equation (3). Optimum pitch gain βopt is given by the following equation:

$$\beta opt=Rxp/Rpp \tag{4}$$

Next, the non periodic component contained in the excitation signal is quantized using the fixed codebook 8. The latter is constituted by a plurality of pulses of amplitude 1 or −1. By way of example, Table 1 illustrates pulse positions for a case where subframe length is 40 samples.

TABLE 1

G.729A-COMPLIANT FIXED CODEBOOK

| PULSE SYSTEM | PULSE POSITION | POLARITY |
|---|---|---|
| $i_0$:1 | $m_0$:<br>0, 5, 10, 15, 20, 25, 30, 35 | $s_0$<br>+/− |
| $i_1$:2 | $m_1$:<br>1, 6, 11, 16, 21, 26, 31, 36 | $s_1$<br>+/− |
| $i_2$:3 | $m_2$:<br>2, 7, 12, 17, 22, 27, 32, 37 | $s_2$<br>+/− |

TABLE 1-continued

G.729A-COMPLIANT FIXED CODEBOOK

| PULSE SYSTEM | PULSE POSITION | POLARITY |
|---|---|---|
| $i_3$:4 | $m_3$:<br>3, 8, 13, 18, 23, 28, 33, 38<br>4, 9, 14, 19, 24, 29, 34, 39 | $s_3$<br>+/− |

The algebraic codebook 8 divides the N (=40) sampling points constituting one subframe into a plurality of pulse-system groups 1 to 4 and, for all combinations obtained by extracting one sampling point $m_0$~$m_3$ from each of the pulse-system groups, successively outputs, as non periodic components, pulsed signals having a +1 or a −1 pulse at each sampling point. In this example, basically four pulses are deployed per subframe.

FIG. 42 is a diagram useful in describing sampling points assigned to each of the pulse-system groups 1 to 4.

(1) Eight sampling points 0, 5, 10, 15, 20, 25, 30, 35 are assigned to the pulse-system group 1;

(2) eight sampling points 1, 6, 11, 16, 21, 26, 31, 36 are assigned to the pulse-system group 2;

(3) eight sampling points 2, 7, 12, 17, 22, 27, 32, 37 are assigned to the pulse-system group 3; and (4) 16 sampling points 3, 4, 8, 9, 13, 14, 18, 19, 23, 24, 28, 29, 33, 34, 38, 39 are assigned to the pulse-system group 4.

Three bits are required to express the sampling points in pulse-system groups 1 to 3 and one bit is required to express the sign of a pulse, for a total of four bits. Further, four bits are required to express the sampling points in pulse-system group 4 and one bit is required to express the sign of a pulse, for a total of five bits. Accordingly, 17 bits are necessary to specify a pulsed excitation signal output from the fixed codebook 8 having the pulse placement of Table 1, and $2^{17}$ ($=2^4\times2^4\times2^4\times2^5$) types of pulsed excitation signals exist.

The pulse positions of each of the pulse systems are limited, as illustrated in Table 1. In the fixed codebook search, a combination of pulses for which the error power relative to the input voice is minimized in the reconstruction region is decided from among the combinations of pulse positions of each of the pulse systems. More specifically, with βopt as the optimum pitch gain found by the adaptive-codebook search, the output $P_L$ of the adaptive codebook is multiplied by βopt and the product is input to an adder 11. At the same time, the pulsed excitation signals are input successively to the adder 11 from the fixed codebook 8 and a pulsed excitation signal is specified that will minimize the difference between the input signal X and a reproduced signal obtained by inputting the adder output to the LPC synthesis filter 6. More specifically, first a target vector X' for a fixed codebook search is generated in accordance with the following equation from the optimum adaptive codebook output $P_L$ and optimum pitch gain βopt obtained from the input signal X by the adaptive-codebook search:

$$X'=X-\beta optAP_L \tag{5}$$

In this example, pulse position and amplitude (sign) are expressed by 17 bits and therefore $2^{17}$ combinations exist. Accordingly, letting $C_K$ represent a kth excitation vector, a excitation vector $C_K$ that will minimize an evaluationfunction error power D in the following equation is found by a search of the fixed codebook:

$$D=|X'-G_cAC_K|^2 \quad (6)$$

where $G_C$ represents the gain of the fixed codebook. In the fixed codebook search, the error-power evaluation unit 10 searches for the combination of pulse position and polarity that will afford the largest normalized cross-correlation value (Rcx*Rcx/Rcc) obtained by normalizing the square of a cross-correlation value Rcx between a noise synthesis signal $AC_K$ and input signal X' by an autocorrelation value Rcc of the noise synthesis signal.

Gain quantization will be described next. With the G.729system, fixed codebook gain is not quantized directly. Rather, the adaptive codebook gain $G_a$ (=βopt) and a correction coefficient γ of the fixed codebook gain $G_c$ are vector quantized. The fixed codebook gain $G_c$ and the correction coefficient γ are related as follows:

$$G_C=g'\times\gamma$$

where g' represents the gain of the present frame predicted from the logarithmic gains of the four past subframes.

A gain quantizer 12 has a gain quantization table, not shown, for which there are prepared 128 (=$2^7$) combinations of adaptive codebook gain $G_a$ and correction coefficients γ for fixed codebook gain. The method of the gain codebook search includes ① extracting one set of table values from the gain quantization table with regard to an output vector from the adaptive codebook and an output vector from the fixed codebook and setting these values in gain varying units 13, 14, respectively; ② multiplying these vectors by gains $G_a$, $G_c$ using the gain varying units 13, 14, respectively, and inputting the products to the LPC synthesis filter 6; and ③ selecting, by way of the error-power evaluation unit 10, the combination for which the error power relative to the input signal X is smallest.

A channel multiplexer 15 creates channel data by multiplexing ① an LSP code, which is the quantization index of the LSP, ② a pitch-lag code Lopt, which is the quantization index of the adaptive codebook, ③ a noise code, which is an fixed codebook index, and ④ a gain code, which is a quantization index of gain. In actuality, it is necessary to perform channel encoding and packetization processing before transmission to the transmission line Decoder Structure and Operation FIG. 43 is a block diagram illustrating a G.729A-compliant decoder. Channel data received from the channel side is input to a channel demultiplexer 21, which proceeds to separate and output an LSP code, pitch-lag code, noise code and gain code. The decoder decodes speech data based upon these codes. The operation of the decoder will now be described in brief, though parts of the description will be redundant because functions of the decoder are included in the encoder.

Upon receiving the LSP code as an input, an LSP dequantizer 22 applies dequantization and outputs an LSP dequantized value. An LSP interpolator 23 interpolates an LSP dequantized value of the first subframe of the present frame from the LSP dequantized value in the second subframe of the present frame and the LSP dequantized value in the second subframe of the previous frame. Next, a parameter deconverter 24 converts the LSP interpolated value and the LSP dequantized value to LPC synthesis filter coefficients. A G.729A-compliant synthesis filter 25 uses the LPC coefficient converted from the LSP interpolated value in the initial first subframe and uses the LPC coefficient converted from the LSP dequantized value in the ensuing second subframe.

An adaptive codebook 26 outputs a pitch signal of subframe length (=40 samples) from a read-out starting point specified by a pitch-lag code, and a fixed codebook 27 outputs a pulse position and pulse polarity from a read-out position that corresponds to an algebraic code. A gain dequantizer 28 calculates an adaptive codebook gain dequantized value and a fixed codebook gain dequantized value from the gain code applied thereto and sets these values in gain varying units 29, 30, respectively. An adder 31 creates a excitation signal by adding a signal, which is obtained by multiplying the output of the adaptive codebook by the adaptive codebook gain dequantized value, and a signal obtained by multiplying the output of the fixed codebook by the fixed codebook gain dequantized value. The excitation signal is input to an LPC synthesis filter 25. As a result, reproduced voice can be obtained from the LPC synthesis filter 25.

In the initial state, the content of the adaptive codebook 26 on the decoder side is such that all signals have amplitudes of zero. Operation is such that a subframe length of the oldest signals is discarded subframe by subframe in terms of time so that the excitation signal obtained in the present frame will be stored in the adaptive codebook 26. In other words, the adaptive codebook 7 of the encoder and the adaptive codebook 26 of the decoder are always maintained in the identical, latest state.

Digital Watermark Technique

The specification of Japanese Patent Application Laid-Open No. 11-272299 discloses a "Method of Embedding Watermark Bits when Encoding Voice" as an digital watermark technique to which CELP is applied. FIG. 44 is a diagram useful in describing such an digital watermark technique. In Table 1, refer to the fourth pulse system $i_3$. Unlike the pulse positions $m_0$ to $m_2$ of the other first to third pulse systems $i_0$ to $i_2$, the pulse position $m_3$ of the fourth pulse system $i_3$ differs in that there are mutually adjacent candidates for this position. In accordance with the G.729 standard, pulse position in the fourth pulse system $i_3$ is such that it does not matter if either of the adjacent pulse positions is selected. For example, pulse position $m_3$=4 in the fourth pulse system $i_3$ may be replaced with pulse position $m_3'$=3, and there will be almost no influence upon the human sense of hearing even if encoded voice code is reproduced following such substitution. Accordingly, an 8-bit key Kp is introduced in order to label the $m_3$ candidates. For example, as shown in FIG. 44, Kp=00001111 holds, candidates 3, 8, 13, 18, 23, 28, 33, 38 of m3 are mapped to respective ones of the bits of Kp, *Kp=11110000 holds and candidates 4, 9, 14, 19, 24, 29, 34, 39 of $m_3$ are mapped to respective ones of the bits of *Kp. If mapping is performed in this manner, all of the candidates of $m_3$ can be labeled "0" or "1" in accordance with the key Kp. If a watermark bit "0" is to be embedded in encoded voice code under these conditions, $m_3$ is selected from candidates that have been labeled "0" in accordance with the key Kp. If a watermark bit "1" is to be embedded, on the other hand, $m_3$ is selected from candidates that have been labeled "1" in accordance with the key Kp. This method makes it possible to embed binarized watermark information is encoded voice code. Accordingly, by furnishing both the transmitter and receiver with the key Kp, it is possible to embed and extract watermark information. Since 1-bit watermark information can be embedded every 5-ms subframe, 200 bits can be embedded per second.

If watermark information is embedded in all codes using the same key Kp, there is a good possibility of decryption by an unauthorized third party. This makes it necessary to enhance concealment. If the total value of $m_0$ to $m_3$ is represented by Cp, the total value will be any of the 58 shown at (a) of FIG. 45. Accordingly, a second key Kcon of 58 bits is introduced and the 58 total values Cp are mapped to respective ones of the bits of this key, as illustrated at (b) in FIG. 45. The total value (72 in FIG. 45) of $m_0$ to $m_3$ in noise code when voice has been encoded is calculated and it is determined whether a bit value Cpb of the Kcon conforming to this total value is "0" or "1". When Cpb="1" holds, a watermark bit is embedded in the encoded voice code in accordance with FIG. 44. If Cpb="0" holds, a watermark bit is not embedded. If this arrangement is adopted, a third party who does not know the key Kcon would find it difficult to decrypt the watermark information.

In cases where other media are transmitted on channels that are independent of the voice channel, basically it is required that the terminals at both ends provide multichannel support. A problem which arises in such cases is that limitations are imposed at the terminals connected to a conventional communications network. This is true with regard to $2^{nd}$ generation mobile telephones, for example, which presently are in most widespread use. Further, even if the terminals at both ends offer multichannel support and make it possible to transmit a plurality of media, routes have a random nature in the case of packet switching, making it difficult to achieve synchronization and linkage at repeaters along the way. A particular problem is that complicated control such as route setting and synchronization processing is required for linkage that employs data accompanying voice per se issued by a specific user.

With the conventional digital watermark technique, use of a key is essential. In addition, the target of embedded data is limited to a pulse position in the fourth pulse system of the fixed codebook. As a consequence, there is a good possibility that the existence of the key will become known to the user. If the user becomes aware of the key, the user can specify the embedded position. This leads to the possibility of leakage and falsification of data.

Further, with the conventional digital watermark technique, since the foregoing is "probability-based" control in which execution or non-execution of data embedding depends upon the total value of pulse position candidates, there is a possibility that the sound-quality degrading effect of embedding of data will be significant. There is need for a data embedding technique as a communication standard in which the embedding of data is concealed, i.e., in which there is no decline in sound quality when decoding (reproduced voice) is performed at a terminal. However, since the prior-art technique results in degraded sound quality, it has not been able to satisfy this need.

SUMMARY OF THE INVENTION

Accordingly, an object of the present invention is to so arrange it that data can be embedded in encoded voice code on the encoder side and extracted correctly on the decoder side without both the encoder and decoder sides possessing a key.

Another object of the present invention is to so arrange it that there is almost no decline in sound quality even if data is embedded in encoded voice code, thereby making the embedding of data concealed to the listener of reproduced voice.

A further object of the present invention is to make the leakage and falsification of embedded data difficult to achieve.

Still another object of the present invention is to so arrange it that both data and control code can be embedded, thereby enabling the decoder side to execute processing in accordance with the control code.

Another object of the present invention is to so arrange it that the transmission capacity of embedded data can be increased.

Another object of the present invention is to make it possible to transmit multimedia such as voice, images and personal information on a voice channel alone.

Another object of the present invention is to so arrange it that any information such as advertisement information can be provided to end users performing mutual communication of voice data.

Another object of the present invention is to so arrange it that sender, recipient, receive time and call category, etc., can be embedded and stored in voice data that has been received.

According to a first aspect of the present invention, when optional data is embedded in encoded voice code, it is determined whether data embedding conditions are satisfied using a first element code, from among element codes constituting the encoded voice code, and a threshold value, and optional data is embedded in the encoded voice code by replacing a second element code with the optional data if the data embedding conditions are satisfied. More specifically, the first element code is a fixed codebook gain code and the second element code is a noise code, which is an index of a fixed codebook. When a dequantized value of the fixed codebook gain code is smaller than the threshold value, it is determined that the data embedding conditions are satisfied and the noise code is replaced with prescribed data, whereby the data is embedded in the encoded voice code. In another concrete example, the first element code is a pitch-gain code and the second element code is a pitch-lag code, which is an index of an adaptive codebook. When a dequantized value of the pitch-gain code is smaller than the threshold value, it is determined that the data embedding conditions are satisfied and the pitch-lag code is replaced with optional data, whereby the optional data is embedded in the encoded voice code.

Taking note of two types of code vectors of a excitation signal, namely an adaptive code vector (pitch-lag code) corresponding to the pitch excitation and a fixed code vector (noise code) corresponding to the noise excitation, it is possible to regard gain as being a factor that indicates the degree of contribution of each code vector. Accordingly, gain is defined as a decision parameter. If the gain is less than a threshold value, it is determined that the degree of contribution of the corresponding excitation code vector is low and the index of this excitation code vector is replaced with an optional data sequence. As a result, it is possible to embed optional data while suppressing the effects of this replacement. Further, by controlling the threshold value, the amount of embedded data can be adjusted while taking into account the effect upon reproduced speech quality.

According to a second aspect of the present invention, when extracting data that has been embedded in encoded voice code encoded by a prescribed voice encoding scheme, it is determined whether data embedding conditions are satisfied using a first element code, from among element codes constituting the encoded voice code, and a threshold value, and the embedded data is extracted upon determining that data has been embedded in a second element code portion of the encoded voice code if the data embedding conditions are satisfied. More specifically, the first element code is a fixed codebook gain code and the second element code is a noise code, which is an index of a fixed codebook. When a dequantized value of the fixed codebook gain code is smaller than the threshold value, it is determined that the data embedding conditions are satisfied and the embedded data is extracted from the noise code. In another concrete example, the first element code is a pitch-gain code and the second element code is a pitch-lag code, which is an index of an adaptive codebook. When a dequantized value of the pitch-gain code is smaller than the threshold value, it is determined that the data embedding conditions are satisfied and the embedded data is extracted from the pitch-lag code.

If this arrangement is adopted, data can be embedded in encoded voice code on the encoder side and extracted correctly on the decoder side without both the encoder and decoder sides possessing a key. Further, it can be so arranged that there is almost no decline in sound quality even if data is embedded in encoded voice code, thereby making the embedding of data concealed to the listener of reproduced voice. Further, it can be made difficult to leak or falsify embedded data by changing threshold values.

According to a third aspect of the present invention, a voice encoding apparatus in a system having a voice encoding apparatus and a voice reproducing apparatus encodes voice by a prescribed voice encoding scheme and embeds optional data in the encoded voice code obtained. The voice reproducing apparatus extracts embedded data from the encoded voice code and reproduces voice from the encoded voice code. In this system, a first element code and a threshold value, which are used to determine whether data has been embedded or not, and a second element code in which data is embedded based upon result of the determination, are defined. When the voice encoding apparatus embeds data under these conditions, the voice encoding apparatus determines whether data embedding conditions are satisfied using the first element code, from among element codes constituting the encoded voice code, and the threshold value, and embeds optional data in the encoded voice code by replacing the second element code with the optional data if the data embedding conditions are satisfied. When data is extracted, on the other hand, the voice reproducing apparatus determines whether data embedding conditions are satisfied using the first element code, from among element codes constituting the encoded voice code, and the threshold value, determines that optional data has been encoded in the second element code of the encoded voice code if the data embedding conditions are satisfied, extracts the embedded data and then subjects the encoded voice code to decoding processing.

As a result, if only an initial value of a threshold value is defined in advance on both the transmitting and receiving sides, data can be embedded and extracted without using a key. Further, if a control code is defined as embedded data, a threshold value can be changed using this control code, and the amount of embedded data transmitted can be adjusted by changing the threshold value. Further, whether to embed only a data sequence, or whether to embed a data/control code sequence in a format that makes it possible to identify the type of data and control code, is decided in dependence upon a gain value. In a case where only a data sequence is embedded, therefore, it is unnecessary to include data-type information. This makes possible improvements relating to transmission capacity.

According to a fourth aspect of the present invention, there is provided a digital voice communication system for encoding voice by a prescribed voice encoding scheme and transmitting the encoded voice, comprising means for analyzing voice data obtained by encoding input voice; means for embedding any code in a specific segment of a portion of the voice data in accordance with result of analysis; and means for transmitting the embedded data as voice data; whereby additional data is transmitted at the same time as ordinary voice. According to the fourth aspect of the present invention, there is further provided a digital voice communication system comprising means for analyzing received voice data; and means for extracting code from a specific segment of a portion of the voice data in accordance with result of analysis; whereby additional data is received and output at the same time as ordinary voice.

Multimedia communication becomes possible by adopting image information (video of present surroundings and map images, etc.) and personal information (a portrait photograph, voice print or finger print, etc.), etc., as the additional information. Further, by adopting a terminal serial number or voice print, etc., as the personal information, the performance of authentication as to whether or not an individual is an authorized user can be enhanced. Moreover, it is possible to improve the security of voice data.

Further, the digital voice communication system is provided with a server apparatus for relaying voice data. It can be so arranged that optional information such as advertisement information is provided to end users, who are performing mutual communication of voice data, by the server.

Further, by embedding sender, recipient, receive time and call category, etc., in received voice data and storing the same in storage means, it is possible to put voice data into file form so that subsequent utilization can be facilitated.

Other features and advantages of the present invention will be apparent from the following description taken in conjunction with the accompanying drawings.

BRIEF DESCRIPTION OF THE DRAWINGS

FIG. 15 is a block diagram of an embedding decision unit for a case where data has been embedded in noise code;

FIG. 16 illustrates the standard format of a receive encoded voice code;

FIG. 17 is a diagram useful in describing the results of determination processing by the data embedding decision unit;

FIG. 35 is a block diagram illustrating the configuration of a digital voice communication system that transmits relation address information at the same time as voice by embedding the relation address information;

DESCRIPTION OF THE PREFERRED EMBODIMENTS

(A) Principle of the Present Invention

Figure 1:
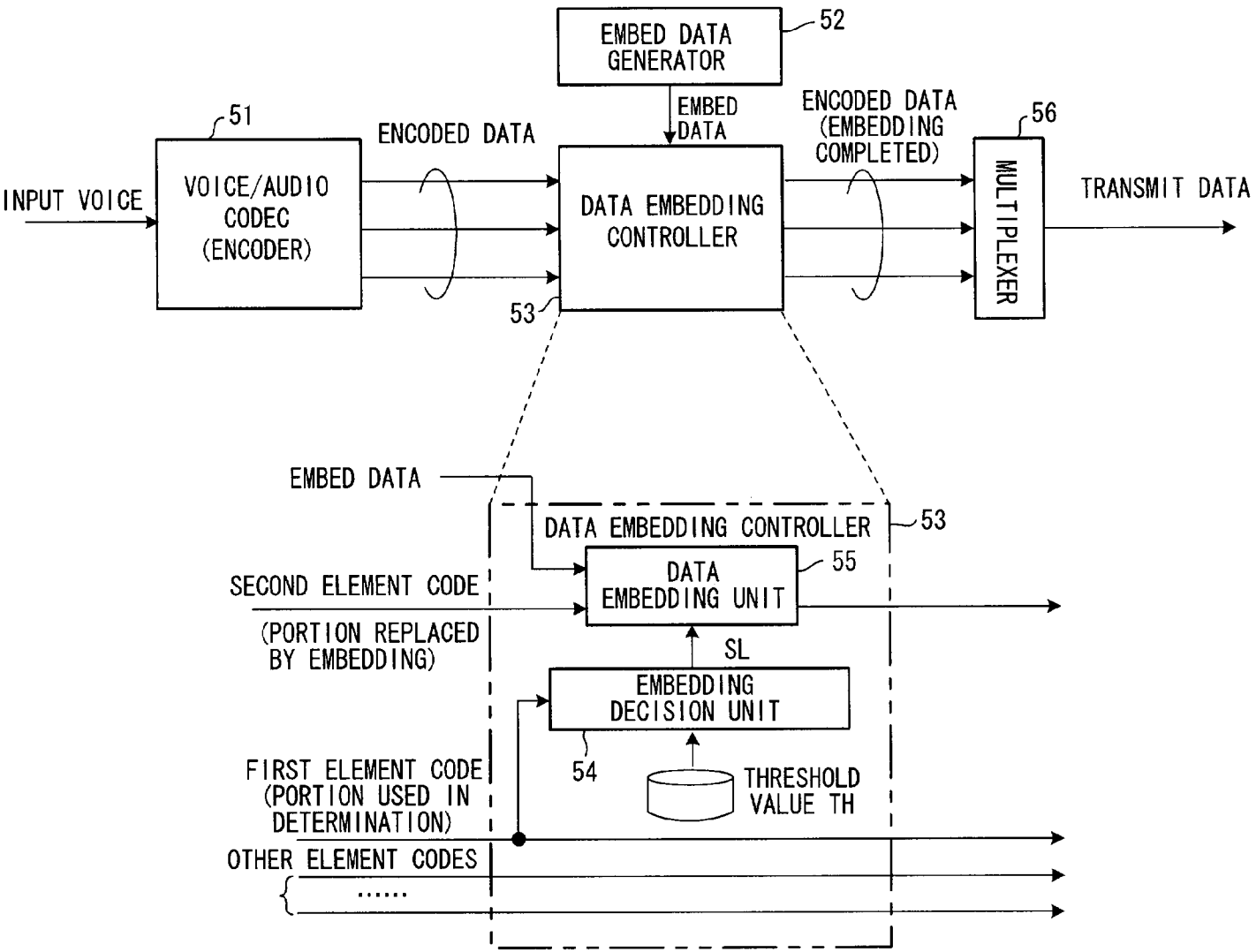
FIG. 1 is a block diagram showing the general arrangement of structural components on the side of an encoder according to the present invention.

With a decoder that operates in accordance with the CELP algorithm, a excitation signal is generated based upon an index, which specifies a excitation sequence, and gain information, voice is generated (reproduced) using a synthesis filter constituted by linear prediction coefficients, and reproduced voice is expressed by the following equation:

$$Srp=H\cdot R=H(Gp\cdot P+Gc\cdot C)=H\cdot Gp\cdot P+H\cdot Gc\cdot C$$

where Srp represents reproduced voice, H an LPC synthesis filter, Gp adaptive code vector gain (pitch gain), P an adaptive code vector (pitch-lag code), Gc noise code vector gain (fixed codebook gain), and C a noise code vector. The first term on the right side is a pitch-period synthesis signal and the second term is a noise synthesis signal.

As set forth above, digital codes (transmit parameters) encoded according to CELP correspond to feature parameters in a voice generating system. Taking note of these features, is possible to ascertain the status of each transmit parameter. For example, taking note of two types of code vectors of a excitation signal, namely an adaptive code vector corresponding to a pitch excitation and a noise code vector corresponding to a noise excitation, it is possible to regard gains Gp, Gc as being factors that indicate the degree of contribution of the code vectors P, C, respectively. More specifically, in a case where the gains Gp, Gc are low, the degrees of contribution of the corresponding code vectors are low. Accordingly, the gains Gp, Gc are defined as decision parameters. If gain is less than a threshold value, it is determined that the degree of contribution of the corresponding excitation code vector P, C is low and the index of this excitation code vector is replaced with an optional data sequence. As a result, it is possible to embed optional data while suppressing the effects of this replacement. Further, by controlling the threshold value, the amount of embedded data can be adjusted while taking into account the effect upon reproduced speech quality.

This technique is such that if only an initial value of a threshold value is defined in advance on both the transmitting and receiving sides, whether or not embedded data exists and the location of embedded data can be determined and, moreover, the writing/reading of embedded data can be performed based solely upon decision parameters (pitch gain and fixed codebook gain) and embedding target parameters (pitch lag and noise code). In other words, transmission of a specific key is not required. Further, if a control code is defined as embedded data, the amount of embedded data transmitted can be adjusted merely by specifying a change in the threshold value by the control code.

Thus, by applying this technique, it is possible to embed any data without changing the encoding format. In other words, an ID or other media information can be embedded in voice information and transmitted/stored without sacrificing the compatibility that is essential in communication/ storage applications and without the user being aware. In addition, according to the present invention, control specifications are stipulated by parameters common to CELP. This means that the invention is not limited to a specific scheme and therefore can be applied to a wide range of schemes. For example, G.729 suited to VoIP and AMR suited to mobile communications can be supported.

(B) Embodiment Relating to Encoder Side (a) General Structure

FIG. 1 is a block diagram showing the general arrangement of structural components on the side of an encoder according to the present invention. A voice/audio CODEC (encoder) 51 encodes input voice in accordance with a prescribed encoding scheme and outputs the encoded voice code (code data) thus obtained. The encoded voice code is composed of a plurality of element codes. An embed data generator 52 generates prescribed data for being embedded in encoded voice code. A data embedding controller 53, which has an embedding decision unit 54 and a data embedding unit 55 constructed as a selector, embeds data in encoded voice code as appropriate. Using a first element code, which is from among element codes constituting the encoded voice code, and a threshold value TH, the embedding decision unit 54 determines whether data embedding conditions are satisfied. If these conditions are satisfied, the data embedding unit 55 replaces a second element code with optional embed data to thereby embed the optional data in the encoded voice code. If the data embedding conditions are not satisfied, the data embedding unit 55 outputs the second element code as is. A multiplexer 56 multiplexes and transmits the element codes that construct the encoded voice code.

Figure 2:
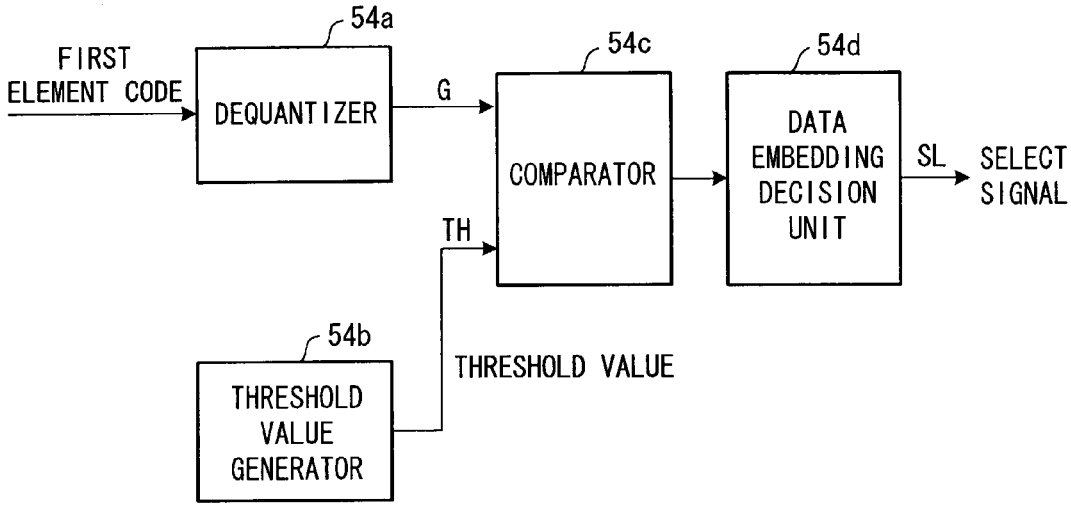
FIG. 2 is a block diagram of an embedding decision unit.

FIG. 2 is a block diagram of the embedding decision unit. A dequantizer 54*a* dequantizes the first element code and outputs a dequantized value G, and a threshold value generator 54*b* outputs the threshold value TH. A comparator 54*c* compares the dequantized value G and the threshold value TH and inputs the result of the comparison to a data embedding decision unit 54*d*. If G≧TH holds, for example, the data embedding decision unit 54*d* determines that the embedding of data is not possible and generates a select signal SL for selecting the second element code, which is output from the encoder 51. If G<TH holds, the data embedding decision unit 54*d* determines that embedding of data is possible and generates a select signal S for selecting embed data that is output from the embed data generator 52. As a result, based upon the select signal SL, the data embedding unit 55 selectively outputs the second element code or the embed data.

In FIG. 2, the first element code is dequantized and compared with the threshold value. However, there is also a case where the comparison can be performed on the code level by setting the threshold value in the form of a code. In such case dequantization is not necessarily required.

(b) First Embodiment

Figure 3:
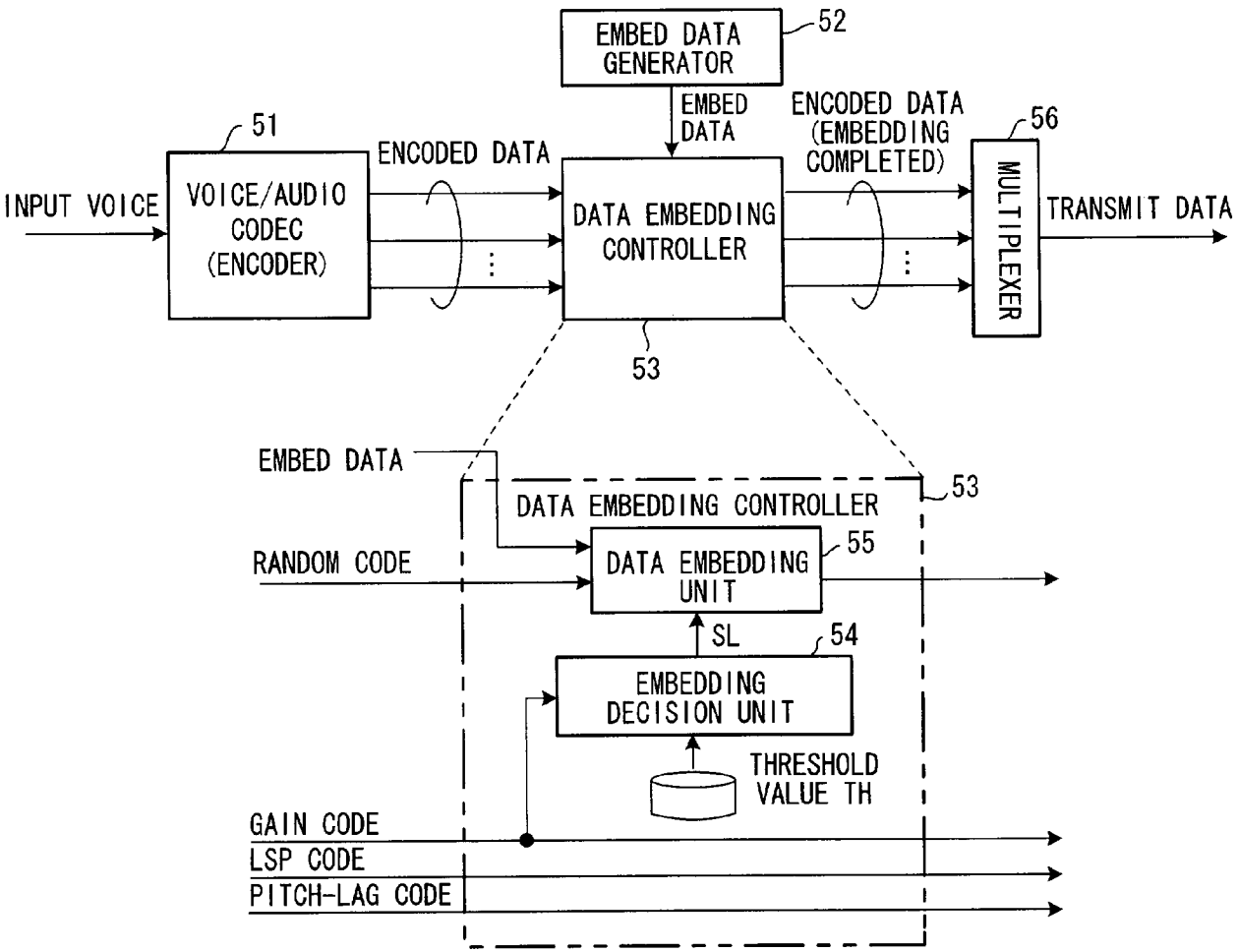
FIG. 3 is a block diagram of a first embodiment for a case where use is made of an encoder for performing encoding in accordance with a G.729-compliant encoding scheme.

FIG. 3 is a block diagram of a first embodiment for a case where use is made of an encoder for performing encoding in accordance with a G.729-compliant encoding scheme. Components identical with those shown in FIG. 1 are designated by like reference characters. This arrangement differs from that of FIG. 1 in that a gain code (fixed codebook gain) is used as the first element code and a noise code, which is an index of a fixed codebook, is used as the second element code.

The codec 51 encodes input voice in accordance with G.729 and inputs the encoded voice code thus obtained to the data embedding controller 53. As shown in Table 2 below, the G.729-compliant encoded voice code has the following as element codes: an LSP code, an adaptive codebook index (pitch-lag code), a fixed codebook index (noise code) and a gain code. The gain code is obtained by combining and encoding pitch gain and fixed codebook gain.

TABLE 2

| ITU-T G.729-COMPLIANT SPECIFICATIONS | |
|---|---|
| BIT RATE | 8 kbit/s |
| FRAME LENGTH | 10 ms |
| SUBFRAME LENGTH | 5 ms |
| TRANSMIT PARAMETERS AND TRANSIT CAPACITY | |
| LSP | 18 bits/10 ms |
| ADAPTIVE CODEBOOK INDEX | 13 bits/10 ms |
| FIXED CODEBOOK INDEX | 17 bits/5 ms |
| GAIN (ADAPTIVE/FIXED CODEBOOK) | 7 bits/5 ms |

The embedding decision unit 54 of the data embedding controller 53 uses the dequantized value of the gain code and the threshold value TH to determine whether data embedding conditions are satisfied, and the data embedding unit 55 replaces noise code with prescribed data to thereby embed the data in the encoded voice code if the data embedding conditions are satisfied. If the data embedding conditions are not satisfied, the data embedding unit 55 outputs the noise element code as is. The multiplexer 56 multiplexes and transmits the element codes that construct the encoded voice code.

Figure 4:
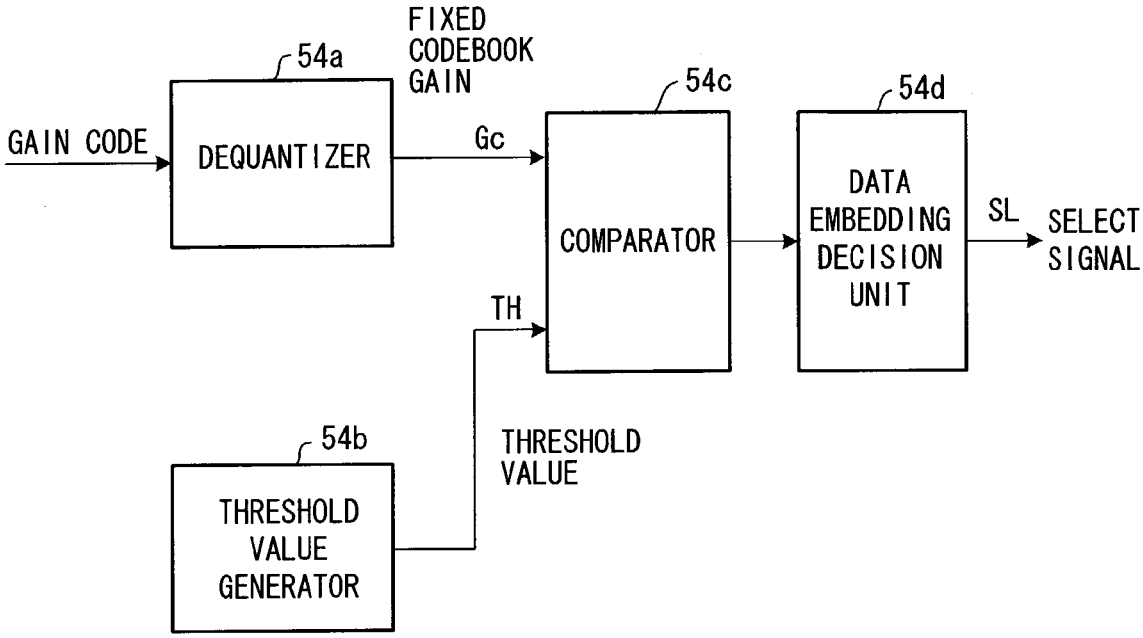
FIG. 4 is a block diagram of an embedding decision unit.

The embedding decision unit 54 has the structure shown in FIG. 4. Specifically, the dequantizer 54*a* dequantizes the gain code and the comparator 54*c* compares the dequantized value (fixed codebook gain) Gc with the threshold value TH. When the dequantized value Gc is smaller than the threshold value TH, the data embedding decision unit 54*d* determines that the data embedding conditions are satisfied and generates a select signal SL for selecting embed data that is output from the embed data generator 52. When the dequantized value Gc is equal to or greater than the threshold value TH, the data embedding decision unit 54*d* determines that the data embedding conditions are not satisfied and generates a select signal SL for selecting a noise code that is output from the encoder 51. Based upon the select signal SL, the data embedding unit 55 selectively outputs the noise code or the embed data.

Figure 5:
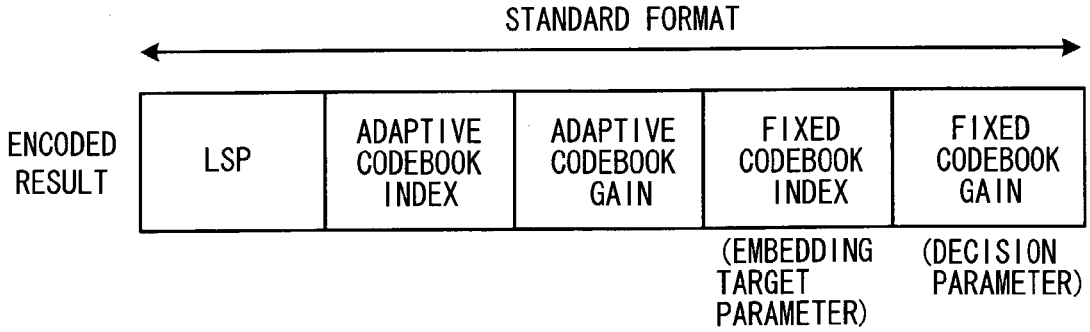
FIG. 5 illustrates the standard format of encoded voice code.
Figure 6:
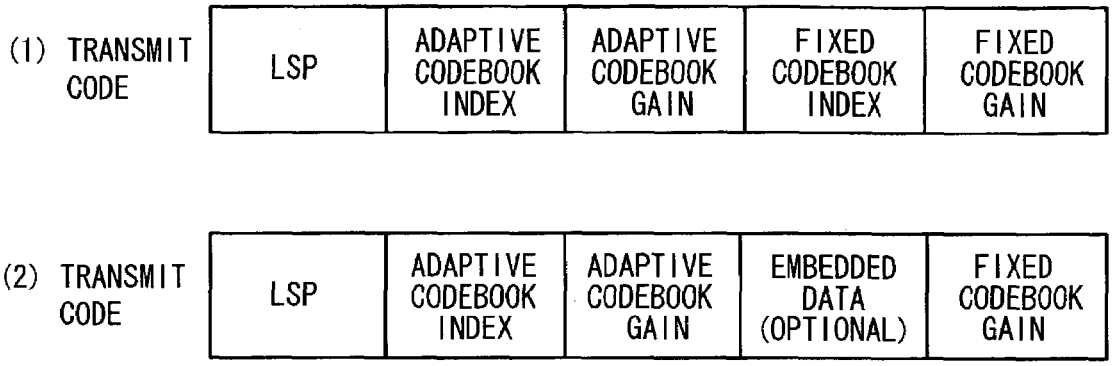
FIG. 6 is a diagram useful in describing transmit code based upon embedding control.

FIG. 5 illustrates the standard format of encoded voice code, and FIG. 6 is a diagram useful in describing transmit code based upon embedding control. These indicate a case where the encoded voice code is composed of five codes (LSP code, adaptive codebook index, adaptive codebook gain, fixed codebook index, fixed codebook gain). In a case where the fixed codebook gain Gc is equal to or greater than the threshold value, data is not embedded in the encoded voice code, as indicated at (1) in FIG. 6. However, if the fixed codebook gain Gc is less than the threshold value TH, then data is embedded in the fixed codebook index portion of the encoded voice code, as indicated at (2) in FIG. 6.

Figure 7:
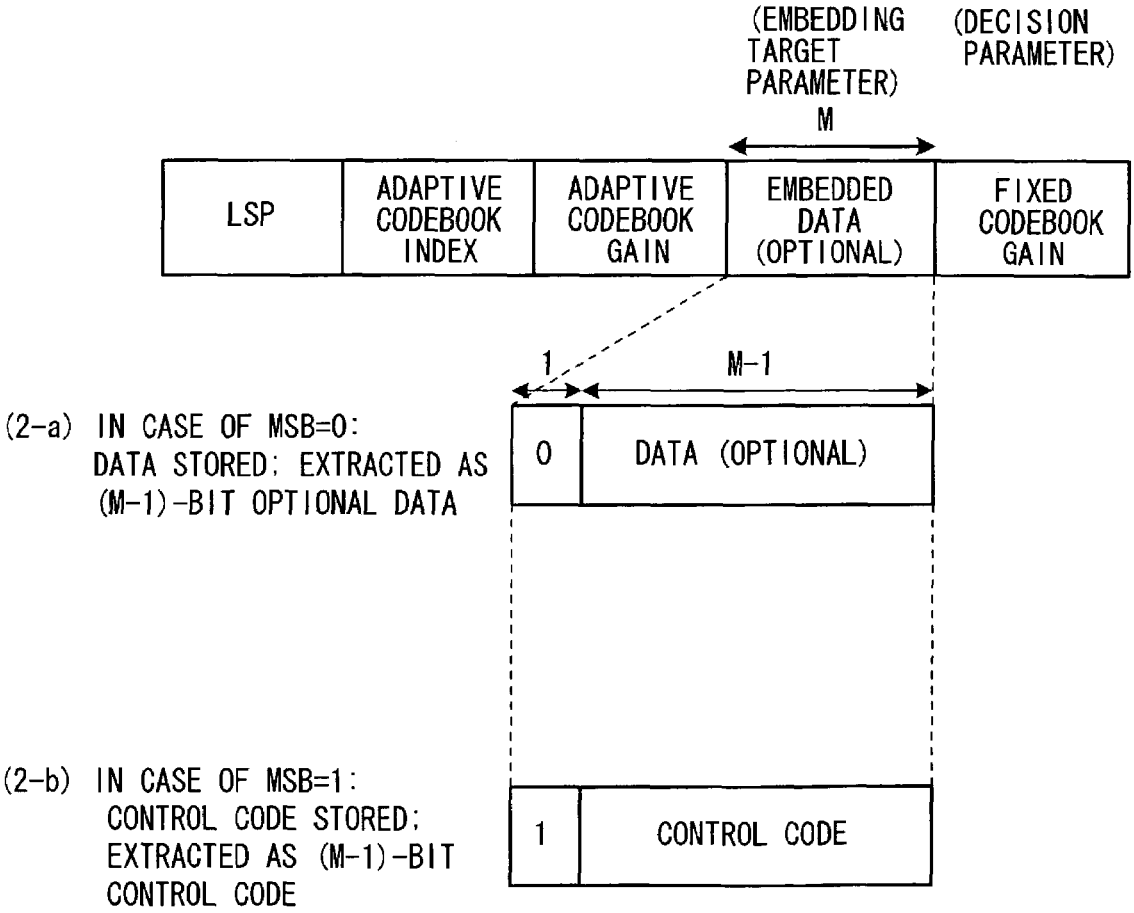
FIG. 7 is a diagram useful in describing a case where data and control code are embedded in a form distinguished from each other.

FIG. 6 illustrates an example for a case where any data is embedded in all M (=17) bits used for the fixed codebook index (noise code). However, by adopting the most significant bit (MSB) as a bit indicative of the type of data, data and a control code can be embedded in the remaining (M−1)-number of bits in a form distinguished from each other, as illustrated in FIG. 7. Thus, by defining a bit, in a portion of the embedded data, that identifies either data or a control code, it is possible to change a threshold value, perform synchronous control, etc., using the control code.

Table 3 below illustrates the result of a simulation in a case where the noise code (17 bits) serving as the fixed codebook index is replaced with any data if gain is less than a certain value in the G.729 voice encoding scheme. Table 3 illustrates the results of evaluating, by SNR, a change in sound quality in a case where voice is reproduced upon adopting randomly generated data as any data and regarding this random data as noise code, as well as the proportion of a frame replaced with embedded data. It should be noted that the threshold values in Table 3 are gain index numbers; the greater the number of index values, the larger the gain serving as the threshold value. Further, SNR is the ratio (in dB) of the excitation signal in a case where the noise code in the encoded voice code is not replaced with data, to an error signal representing the difference between the excitation signal in a case where the noise code is not replaced with data and the excitation signal in a case where the noise code is replaced with data; SNRseg represents the SNR on a per-frame basis; and SNRtot represents the average SNR over the entire voice interval. The proportion (%) is that at which data is embedded once the gain has fallen below the corresponding threshold value in a case where a standard signal is input as the voice signal.

TABLE 3

THRESHOLD VALUE (GAIN INDEX), EFFECT UPON SOUND QUALITY, AND PROPORTION OF FRAME ALTERED

| THRESHOLD VALUE | SNRseg [dB] | SNRtot [dB] | PROPORTION [%] | THRESHOLD VALUE | SNRseg [dB] | SNRtot [dB] | PROPORTION [%] |
|---|---|---|---|---|---|---|---|
| 0 | 11.60 | 13.27 | 0 | 18 | 11.44 | 13.21 | 45.09 |
| 2 | 11.59 | 13.27 | 11.22 | 20 | 11.40 | 13.20 | 45.59 |
| 4 | 11.58 | 13.24 | 31.90 | 30 | 11.32 | 13.21 | 47.63 |
| 6 | 11.56 | 13.24 | 37.68 | 40 | 11.16 | 13.22 | 49.34 |
| 8 | 11.53 | 13.25 | 40.37 | 50 | 11.03 | 13.18 | 50.66 |
| 10 | 11.52 | 13.26 | 41.88 | 60 | 10.86 | 13.13 | 52.04 |
| 12 | 11.50 | 13.24 | 42.96 | 80 | 10.56 | 13.10 | 54.24 |
| 14 | 11.47 | 13.22 | 43.87 | 100 | 10.16 | 12.96 | 56.35 |
| 16 | 11.44 | 13.20 | 44.51 | | | | |

As shown in Table 3, setting the threshold value of the fixed codebook gain to 12 makes it possible to replace 43% of the total transmission capacity of the fixed codebook gain index (noise code) with any data. In addition, even if decoding is performed as is by the decoder, the difference in sound quality can be held to a small 0.1 dB (=11.60−11.50) in comparison with a case where no data is embedded (i.e., a case where the threshold value is 0). This means that there is no decline in sound quality in G.729, and that it is possible to transmit any data at as high as 1462 bits/s [=0.43×17×(1000/5)]. Further, by raising or lowering the threshold value, the transmission capacity (proportion) of embedded data can also be adjusted while taking into account the effect upon sound quality. For example, if a change in sound quality of 0.2 dB is allowed, the transmission capacity can be increased to 46% (1564 bits/s) by setting the threshold value to 20.

(c) Second Embodiment

Figure 8:
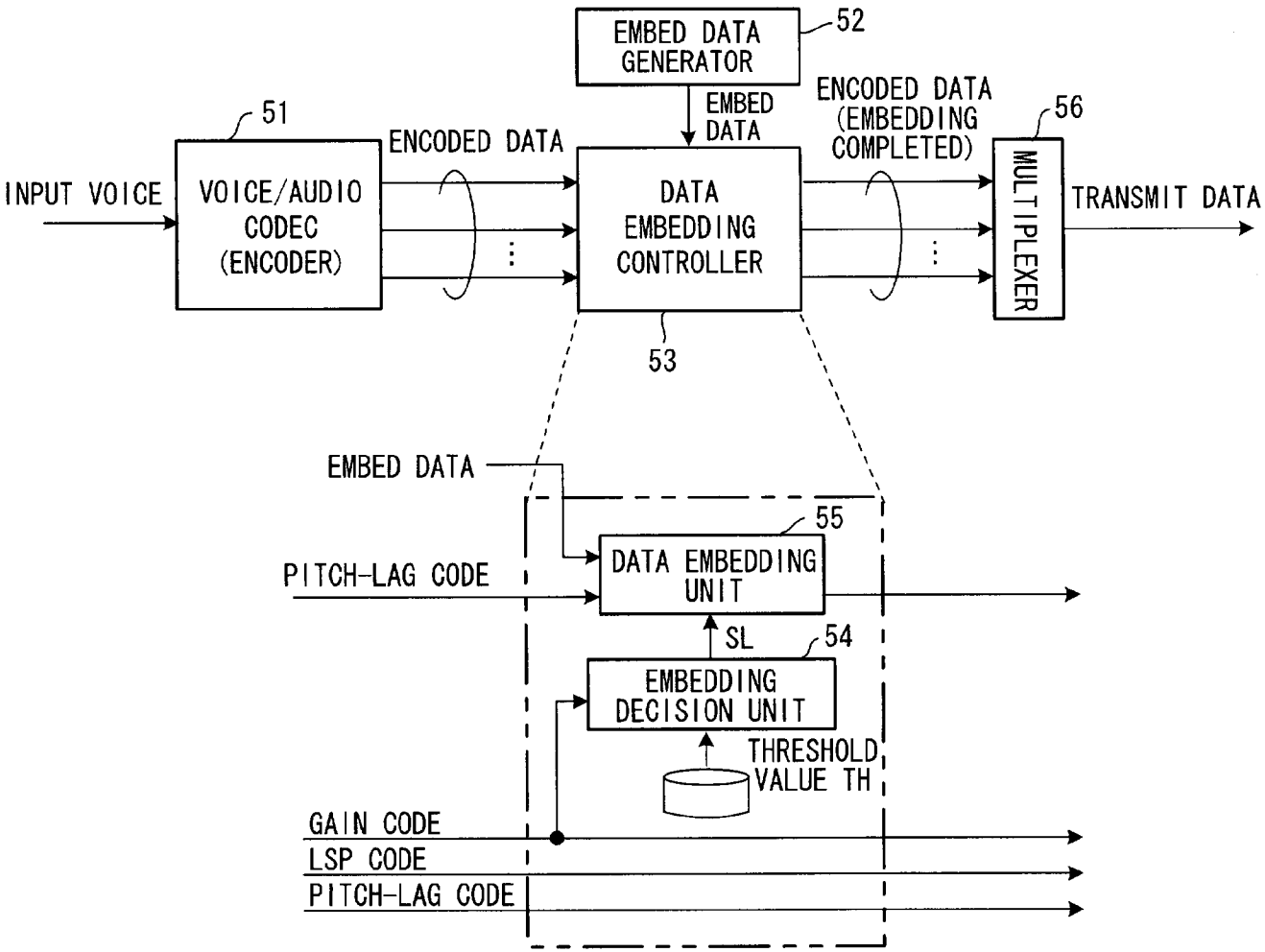
FIG. 8 is a block diagram of a second embodiment for a case where use is made of an encoder for performing encoding in accordance with a G.729-compliant encoding scheme.

FIG. 8 is a block diagram of a second embodiment for a case where use is made of an encoder for performing encoding in accordance with a G.729-compliant encoding scheme. Components identical with those shown in FIG. 1 are designated by like reference characters. This arrangement differs from that of FIG. 1 in that a gain code (pitch-gain gain) is used as the first element code and a pitch-lag code, which is an index of an adaptive codebook, is used as the second element code.

The codec 51 encodes input voice in accordance with G.729 and inputs the encoded voice code thus obtained to the data embedding controller 53. The embedding decision unit 54 of the data embedding controller 53 uses the dequantized value (pitch gain) of the gain code and the threshold value TH to determine whether data embedding conditions are satisfied, and the data embedding unit 55 replaces pitch-lag code with prescribed data to thereby embed the data in the encoded voice code if the data embedding conditions are satisfied. If the data embedding conditions are not satisfied, the data embedding unit 55 outputs the pitch-lag element code as is. The multiplexer 56 multiplexes and transmits the element codes that construct the encoded voice code.

Figure 9:
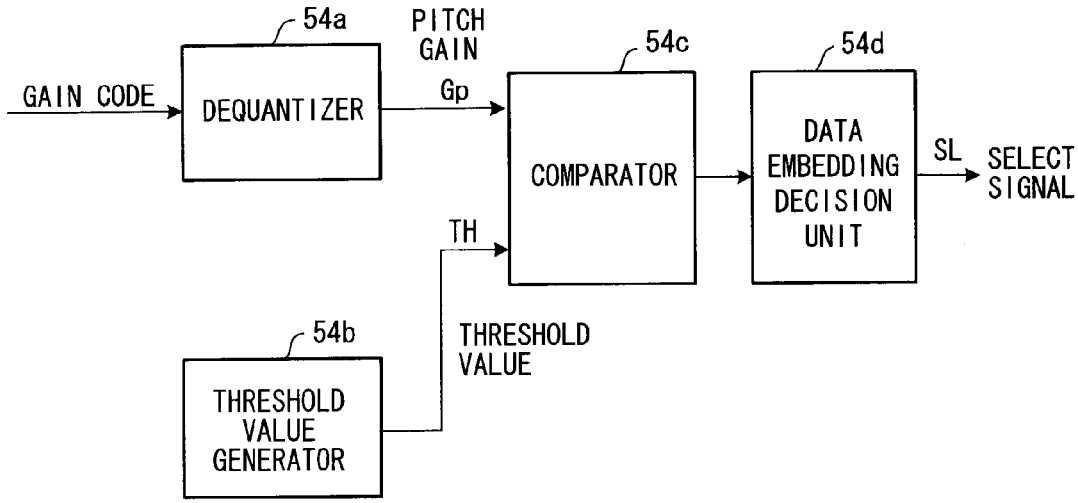
FIG. 9 is a block diagram of an embedding decision unit.

The embedding decision unit 54 has the structure shown in FIG. 9. Specifically, the dequantizer 54*a* dequantizes the gain code and the comparator 54*c* compares the dequantized value (pitch gain) Gp with the threshold value TH. When the dequantized value Gp is smaller than the threshold value TH, the data embedding decision unit 54*d* determines that the data embedding conditions are satisfied and generates a select signal SL for selecting embed data that is output from the embed data generator 52. When the dequantized value Gp is equal to or greater than the threshold value TH, the data embedding decision unit 54*d* determines that the data embedding conditions are not satisfied and generates a select signal SL for selecting a pitch-lag code that is output from the encoder 51. Based upon the select signal SL, the data embedding unit 55 selectively outputs the pitch-lag code or the embed data.

Figure 10:
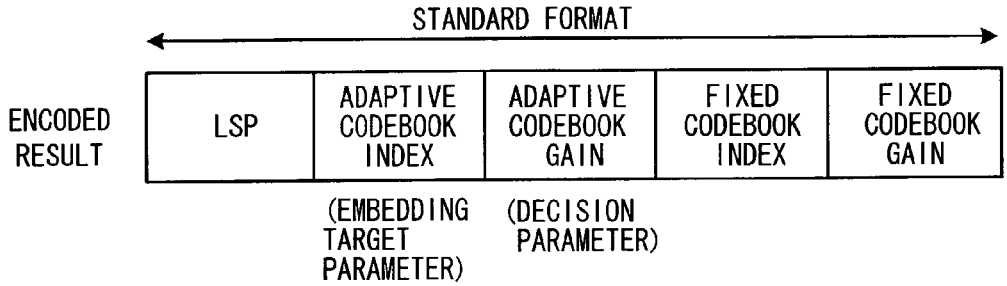
FIG. 10 illustrates the standard format of encoded voice code.
Figures 11, 13:
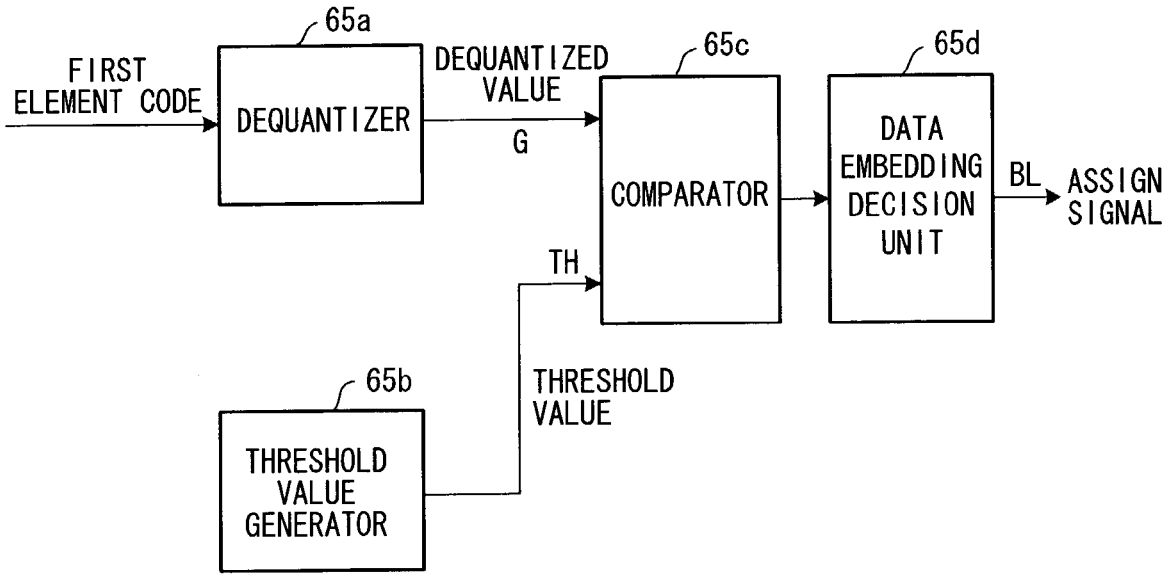
FIG. 11 is a diagram useful in describing transmit code based upon embedding control.
FIG. 13 is a block diagram of an embedding decision unit.

FIG. 10 illustrates the standard format of encoded voice code, and FIG. 11 is a diagram useful in describing transmit code based upon embedding control. These indicate a case where the encoded voice code is composed of five codes (LSP code, adaptive codebook index, adaptive codebook gain, fixed codebook index, fixed codebook gain). In a case where the fixed codebook gain Gp is equal to or greater than the threshold value, data is not embedded in the encoded voice code, as indicated at (1) in FIG. 11. However, if the fixed codebook gain Gp is less than the threshold value TH, then data is embedded in the adaptive codebook index portion of the encoded voice code, as indicated at (2) in FIG. 11.

Table 4 below illustrates the result of a simulation in a case where the pitch-lag code (13 bits/10 ms) serving as the adaptive codebook index is replaced with optional data if gain is less than a certain value in the G.729 voice encoding scheme. Table 4 illustrates the results of evaluating, by SNR, a change in sound quality in a case where voice is reproduced upon adopting randomly generated data as the optional data and regarding this random data as pitch-lag code, as well as the proportion of a frame replaced with embedded data.

TABLE 4

GAIN THRESHOLD VALUE TO WHICH ADAPTIVE CODEBOOK IS APPLIED, EFFECT UPON SOUND QUALITY, AND PROPORTION OF FRAME ALTERED

| THRESHOLD VALUE | SNRseg [dB] | SNRtot [dB] | PROPORTION [%] | THRESHOLD VALUE | SNRseg [dB] | SNRtot [dB] | PROPORTION [%] |
|---|---|---|---|---|---|---|---|
| 0.0 | 11.60 | 13.27 | 0 | 0.7 | 10.92 | 12.69 | 59.55 |
| 0.1 | 11.58 | 13.22 | 4.79 | 0.8 | 10.46 | 12.01 | 65.70 |
| 0.2 | 11.54 | 13.23 | 12.66 | 0.9 | 9.51 | 10.30 | 73.26 |
| 0.3 | 11.51 | 13.22 | 23.31 | 1.0 | 8.35 | 8.70 | 81.21 |
| 0.4 | 11.42 | 13.15 | 34.86 | 1.1 | 7.75 | 7.92 | 87.16 |
| 0.5 | 11.36 | 13.15 | 45.00 | 1.2 | 7.43 | 7.56 | 90.50 |
| 0.6 | 11.22 | 13.04 | 52.35 | | | | |

As shown in Table 4, setting the threshold value to gain 0.5 makes it possible to replace 45% of the total transmission capacity of the pitch-lag code, which is the adaptive codebook index. In addition, even if decoding is performed as is by the decoder, the difference in sound quality can be held to a small 0.24 dB (=11.60−11.36).

(C) Embodiment Relating to Decoder Side (a) General Structure

Figure 12:
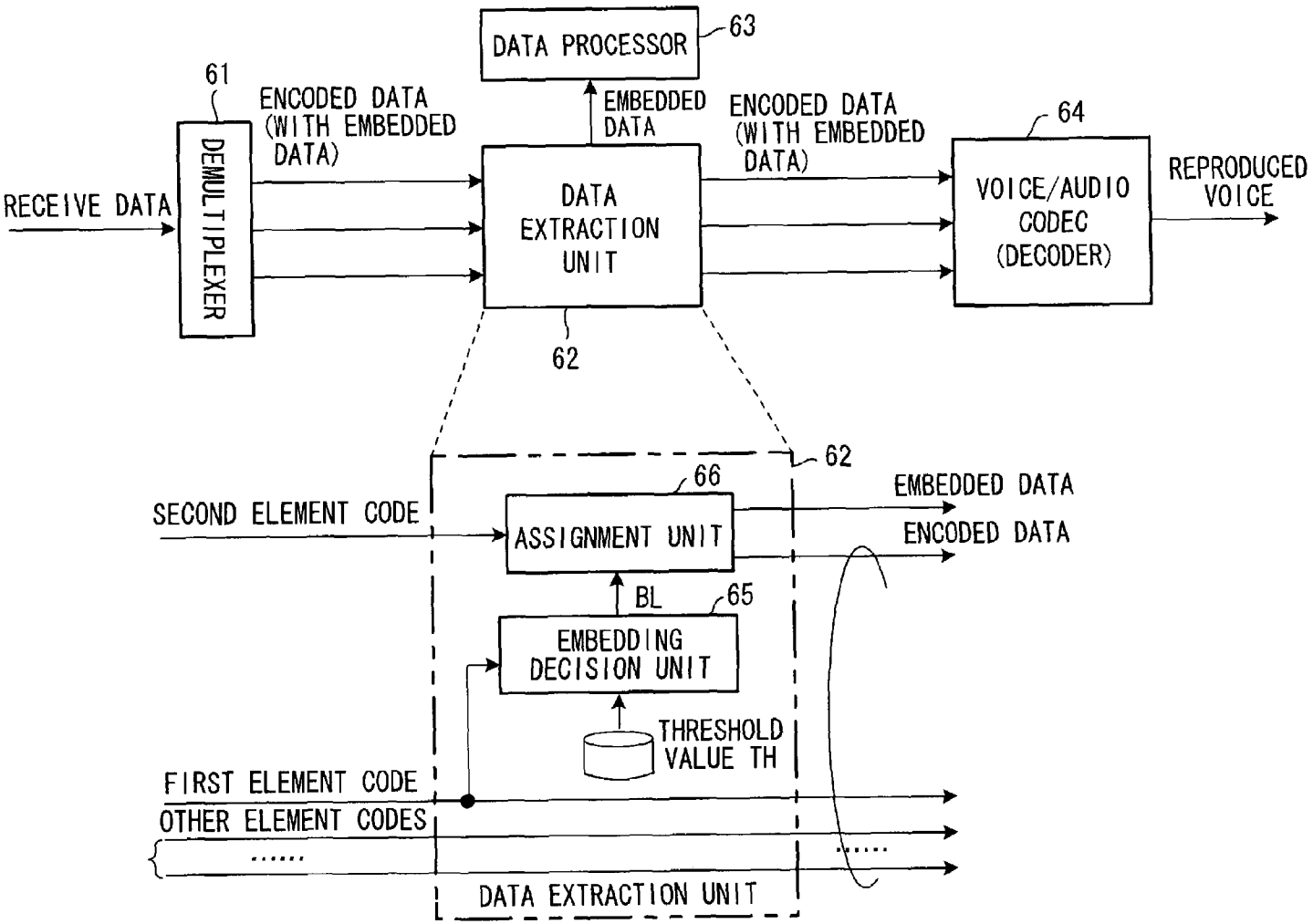
FIG. 12 is a block diagram showing the general arrangement of structural components on the side of a decoder according to the present invention.

FIG. 12 is a block diagram showing the general arrangement of structural components on the side of a decoder according to the present invention. Upon receiving encoded voice code, a demultiplexer 61 demultiplexes the encoded voice code into element codes and inputs these to a data extraction unit 62. The latter extracts data from a second element code from among the demultiplexed element codes, inputs this data to a data processor 63 and applies each of the entered element codes to a voice/audio CODEC (decoder) 64 as is. The decoder 64 decodes the entered encoded voice code, reproduces voice and outputs the same.

The data extraction unit 62, which has an embedding decision unit 65 and an assignment unit 66, extracts data from encoded voice code as appropriate. Using a first element code, which is from among element codes constituting the encoded voice code, and a threshold value TH, the embedding decision unit 65 determines whether data embedding conditions are satisfied. If these conditions are satisfied, the assignment unit 66 regards a second element code from among the element codes as embedded data, extracts the embedded data and sends this data to the data processor 63. The assignment unit 66 inputs the entered second element code to the decoder 64 as is regardless of whether the data embedding conditions are satisfied or not.

FIG. 13 is a block diagram of the embedding decision unit. A dequantizer 65*a* dequantizes the first element code and outputs a dequantized value G, and a threshold value generator 65*b* outputs the threshold value TH. A comparator 65*c* compares the dequantized value G and the threshold value TH and inputs the result of the comparison to a data embedding decision unit 65*d*. If G≧TH holds, the data embedding decision unit 65*d* determines that data has not been embedded and generates an assign signal BL; if G<TH holds, the data embedding decision unit 65*d* determines that data has been embedded and generates the assign signal BL. If data has been embedded, then the assignment unit 66 extracts this data from the second element code, inputs the data to the data processor 63 and inputs the second element code to the decoder 64 as is on the basis of the assign signal BL. If data has not been embedded, the assignment unit 66 inputs the second element code to the decoder 64 as is on the basis of the assign signal BL. In FIG. 13, the first element code is dequantized and compared with the threshold value. However, there is also a case where the comparison can be performed on the code level by setting the threshold value in the form of a code. In such case dequantization is not necessarily required.

(b) First Embodiment

Figure 14:
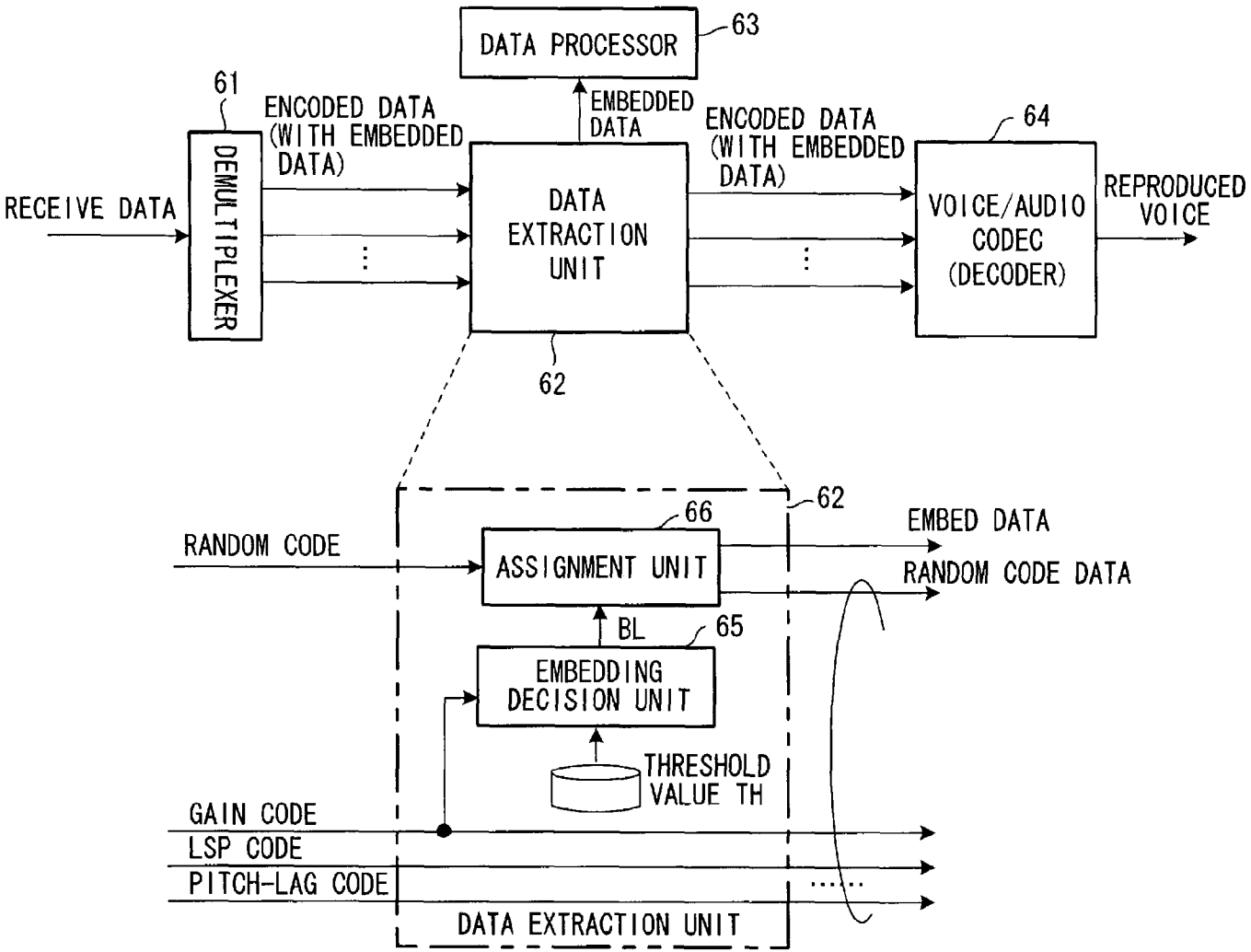
FIG. 14 is a block diagram of a first embodiment for a case where data has been embedded in noise code.

FIG. 14 is a block diagram of a first embodiment for a case where data has been embedded in G.729-compliant noise code. Components identical with those shown in FIG. 12 are designated by like reference characters. This arrangement differs from that of FIG. 12 in that a gain code (fixed codebook gain) is used as the first element code and a noise code, which is an index of a fixed codebook, is used as the second element code.

Upon receiving encoded voice code, the demultiplexer demultiplexes the encoded voice code into element codes and inputs these to the data extraction unit 62. On the assumption that encoding has been performed in accordance with G.729, the demultiplexer 61 demultiplexes the encoded voice code into LSP code, pitch-lag code, noise code and gain code and inputs these to the data extraction unit 62. It should be noted that the gain code is the result of combining pitch gain and fixed codebook gain and quantizing (encoding) these using a quantization table.

Using the dequantized value of the gain code and the threshold value TH, the embedding decision unit 65 of the data extraction unit 62 determines whether data embedding conditions are satisfied. If data embedding conditions are satisfied, the assignment unit 66 regards the noise code as embedded data, inputs the embedded data to the data processor 63 and inputs the fixed codebook to the decoder 64 in the form in which it was applied thereto. If the data embedding conditions are not satisfied, the assignment unit 66 inputs the noise code to the decoder 64 in the form in which it was applied thereto.

The embedding decision unit 65 has the structure shown in FIG. 15. Specifically, the dequantizer 65*a* dequantizes the gain code and the comparator 65*c* compares the dequantized value (fixed codebook gain) Gc with the threshold value TH. When the dequantized value Gc is smaller than the threshold value TH, the data embedding decision unit 65*d* determines that data has not been embedded and generates the assign signal BL. When the dequantized value Gc is equal to or greater than the threshold value TH, the data embedding decision unit 65*d* determines that data has not been embedded and generates the assign signal BL. On the basis of the assign signal BL, the assignment unit 66 inputs the data, which has been embedded in the fixed codebook, to the data processor 63 and inputs the fixed codebook to the decoder 64.

FIG. 16 illustrates the standard format of a receive encoded voice code, and FIG. 17 is a diagram useful in describing the results of determination processing by the data embedding decision unit. These indicate a case where the encoded voice code is composed of five codes (LSP code, adaptive codebook index, adaptive codebook gain, fixed codebook index, fixed codebook gain). When a signal is received, whether data has been embedded in the fixed codebook index (noise code) portion of the encoded voice code is unknown (FIG. 16). However, whether data has been embedded or not is clarified by comparing the fixed codebook gain Gc and the threshold value TH in terms of size. That is, if the fixed codebook gain Gc is equal to or greater than the threshold value TH, then data has not been embedded in the fixed codebook index portion, as illustrated at (1) in FIG. 17. If the fixed codebook gain Gc is less than the threshold value TH, on the other hand, then data has been embedded in the fixed codebook index portion, as illustrated at (2) in FIG. 17.

By adopting the most significant bit (MSB) as a bit indicative of the type of data, data and a control code can be embedded in the remaining (M−1)-number of bits in a form distinguished from each other, as illustrated in FIG. 7. If such as expedient is adopted, the data processor 63 may refer to the most significant bit and, if the bit is indicative of the control code, may execute processing that conforms to the control code, e.g., processing to change the threshold value, synchronous control processing, etc.

(c) Second Embodiment

Figure 18:
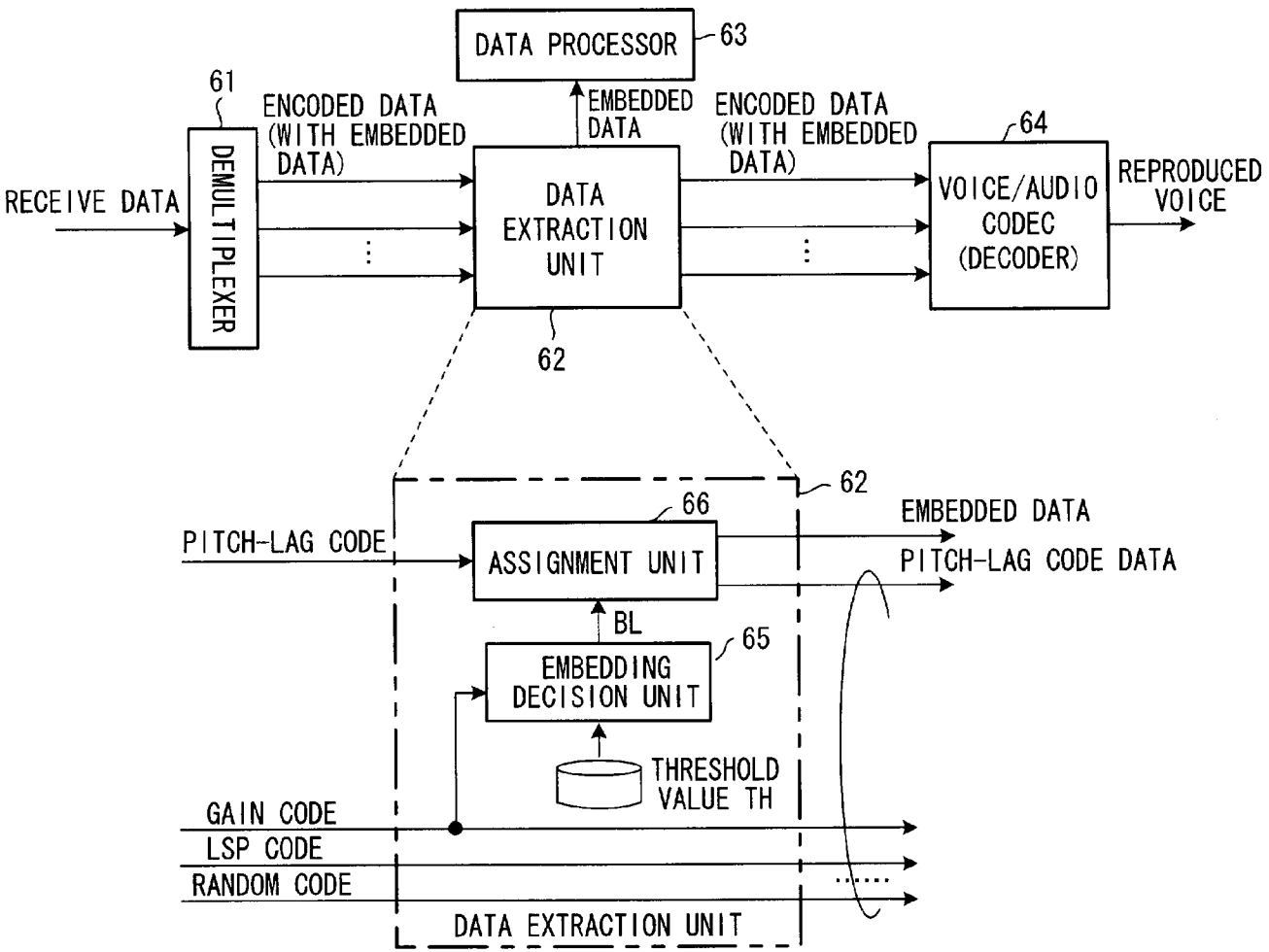
FIG. 18 is a block diagram of a second embodiment for a case where data has been embedded in a pitch-lag code.

FIG. 18 is a block diagram of a second embodiment for a case where data has been embedded in G.729-compliant pitch-lag code. Components identical with those shown in FIG. 12 are designated by like reference characters. This arrangement differs from that of FIG. 12 in that a gain code (pitch-gain code) is used as the first element code and a pitch-lag code, which is an index of an adaptive codebook, is used as the second element code.

Upon receiving encoded voice code, the demultiplexer 61 demultiplexes the encoded voice code into element codes and inputs these to the data extraction unit 62. On the assumption that encoding has been performed in accordance with G.729, the demultiplexer 61 demultiplexes the encoded voice code into LSP code, pitch-lag code, noise code and gain code and inputs these to the data extraction unit 62. It should be noted that the gain code is the result of combining pitch gain and fixed codebook gain and quantizing (encoding) these using a quantization table.

Using the dequantized value of the gain code and the threshold value TH, the embedding decision unit 65 of the data extraction unit 62 determines whether data embedding conditions are satisfied. If data embedding conditions are satisfied, the assignment unit 66 regards the pitch-lag code as embedded data, inputs the embedded data to the data processor 63 and inputs the pitch-lag code to the decoder 64 in the form in which it was applied thereto. If the data embedding conditions are not satisfied, the assignment unit 66 inputs the pitch-lag code to the decoder 64 in the form in which it was applied thereto.

Figure 19:
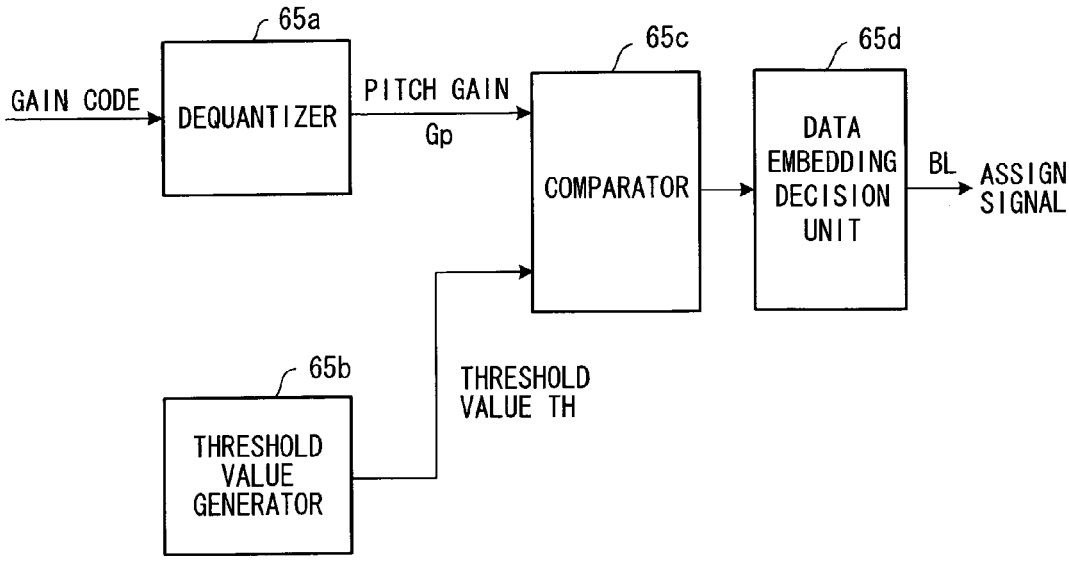
FIG. 19 is a block diagram of an embedding decision unit for a case where data has been embedded in a pitch-lag code.

The embedding decision unit 65 has the structure shown in FIG. 19. Specifically, the dequantizer 65*a* dequantizes the gain code and the comparator 65*c* compares the dequantized value (pitch-gain) Gp with the threshold value TH. When the dequantized value Gp is smaller than the threshold value TH, the data embedding decision unit 65*d* determines that data has not been embedded and generates the assign signal BL. When the dequantized value Gp is equal to or greater than the threshold value TH, the data embedding decision unit 65*d* determines that data has not been embedded and generates the assign signal BL. On the basis of the assign signal BL, the assignment unit 66 inputs the data, which has been embedded in the pitch-lag code, to the data processor 63 and inputs the fixed codebook to the decoder 64.

Figure 20:
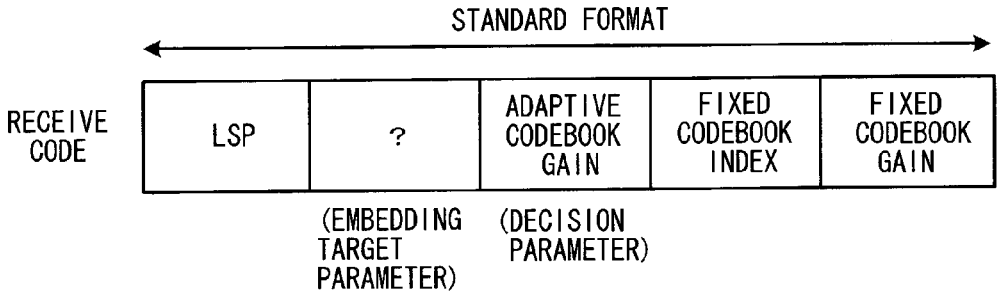
FIG. 20 illustrates the standard format of a receive encoded voice code.
Figures 21, 22:
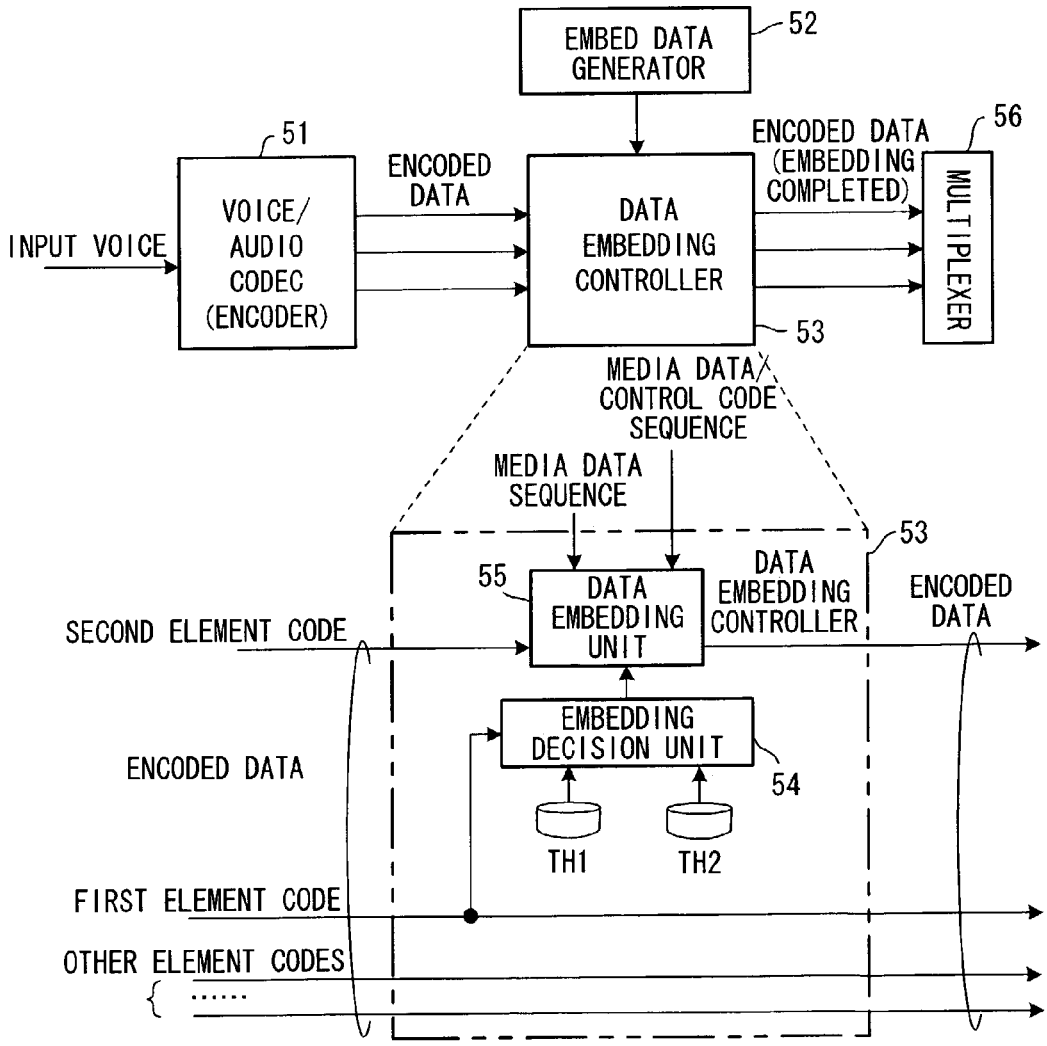
FIG. 21 is a diagram useful in describing the results of determination processing by the data embedding decision unit.
FIG. 22 is a block diagram of structure on the side of an encoder in which multiple threshold values are set.

FIG. 20 illustrates the standard format of a receive encoded voice code, and FIG. 21 is a diagram useful in describing the results of determination processing by the data embedding decision unit. These indicate a case where the encoded voice code is composed of five codes (LSP code, adaptive codebook index, adaptive codebook gain, fixed codebook index, fixed codebook gain). When a signal is received, whether data has been embedded in the adaptive codebook index (pitch-lag code) portion of the encoded voice code is unknown (FIG. 20). However, whether data has been embedded or not is clarified by comparing the adaptive codebook gain Gp and the threshold value TH in terms of size. That is, if the adaptive codebook gain Gp is equal to or greater than the threshold value TH, then data has not been embedded in the adaptive codebook index portion, as illustrated at (1) in FIG. 21. If the adaptive codebook gain Gp is less than the threshold value TH, on the other hand, then data has been embedded in the fixed codebook index portion, as illustrated at (2) in FIG. 21.

(D) Embodiment in Which Multiple Threshold Values are Set

(a) Embodiment on Encoder Side

FIG. 22 is a block diagram of structure on the side of an encoder in which multiple threshold values are set. Components identical with those shown in FIG. 1 are designated by like reference characters. This arrangement differs from that of FIG. 1 in that ① two threshold values are provided; ② whether to embed only a data sequence, or whether to embed a data/control code sequence having a bit indicative of the type of data, is decided in dependence upon the magnitude of the dequantized value of a first element code; and ③ data is embedded based upon the above-mentioned determination.

The voice/audio CODEC (encoder) 51 encodes input voice in accordance with, e.g., G.729, and outputs the encoded voice code (encoded data) obtained. The encoded voice code is composed of a plurality of element codes. The embed data generator 52 generates two types of data sequences to be embedded in the encoded voice code. The first data sequence is one comprising only media data, for example, and the second data sequence is a data/control code sequence having the data-type bit illustrated in FIG. 7. The media data and control code can be mixed in accordance with the "1", "0" logic of the data-type bit.

The data embedding controller 53, which has the embedding decision unit 54 and the data embedding unit 55 constructed as a selector, embeds data in encoded voice code as appropriate. Using a first element code, which is from among element codes constituting the encoded voice code, and threshold values TH1, TH2 (TH2>TH1), the embedding decision unit 54 determines whether data embedding conditions are satisfied. If these conditions are satisfied, the embedding decision unit 54 then determines whether the embedding conditions satisfied concern a data sequence comprising only media data or a data/control code sequence having the data-type bit. For example, the embedding decision unit 54 determines that the data embedding conditions are satisfied if the dequantized value of the first element code satisfies the relation ① TH2<G, that embedding conditions concerning a data/control code sequence having the data-type bit are satisfied if the relation ② TH1≦G<TH2 holds, and that embedding conditions concerning a data sequence comprising only media data are satisfied if the relation ③ G<TH1 holds.

If ① TH1≦G<TH2 holds, the data embedding unit 55 replaces a second element code with a data/control code sequence having the data-type bit, which is generated by the embed data generator 52, thereby embedding this data in the encoded voice code. If ② G<TH1 holds, the data embedding unit 55 replaces the second element code with a media data sequence, which is generated by the embed data generator 52, thereby embedding this data in the encoded voice code. If ③ TH2<G holds, the data embedding unit 55 outputs the second element code as is. The multiplexer 56 multiplexes and transmits the element codes that construct the encoded voice code.

Figure 24:
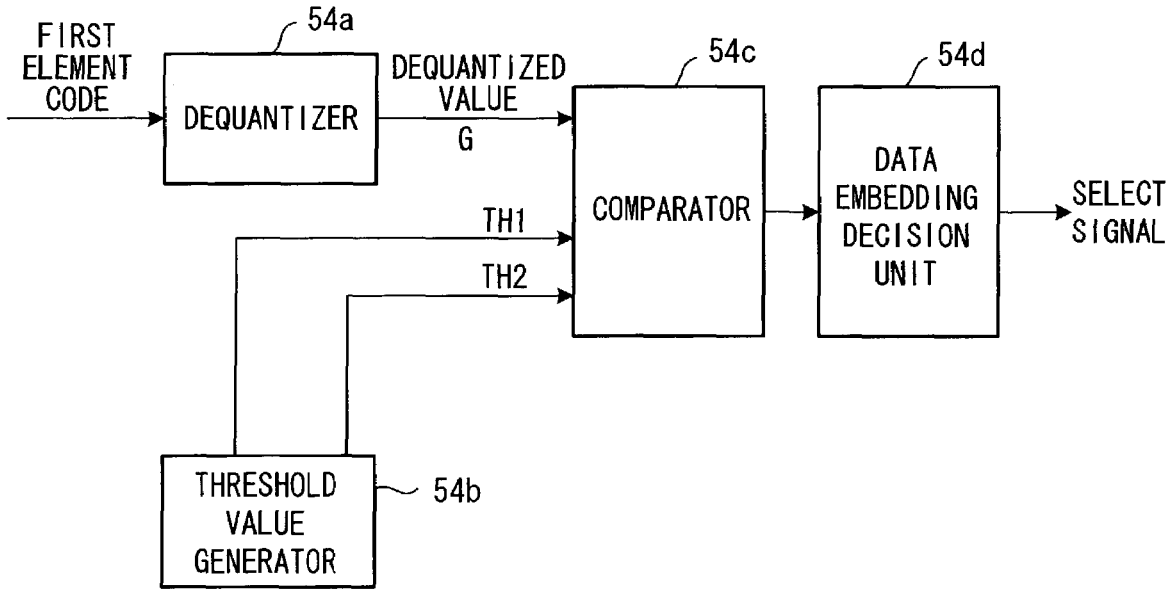
FIG. 24 is a block diagram of an embedding decision unit in a case where multiple threshold value have been set.

FIG. 24 is a block diagram of the embedding decision unit. The dequantizer 54*a* dequantizes the first element code and outputs a dequantized value G, and the threshold value generator 54*b* outputs the threshold values TH1, TH2. The comparator 54*c* compares the dequantized value G and the threshold values TH1, HH2 and inputs the result of the comparison to the data embedding decision unit 54*d*. The latter outputs the prescribed select signal SL in accordance with whether ① TH2<G holds, ② TH1≦G<TH2 holds or ③ G<TH1 holds. As a result, the data embedding unit 55 selects and outputs either the second element code, the data/control code sequence having the data-type bit, or the media data sequence, based upon the select signal SL.

In a case where an encoder compliant with the G.729 encoding scheme is used as the encoder, the value conforming to the first element code is either fixed codebook gain or pitch gain, and the second element code is either a noise code or a pitch-lag code.

Figure 25:
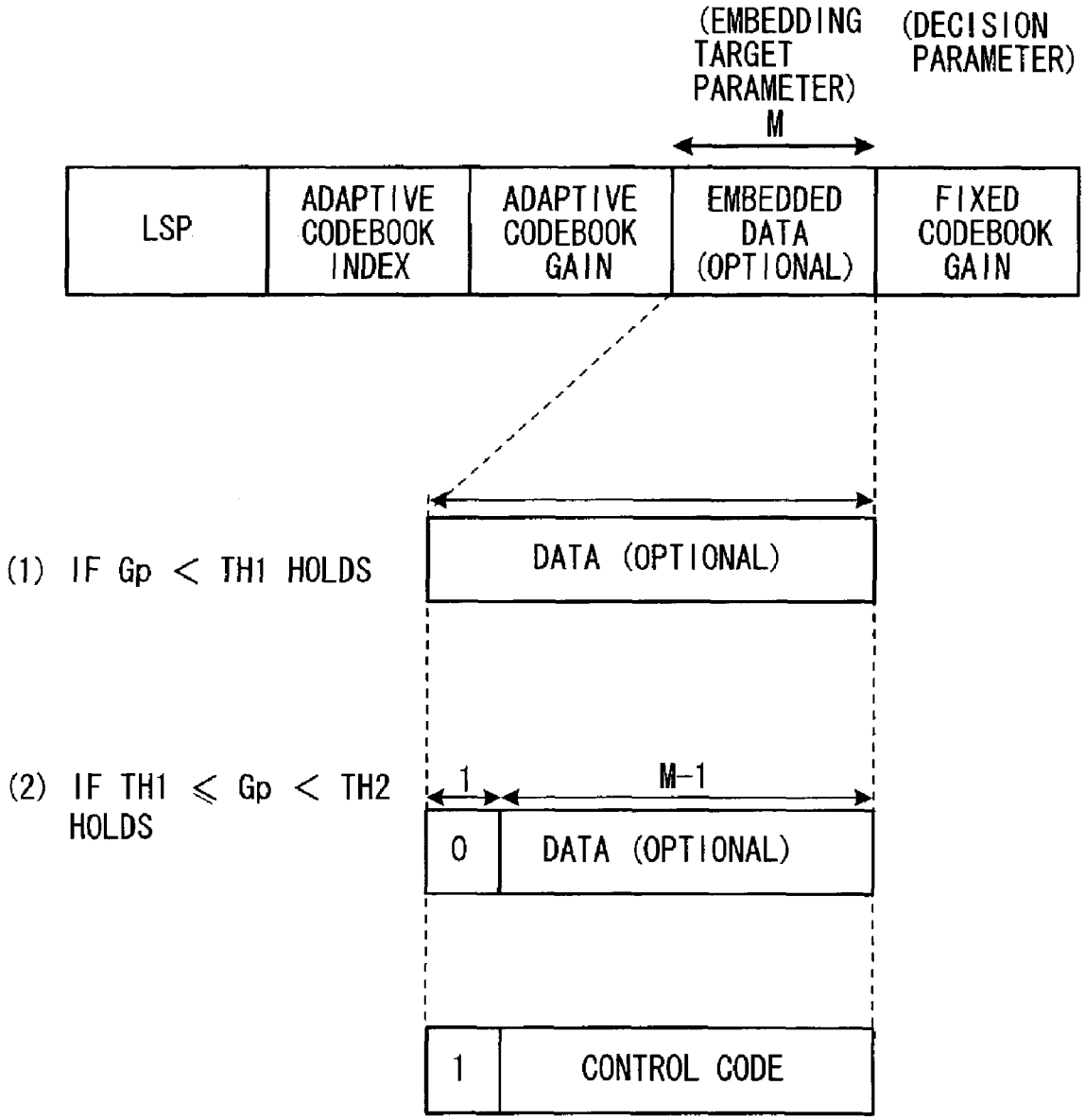
FIG. 25 is a diagram useful in describing embedding of data.

FIG. 25 is a diagram useful in describing embedding of data in a case where the value conforming to the dequantized value of the first element code is fixed codebook gain Gp and the second element code is noise code. If Gp<TH1 holds, any data such as media data is embedded in all 17 bits of the noise code portion. If TH1≦Gp<TH2 holds, the most significant bit is made "1", control code is embedded in 16 bits, the most significant bit is made "0" and optional data is embedded in the remaining 16 bits.

(b) Embodiment on Decoder Side

Figure 26:
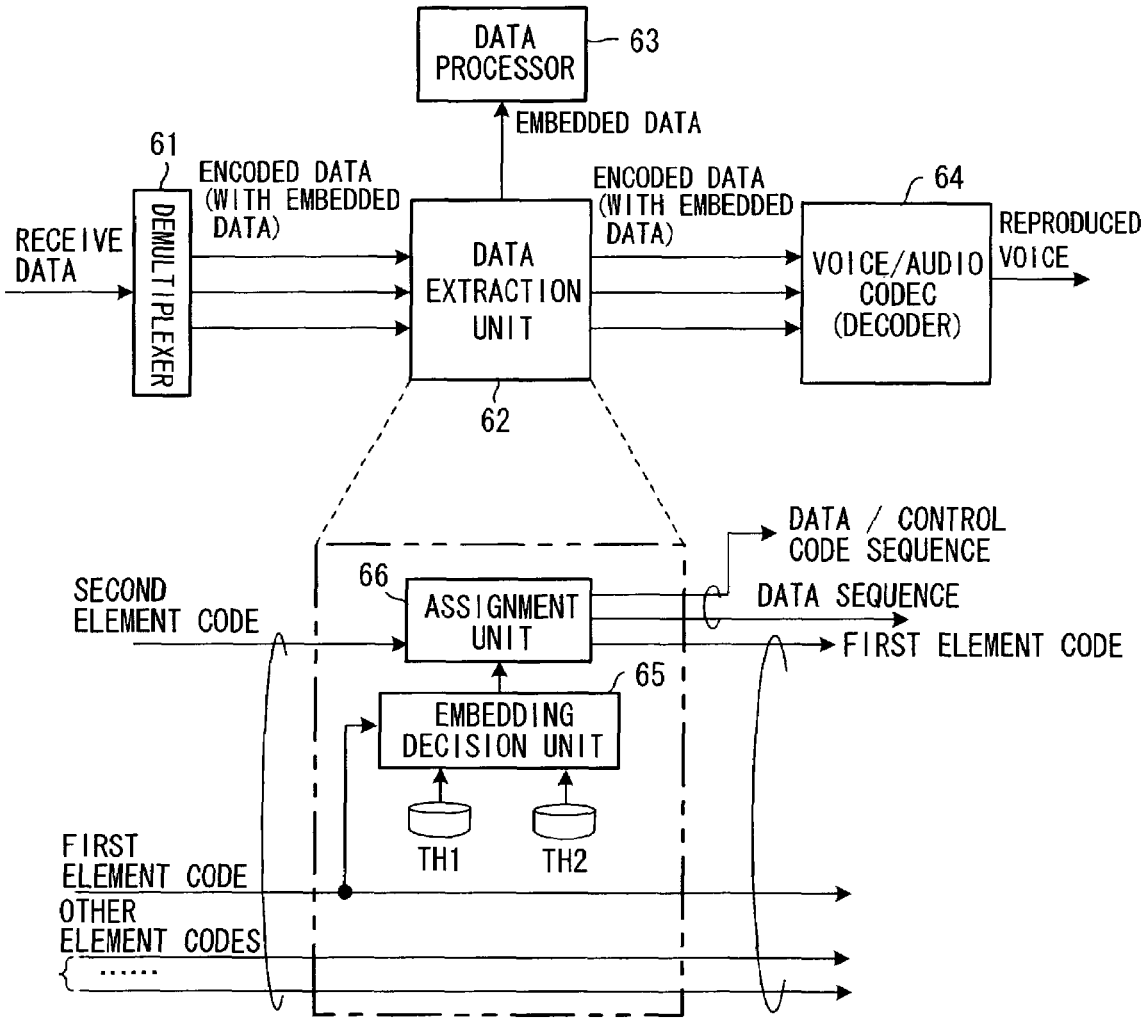
FIG. 26 is a block diagram of structure on the side of a decoder in which multiple threshold values are set.

FIG. 26 is a block diagram of structure on the side of an encoder in which multiple threshold values are set. Components identical with those shown in FIG. 12 are designated by like reference characters. This arrangement differs from that of FIG. 12 in that ① two threshold values are provided; ② the determination as to whether a data sequence or a data/control code sequence having a bit indicative of the type of data has been embedded is determined in dependence upon the magnitude of the dequantized value of a first element code; and ③ data is assigned based upon the above-mentioned determination.

Upon receiving encoded voice code, the demultiplexer 61 demultiplexes the encoded voice code into element codes and inputs these to the data extraction unit 62. The latter extracts a data sequence or data/control code sequence from a first element code from among the demultiplexed element codes, inputs this data to a data processor 63 and applies each of the entered element codes to a voice/audio CODEC (decoder) 64 as is. The decoder 64 decodes the entered encoded voice code, reproduces voice and outputs the same.

Figure 23:
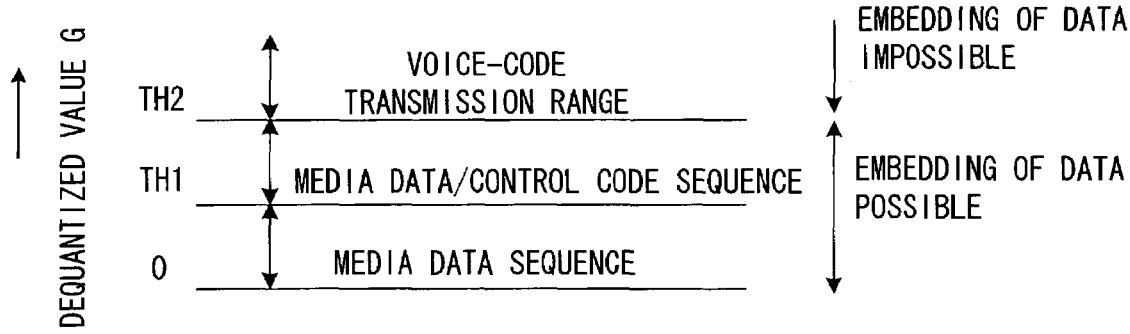
FIG. 23 is a diagram useful in describing a range within which embedding of data is possible.

The data extraction unit 62, which has an embedding decision unit 65 and an assignment unit 66, extracts a data sequence or a data/control code sequence from encoded voice code as appropriate. Using a value conforming to the first element code, which is a code from among element codes constituting the encoded voice code, and threshold values TH1, TH2 (TH2>TH1) shown in FIG. 23, the embedding decision unit 65 determines whether data embedding conditions are satisfied. If these conditions are satisfied, the embedding decision unit 65 then determines whether the embedding conditions satisfied concern a data sequence comprising only media data or a data/control code sequence having the data-type bit. For example, the embedding decision unit 65 determines that the data embedding conditions are satisfied if the dequantized value of the first element code satisfies the relation ① TH2<G, that embedding conditions concerning a data/control code sequence having the data-type bit are satisfied if the relation ② TH1≦G<TH2 holds, and that embedding conditions concerning a data sequence comprising only media data are satisfied if the relation ③ G<TH1 holds.

If ① TH1≦G<TH2 holds, the assignment unit 66 regards the second element code as the data/control code sequence having the data-type bit, inputs this to the data processor 63 and the inputs the second element code to the decoder 64. If ② G<TH1 holds, the assignment unit 66 regards the second element code as a data sequence comprising media data, inputs this to the data processor 63 and the inputs the second element code to the decoder 64. If ③ TH2<G holds, the assignment unit 66 regards this as indicating that data has not been embedded in the second element code and inputs the second element code to the decoder 64.

Figure 27:
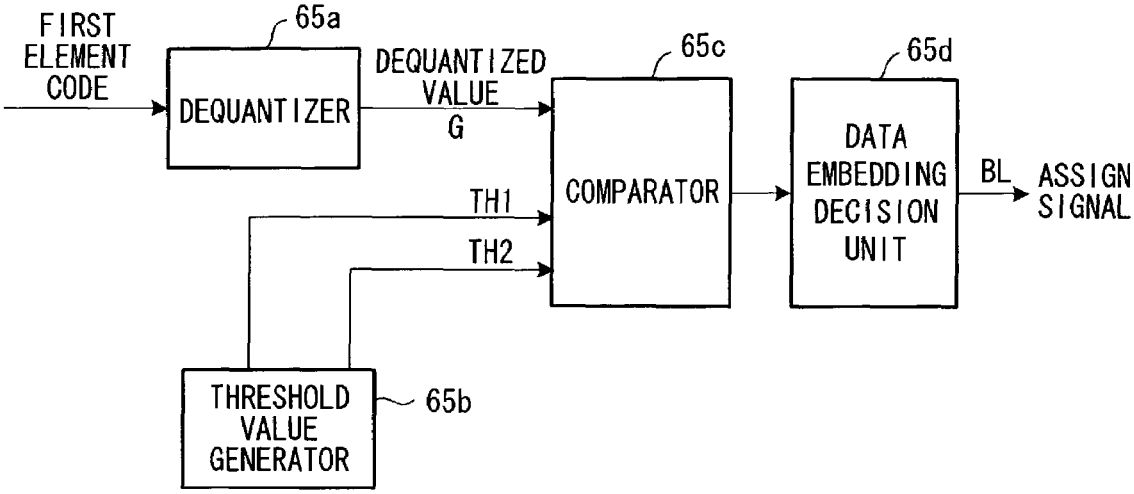
FIG. 27 is a block diagram of an embedding decision unit.

FIG. 27 is a block diagram of the embedding decision unit 65. The dequantizer 65*a* dequantizes the first element code and outputs the dequantized value G, and the threshold value generator 65*b* outputs the first and second threshold values TH1, TH2. The comparator 65*c* compares the dequantized value G and the threshold values TH1, TH2 and inputs the result of the comparison to a data embedding decision unit 65*d*. The data embedding decision unit 65*d* outputs the prescribed assign signal BL in accordance with whether ① TH2<G, ② TH1≦G<TH2 or ③ G<TH1 holds. As a result, the assignment unit 66 performs the above-mentioned assignment based upon the assign signal BL.

In a case where encoded voice code that has been encoded in accordance with G.729 encoding is received, the value conforming to the first element code is fixed codebook, gain or pitch gain, and the second element code is noise code or pitch-lag code.

The foregoing has been described for a case where the present invention is applied to a voice communication system that transmits voice from a transmitter having an encoder to a receiver having a decoder. However, the present invention is not limited to such a voice communication system but is applicable to other systems as well. For example, the present invention can be applied to a recording/playback system in which voice is encoded and recorded on a storage medium by a recording apparatus having an encoder, and voice is reproduced from the storage medium by a playback apparatus having a decoder.

Figure 28:
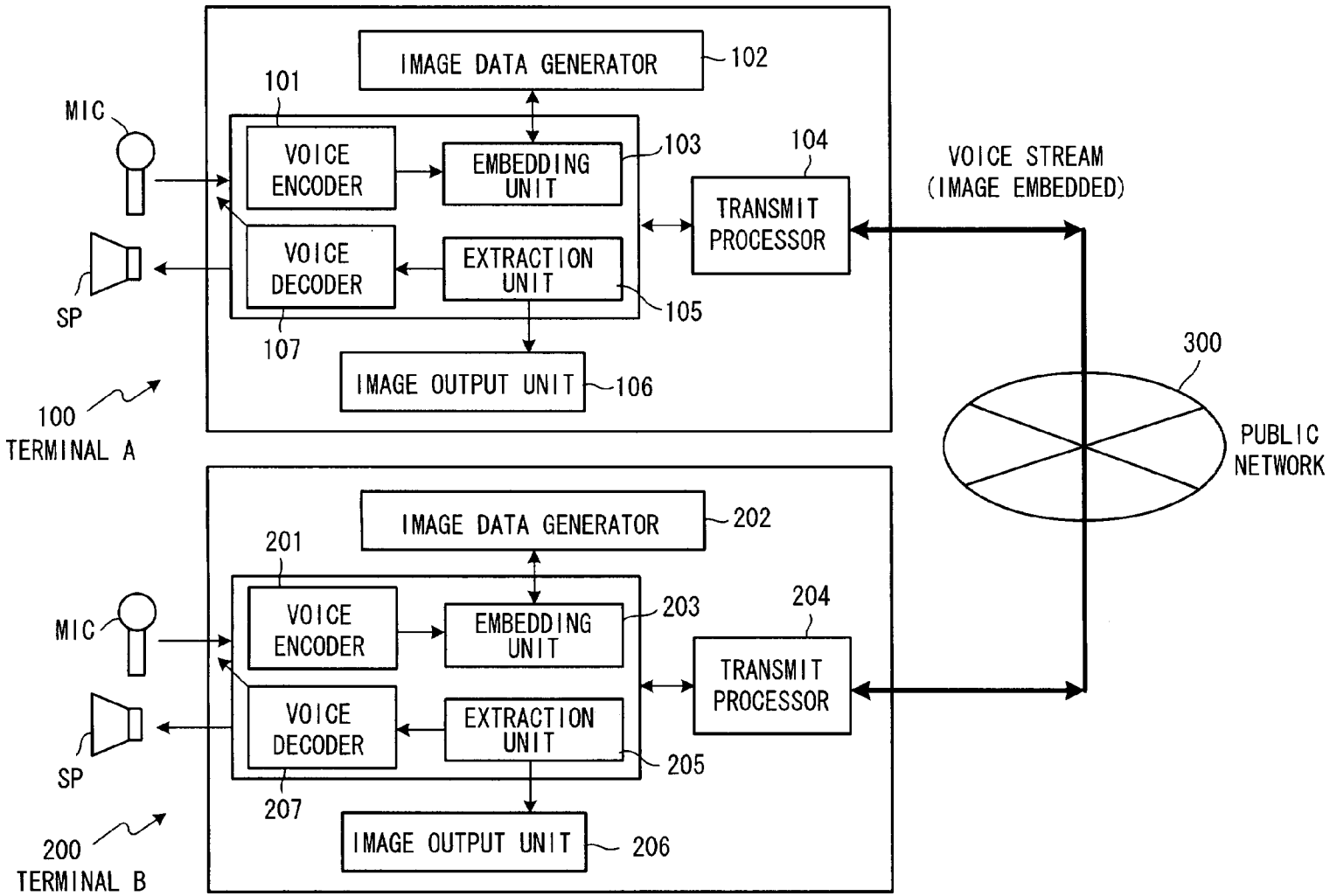
FIG. 28 is a block diagram illustrating the configuration of a digital voice communication system that implements multimedia transmission for transmitting an image at the same time as voice by embedding the image.

(E) Digital Voice Communication System (a) System for Implementing Image Transmission Service FIG. 28 is a block diagram illustrating the configuration of a digital voice communication system that implements multimedia transmission for transmitting an image at the same time as voice by embedding the image. Here a terminal A 100 and a terminal B 100 are illustrated as being connected via a public network 300. The terminals A and B are identically constructed. The terminal A 100 includes a voice encoder 101 for encoding voice data, which has entered from a microphone MIC, in accordance with, e.g., G.729A, and inputting the encoded voice data to an embedding unit 103, and an image data generator 102 for generating image data to be transmitted and inputting the generated image data to the embedding unit 103. By way of example, the image data generator 102 compresses and encodes an image such as a photo of surroundings or a portrait photo of the user per se taken by a digital camera (not shown), stores the encoded image data in memory, and then encodes this image data or map image data of the user's surroundings and inputs the encoded data to the embedding unit 103. Using a portion corresponding to the data embedding controller 53 illustrated in the embodiment of FIG. 3 or FIG. 8, the embedding unit 103 embeds the image data in the encoded voice code data, which enters from the voice encoder 101, in accordance with an embedding criterion identical with that of the above embodiment, and outputs the resulting encoded voice code data. A transmit processor 104 transmits the encoded voice code data having the embedded image data to the other party's terminal B 200 via the public network 300.

The other party's terminal B 200 has a transmit processor 204 for receiving the encoded voice code data from the public network 300 and inputting this data to an extraction unit 205. The latter corresponds to the data extraction unit 62 illustrated in the embodiment of FIG. 14 or FIG. 18, extracts the image data in accordance with an embedding criterion identical with that of the above embodiment and inputs this image data to an image output unit 206. The extraction unit 205 also inputs the encoded voice code data to a voice decoder 207. The image output unit 206 decodes the entered image data, generates an image and displays the image on a display unit. The voice decoder 207 decodes the entered encoded voice code data and outputs the decoded signal from a speaker SP.

It should be noted that that control for embedding image data in encoded voice code data, transmitting the resultant data from the terminal B to the terminal A and outputting the image at terminal A also is executed in a manner similar to that described above.

Figure 29:
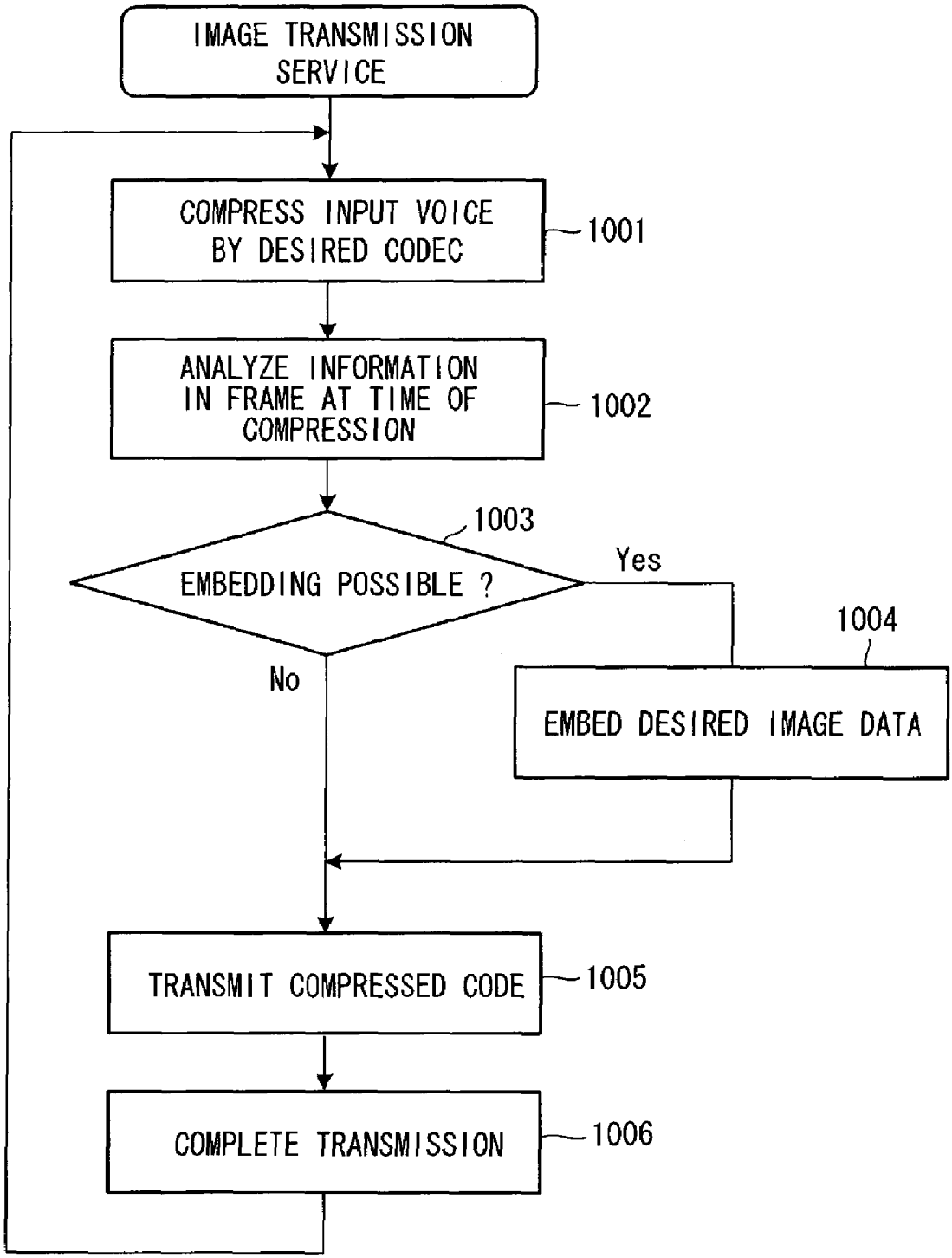
FIG. 29 is a flowchart of transmit processing executed by a transmitting terminal in an image transmission service.

FIG. 29 is a flowchart of transmit processing executed by a transmitting terminal in an image transmission service. Input voice is encoded and compressed in accordance with a desired encoding scheme, e.g., G.729A (step 1001), the information in an encoded voice frame is analyzed (step 1002), it is determined based upon the result of analysis whether embedding is possible (step 1003) and, if embedding is possible, image data is embedded in the encoded voice code data (step 1004), the encoded voice code data in which the image data has been embedded is transmitted (step 1005), and the above operation is repeated until transmission is completed (step 1006).

Figure 30:
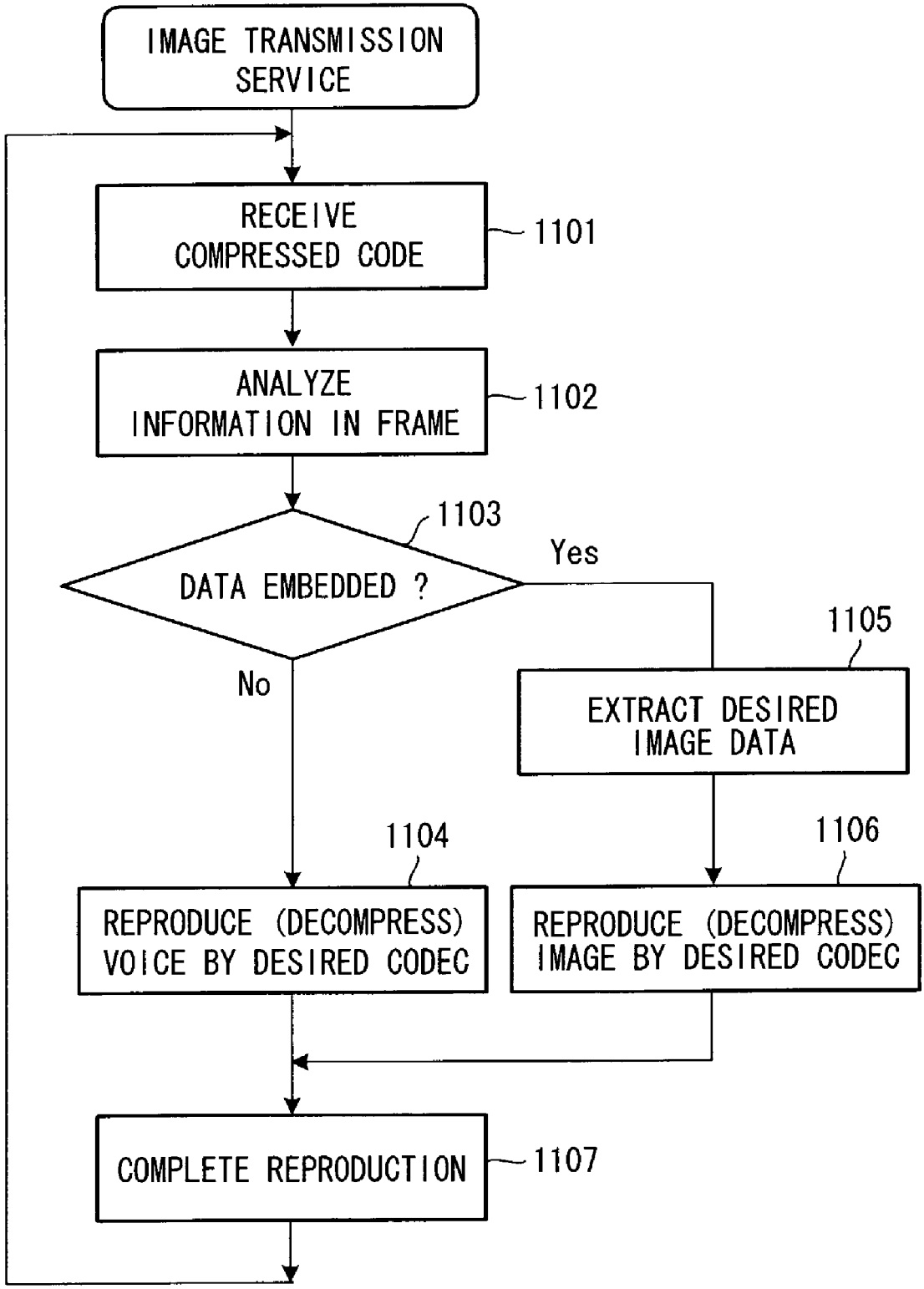
FIG. 30 is a flowchart of receive processing executed by a receiving terminal in an image transmission service.

FIG. 30 is a flowchart of receive processing executed by a receiving terminal in an image transmission service. If encoded voice code data is received (step 1101), the information in an encoded voice frame is analyzed (step 1102), it is determined based upon the result of analysis whether image data has been embedded (step 1103) and, if image data has not been embedded, then the encoded voice code data is decoded and reproduced voice is output from the speaker (step 1104). If image data has been embedded, on the other hand, the image data is extracted (step 1105) in parallel with the voice reproduction of step 1104, the image data is decoded to reproduce the image and the image is displayed on a display unit (step 1106). The above operation is then repeated until reproduction is completed (step 1107).

In accordance with the digital voice communication system of FIG. 28, additional data can be transmitted at the same time as voice using the ordinary voice transmission protocol as is. Further, since the additional information is embedded under the voice data, there is no auditory overlap, the additional information is not obtrusive and does not result in abnormal sounds. Multimedia communication becomes possible by adopting image information (video of present surroundings and map images, etc.) and personal information (a portrait photograph or voice print), etc., as the additional information.

(b) System for Implementing Authentication Information Transmission Service

Figure 31:
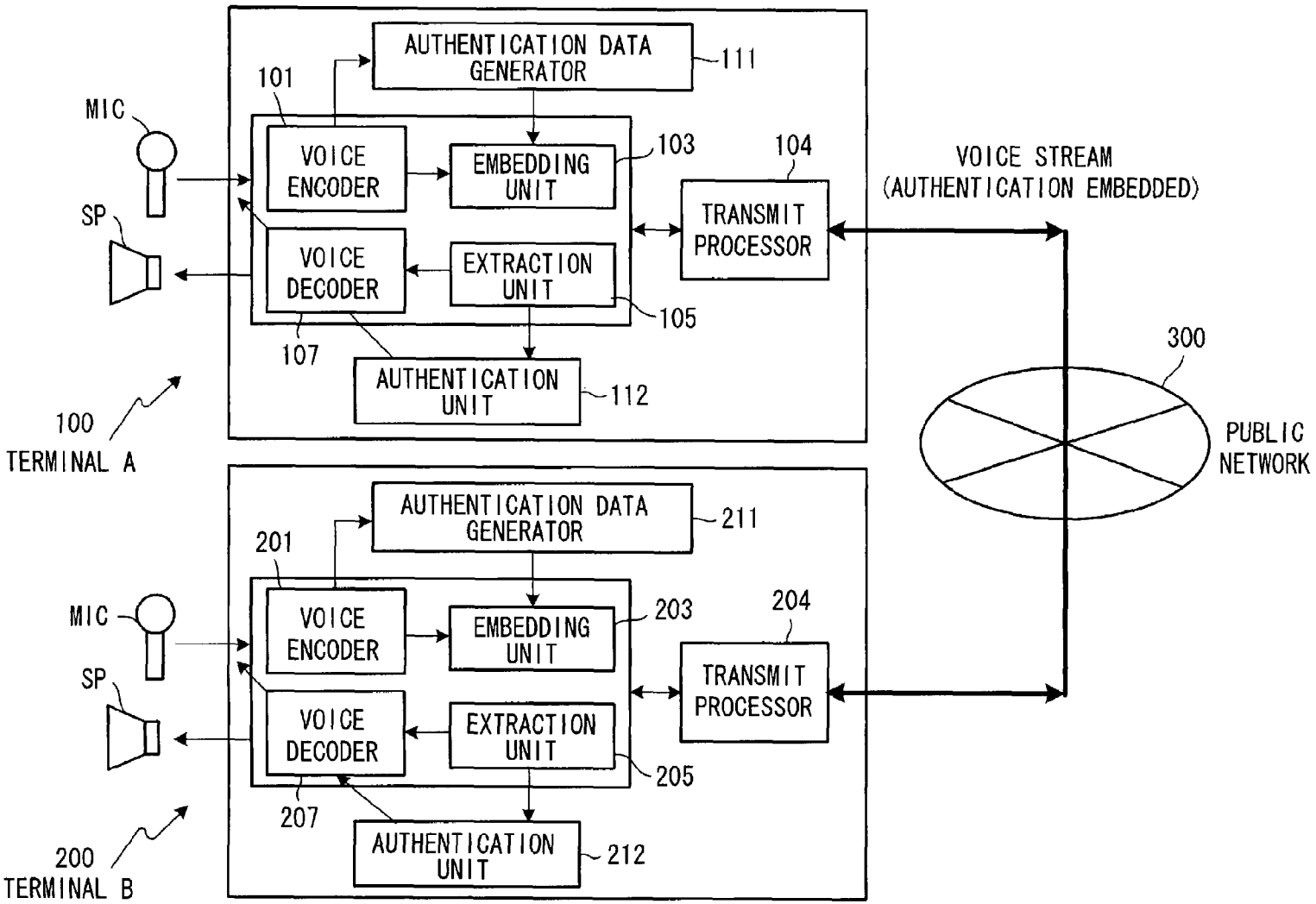
FIG. 31 is a block diagram illustrating the configuration of a digital voice communication system that transmits authentication information at the same time as voice by embedding the authentication information.

FIG. 31 is a block diagram illustrating the configuration of a digital voice communication system that transmits authentication information at the same time as voice by embedding the authentication information. Components identical with those shown in FIG. 28 are designated by like reference characters. This system differs in that authentication data generators 111, 211 are provided instead of the image data generators 102, 202, and in that authentication units 112, 212 are provided instead of the image output units 106, 206. FIG. 31 illustrates a case where a voice print is embedded as the authentication information. The authentication data generator 111 creates voice print information using encoded voice code data or raw voice data prior to the embedding of data and then stores the created information. On the receiving side the authentication units 112, 212 extract the voice print information, perform authentication by comparing this voice print information with the voice print of the user registered beforehand, and allow the decoding of voice if the individual is found to be authorized. It should be noted that authentication information is not limited to a voice print. Other examples of authentication information are a unique code (serial number) of the terminal, a unique code of the user per se or a unique code that is a combination of these codes.

Figure 32:
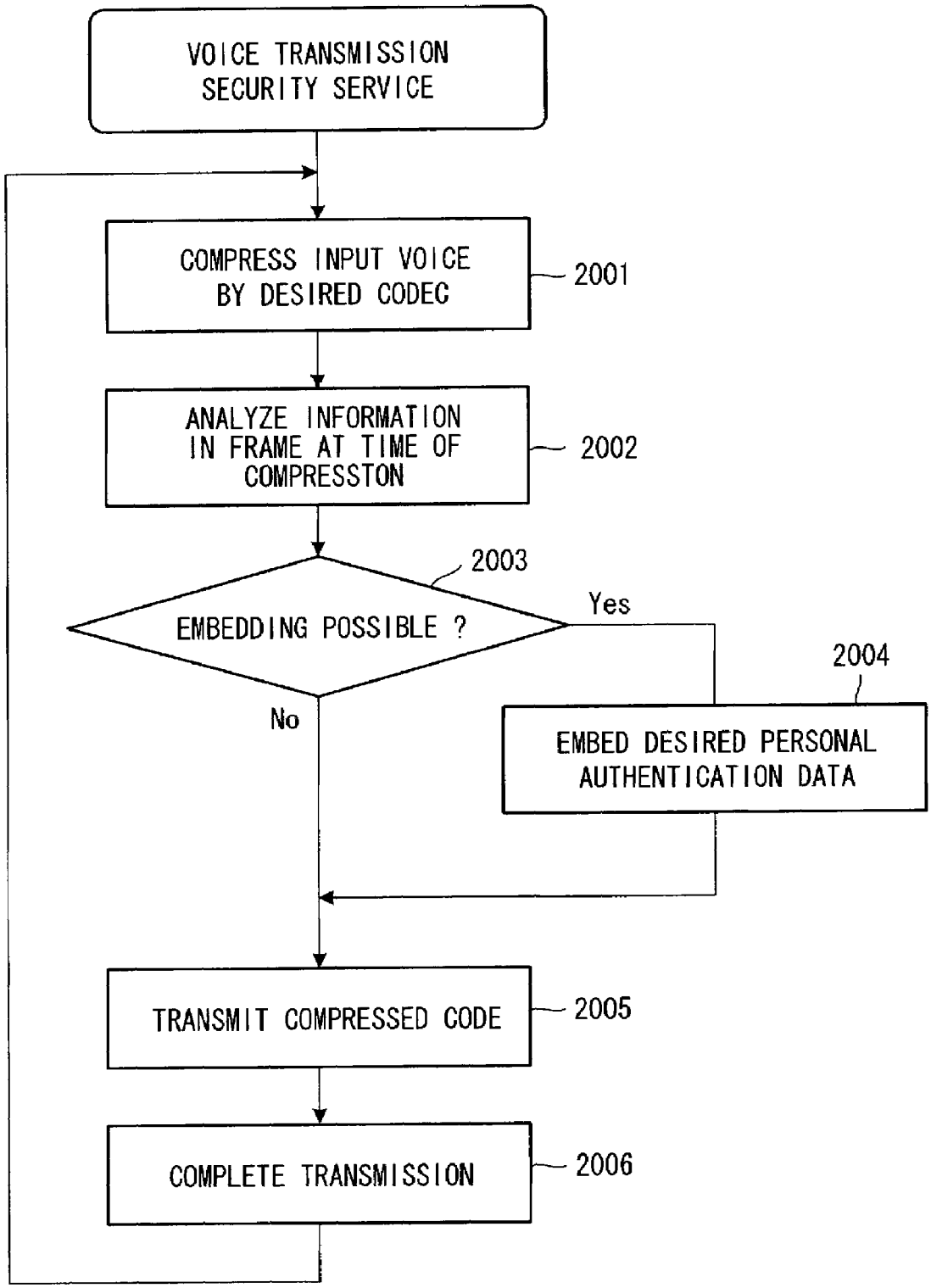
FIG. 32 is a flowchart of transmit processing executed by a transmitting terminal in an authentication information transmission service.

FIG. 32 is a flowchart of transmit processing executed by a transmitting terminal in an authentication information transmission service. Input voice is encoded and compressed in accordance with a desired encoding scheme, e.g., G.729A (step 2001), the information in an encoded voice frame is analyzed (step 2002), it is determined based upon the result of analysis whether embedding is possible (step 2003) and, if embedding is possible, personal authentication data is embedded in the encoded voice code data (step 2004), the encoded voice code data in which the authentication data has been embedded is transmitted (step 2005), and the above operation is repeated until transmission is completed (step 2006).

Figure 33:
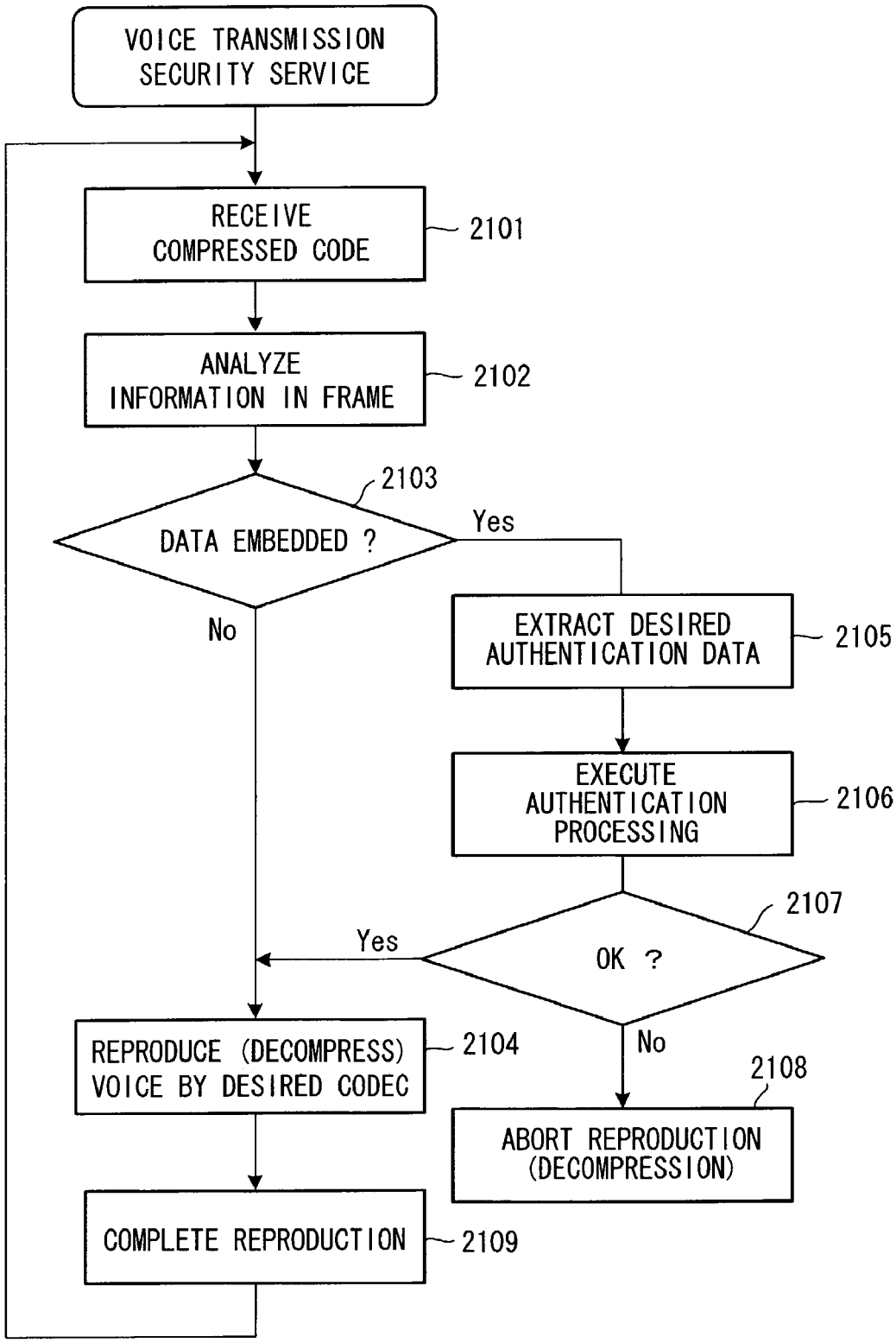
FIG. 33 is a flowchart of receive processing executed by a receiving terminal in an authentication information transmission service.

FIG. 33 is a flowchart of receive processing executed by a receiving terminal in an authentication information transmission service. If encoded voice code data is received (step 2101), the information in an encoded voice frame is analyzed (step 2102), it is determined based upon the result of analysis whether authentication information has been embedded (step 2103) and, if authentication information has not been embedded, then the encoded voice code data is decoded and reproduced voice is output from the speaker (step 2104). If authentication information has been embedded, on the other hand, the authentication information is extracted (step 2105) and authentication processing is executed (step 2106). For example, this authentication information is compared with that of an individual registered in advance and whether authentication is NG or OK is judged (step 2107). If the decision is NG, i.e., if the individual is not an authorized individual, then decoding (reproduction and decompression) of the encoded voice code data is aborted (step 2108). If the decision is OK, i.e., if the individual is the authorized individual, then decoding of the encoded voice code data is allowed, voice is reproduced and reproduced voice is output from the speaker (step 2104). The above operation is repeated until transmission from the other party is completed (step 2109)

In accordance with the digital voice communication system of FIG. 31, additional data can be transmitted at the same time as voice using the ordinary voice transmission protocol as is. Further, since the additional information is embedded under the voice data, there is no auditory overlap, the additional information is not obtrusive and does not result in abnormal sounds. By embedding authentication information as the additional information, the performance of authentication as to whether or not an individual is an authorized user can be enhanced. Moreover, it is possible to improve the security of voice data.

(c) System for Implementing Key Information Transmission Service

Figure 34:
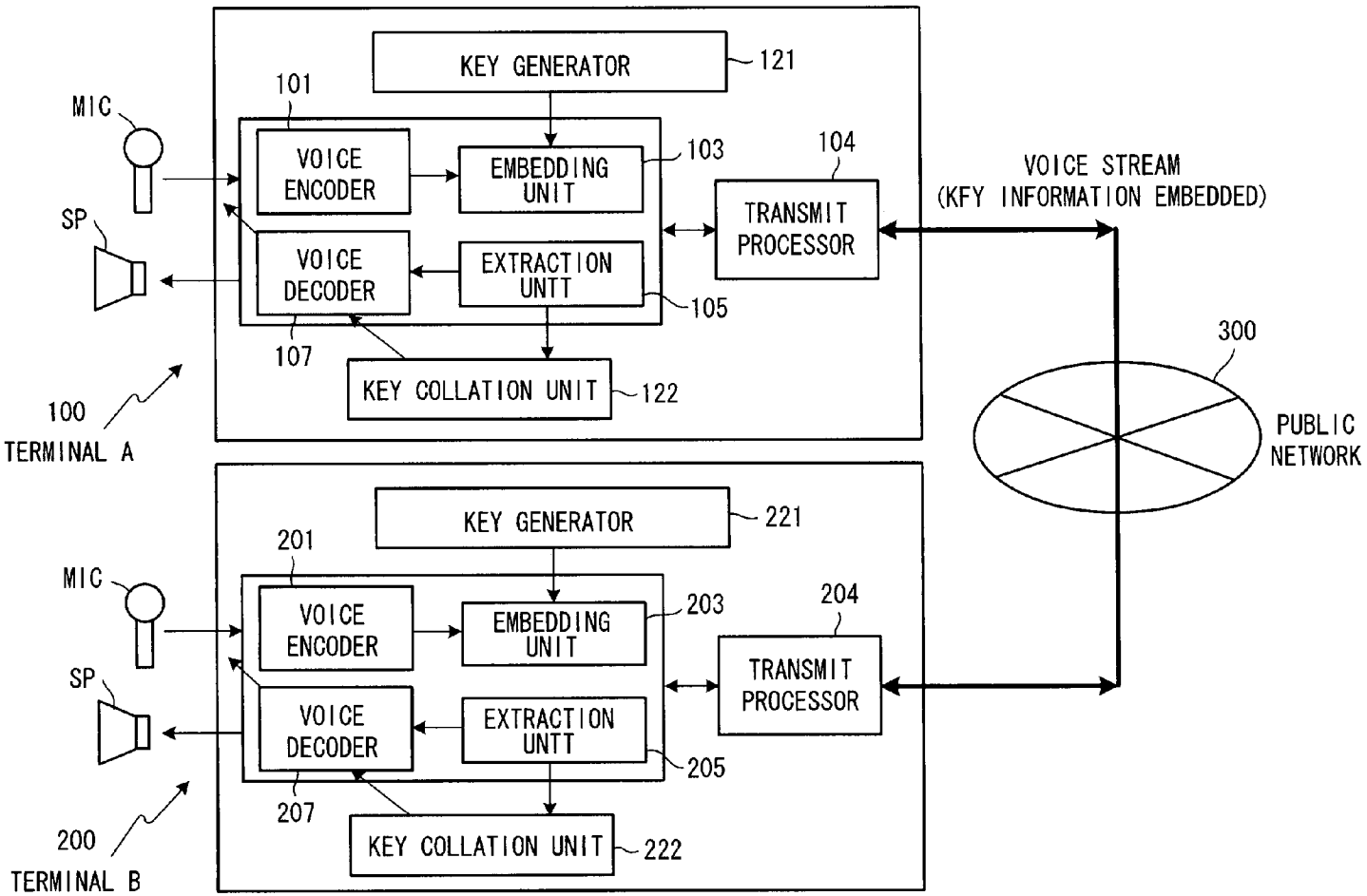
FIG. 34 is a block diagram illustrating the configuration of a digital voice communication system that transmits key information at the same time as voice by embedding the key information.

FIG. 34 is a block diagram illustrating the configuration of a digital voice communication system that transmits key information at the same time as voice by embedding the key information. Components in FIG. 34 identical with those shown in FIG. 28 are designated by like reference characters. This system differs in that key generators 121, 221 are provided instead of the image data generators 102, 202, and in that key collation units 122, 222 are provided instead of the image output units 106, 206. The key generator 121 is so adapted that previously set key information is stored in an internal memory beforehand. In accordance with an embedding criterion identical with that of the embodiment of FIG. 3 or FIG. 8, the embedding unit 103 embeds the key information, which enters from the key generator 121, in the encoded voice code data that enters from the voice encoder 101 and outputs the resultant encoded voice code data. The transmit processor 104 transmits the encoded voice code data having the embedded key information to the other party's terminal B 200 via the public network 300.

The transmit processor 204 of the other party's terminal B 200 receives the encoded voice code data from the public network 300 and inputs this data to the extraction unit 205. In accordance with an embedding criterion identical with that of the embodiment of FIG. 14 or FIG. 18, the extraction unit 205 extracts the key information and inputs this information to the collation unit 222. The extraction unit 205 also inputs the encoded voice code data to the voice decoder 207. The collation unit 222 performs authentication by comparing the entered information with key information registered in advance, allows decoding of voice if the two items of information match and prohibits the decoding of voice if the two items of information do not match. If the arrangement described above is adopted, it is possible to reproduce voice data solely from a specific user.

(d) System for Implementing a Multipoint Access Service

FIG. 35 is a block diagram illustrating the configuration of a digital voice communication system that transmits IP telephone address information at the same time as voice by embedding the relation address information. Components in FIG. 35 identical with those shown in FIG. 28 are designated by like reference characters. This system differs in that IP telephone address input units 131, 231 are provided instead of the image data generators 102, 202, relation storage units 132, 232 are provided instead of the image output units 106, 206, and display/key units DPK are provided.

A previously set relation address has been stored in an internal memory of the relation address input unit 131 in advance. This relation address may be an alternative IP telephone address or e-mail address of terminal A or an IP telephone number or an e-mail address of a facility other than terminal A or of another site. In accordance with an embedding criterion identical with that of the embodiment of FIG. 3 or FIG. 8, the embedding unit 103 embeds the relation address, which enters from the relation address input unit 131, in the encoded voice code data that enters from the voice encoder 101 and outputs the resultant encoded voice code data. The transmit processor 104 transmits the encoded voice code data having the embedded relation address to the other party's terminal B 200 via the public network 300.

The transmit processor 204 of the other party's terminal B 200 receives the encoded voice code data from the public network 300 and inputs this data to the extraction unit 205. In accordance with an embedding criterion identical with that of the embodiment of FIG. 14 or FIG. 18, the extraction unit 205 extracts the relation address and inputs this information to the relation address storage unit 232. The extraction unit 205 also inputs the encoded voice code data to the voice decoder 207. The relation address storage unit 232 stores the entered IP telephone address.

The display-key unit DPK displays the relation address that has been stored in the relation address storage unit 232. As a result, this relation address can be selected to telephone the address or transfer a mail to the address by a single click.

(e) System for Implementing Advertisement Information Embedding Service

Figure 36:
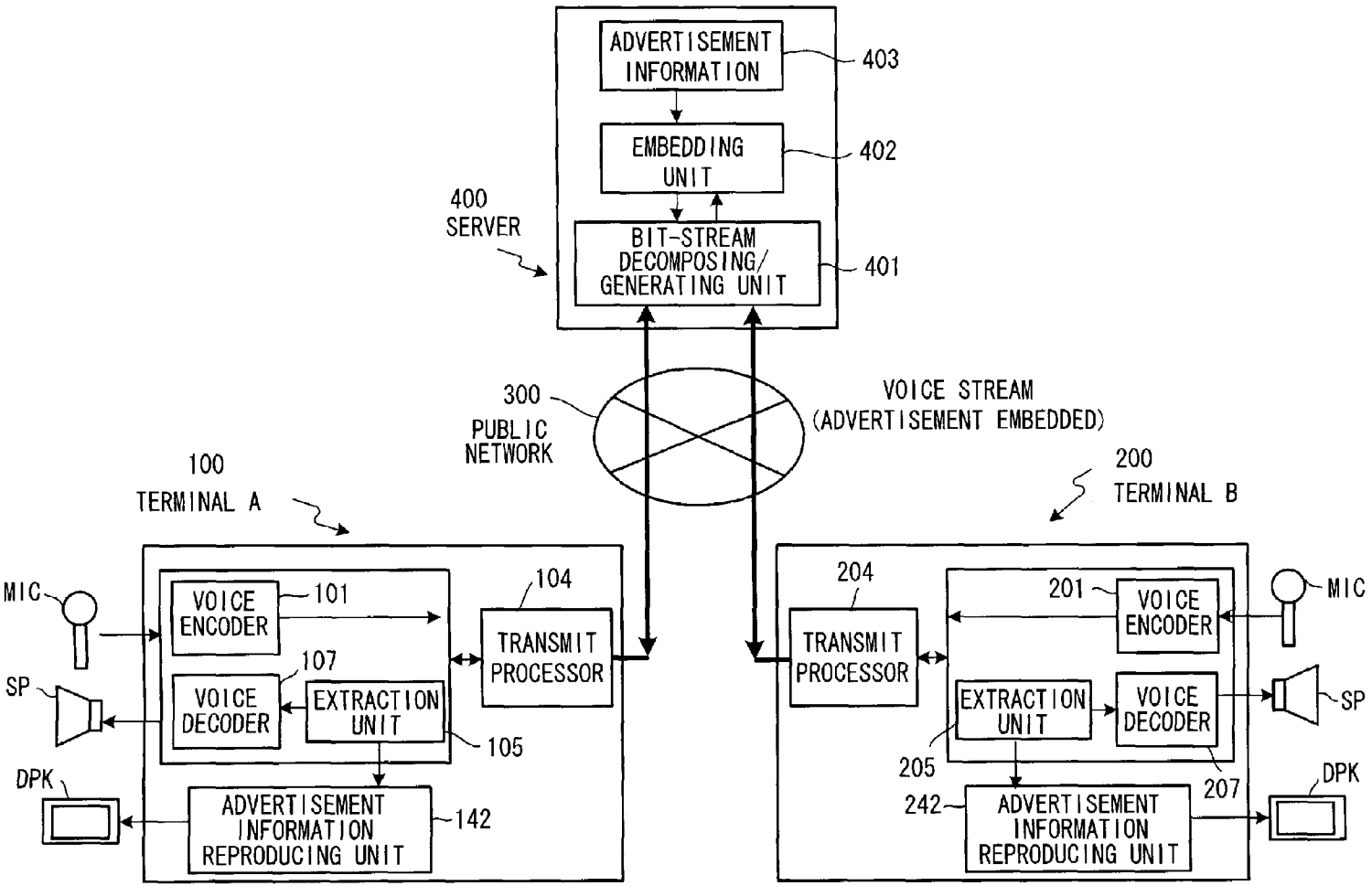
FIG. 36 is a block diagram illustrating the configuration of a digital voice communication system that implements a service for embedding advertisement information.

FIG. 36 is a block diagram illustrating the configuration of a digital voice communication system that implements a service for embedding advertisement information. Here a server (gateway) is provided and the server embeds advertisement information in encoded voice code data, whereby advertisement information is provided directly to an end users in mutual communication. Components in FIG. 36 identical with those shown in FIG. 28 are designated by like reference characters. This system differs from that of FIG. 28 in that ① the image data generators 102, 202 and embedding units 103, 203 are eliminated from the terminals 100, 100; ② advertisement information reproducing units 142, 242 are provided instead of the image output units 106, 206; ③ display/key units DPK are provided; and ④ the public network 300 is provided with a server (gateway) 400 for relaying voice data between the terminals.

The server 400 includes a bit-stream decomposing/generating unit 401 for extracting a transmit packet from a bit stream that enters from the terminal 100 on the transmitting side, specifying the sender and recipient from the IP header of this packet, specifying the media type and encoding scheme from the RTP header, determining whether advertisement-information insertion conditions are satisfied based upon these items of information and inputs encoded voice code data of the transmit packet to an embedding unit 402. In accordance with an embedding criterion identical with that of the embodiment of FIG. 3 or FIG. 8, the embedding unit 402 determines whether embedding is possible or not and, if embedding is possible, embeds advertisement information, which has been provided separately by an advertiser (information provider) and stored in a memory 403, in the encoded voice code data and inputs the resultant encoded voice code data to the bit-stream decomposing/generating unit 401. The latter generates a transmit packet using the encoded voice code data and transmits the encoded voice code data to the terminal B 200 on the receiving side.

The transmit processor 204 of the other party's terminal B 200 receives the encoded voice code data from the public network 300 and inputs this data to the extraction unit 205. In accordance with an embedding criterion identical with that of the embodiment of FIG. 14 or FIG. 18, the extraction unit 205 extracts the advertisement information and inputs this information to an advertisement information reproducing unit 242. The extraction unit 205 also inputs the encoded voice code data to the voice decoder 207. The advertisement information reproducing unit 242 reproduces the entered advertisement information and displays it on the display unit of the display/key unit DPK. The voice decoder 207 reproduces voice and outputs reproduced voice from the speaker SP.

Figure 37:
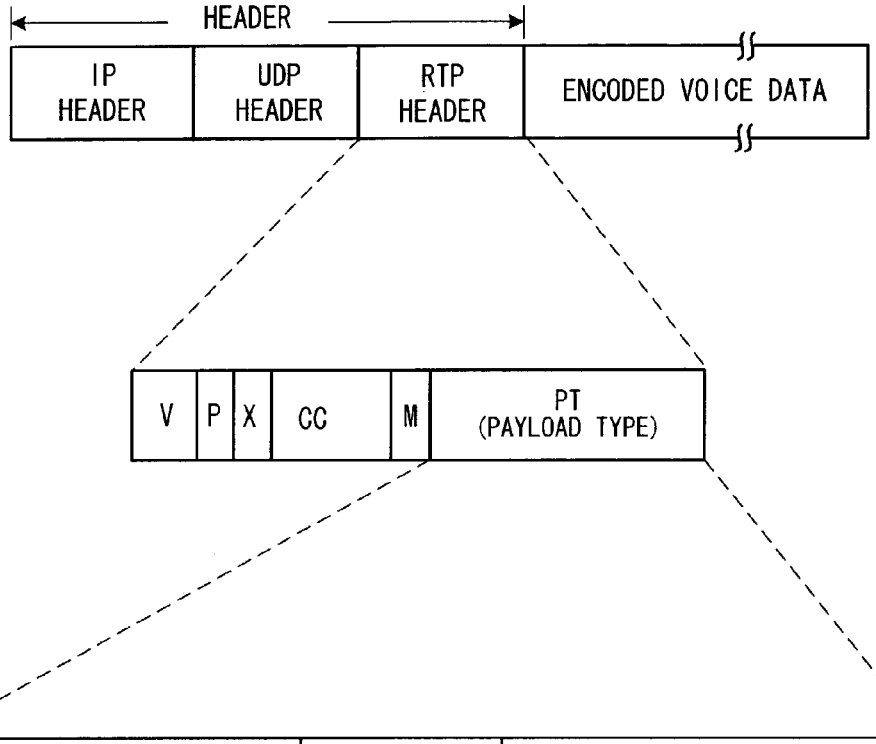
FIG. 37 shows an example of the structure of an IP packet in an Internet telephone service.

FIG. 37 shows an example of the structure of an IP packet in an Internet telephone service. Here a header is composed of an IP header, a UDP (User Datagram Protocol) header and an RTP (Real-time Transport Protocol) header. The IP header includes an originating source address and a transmission destination address (neither of which are shown). Media type and CODEC type are stipulated by payload type PT of the RTP header. Accordingly, the bit-stream decomposing/generating unit 401 refers to the header of the transmit packet, thereby making it possible to identify the sender, recipient, media type and encoding scheme.

Figure 38:
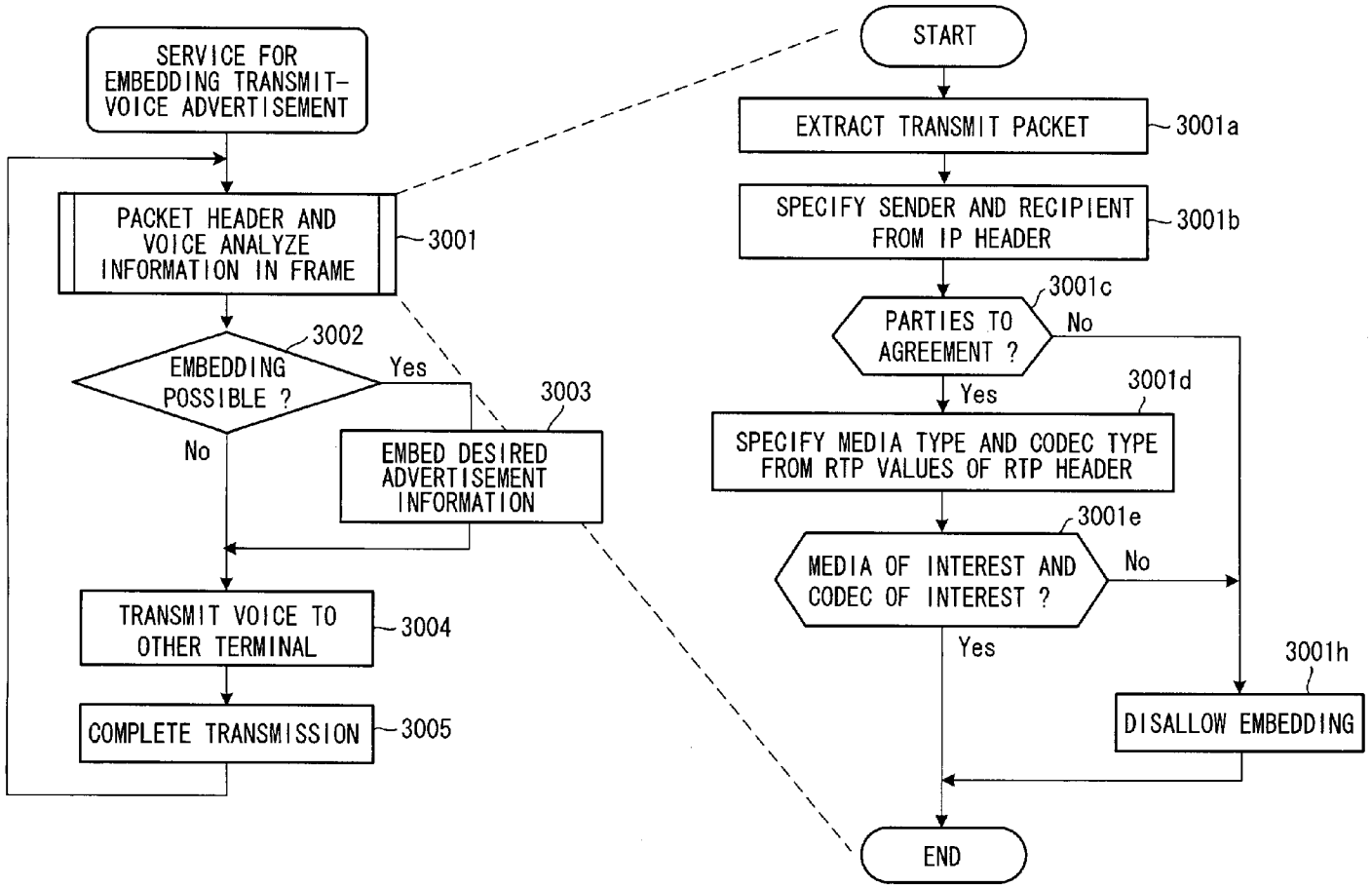
FIG. 38 is a flowchart of processing, which is for inserting advertising information, executed by a server.

FIG. 38 is a flowchart of processing, which is for inserting advertising information, executed by the server 400.

When a bit stream is input thereto, the server 400 analyzes the header of a transmit packet and the encoded voice data (step 3001). More specifically, the server 400 extracts a transmit packet from the bit stream (step 3001*a*), extracts the transmit address and receive address from the IP header (step 3001*b*), determines whether the sender and recipient have concluded an advertising agreement (step 3001*c*) and, if such an agreement has been concluded, refers to the RTP header to identify the media type and CODEC type (step 3001*d*). For example, if the media type is voice and the CODEC type is G.729A ("YES" at step 3001*e*), then, in accordance with an embedding criterion identical with that of the embodiment of FIG. 3 or FIG. 8, the server determines whether embedding is allowed (step 3001*f*) and judges that embedding is allowed or not allowed (steps 3001*g*, 3001*h*) in accordance with the result of the determination. The server judges that embedding is not allowed (step 3001*h*) if it is found at step 3001*c* that an advertising agreement has not been concluded, or if it is found at step 3001*e* that the media is not voice, or if it is found at step 3001*e* that the CODEC type is not allowed.

If the server 400 subsequently determines that embedding is possible ("YES" at step 3002), the server embeds the advertisement information provided by the advertiser (the information provider) in the encoded voice code data (step 3003). If the server 400 determines that embedding is not possible ("NO" at step 3002), then the server transmits the advertisement information to the terminal on the receiving side (step 3004) without embedding it in the encoded voice code data. The server then repeats the above operation until transmission is completed (step 3005).

Figure 39:
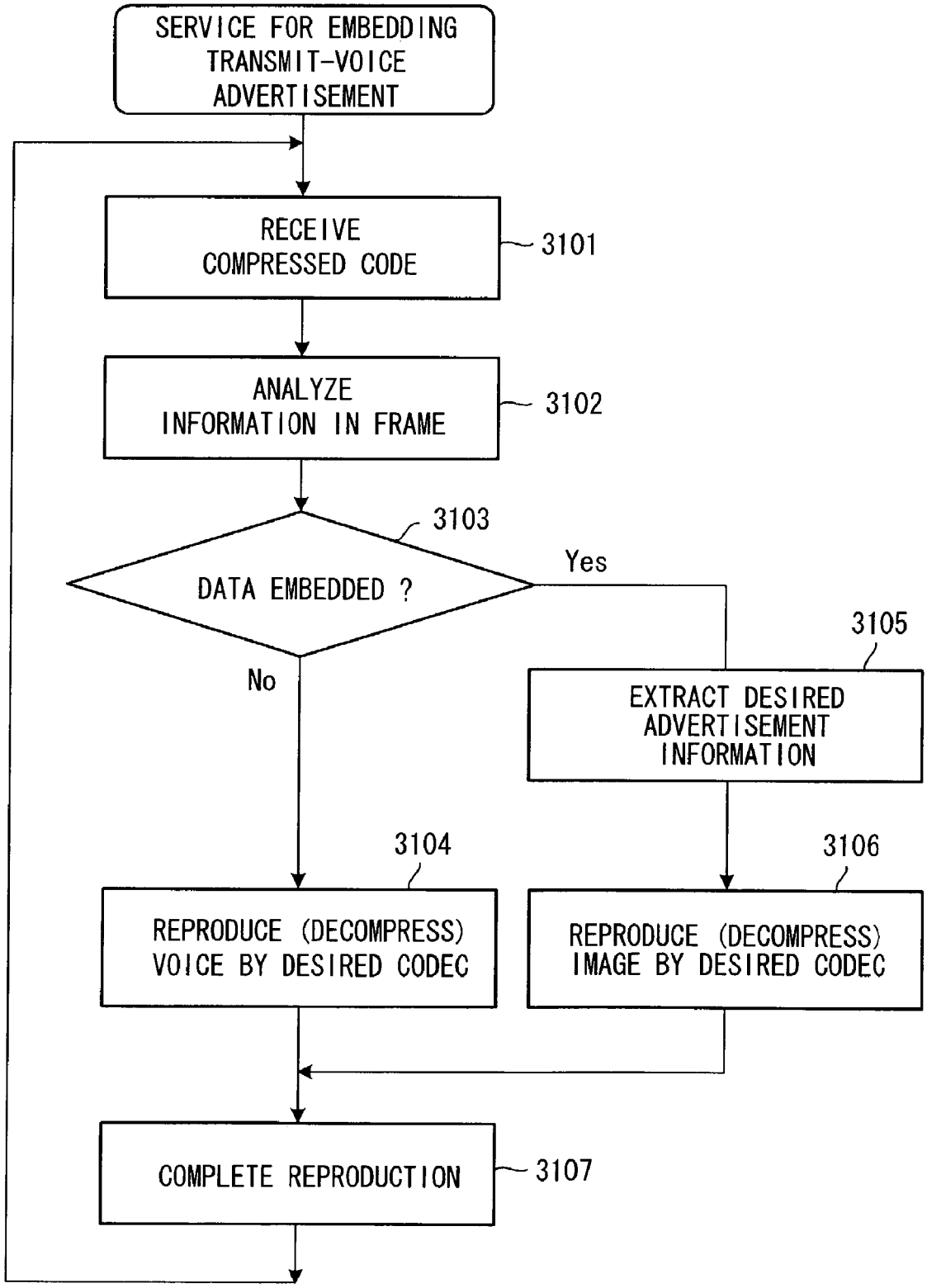
FIG. 39 is a flowchart of processing for receiving advertisement information executed by a receiving terminal in a service for embedding advertisement information.

FIG. 39 is a flowchart of processing for receiving advertisement information executed by a receiving terminal in a service for embedding advertisement information. If encoded voice code data is received (step 3101), the terminal analyzes the information in the encoded voice frame (step 3102), determines whether advertisement information has been embedded based upon the result of analysis (step 3101) and, if advertisement information has not been embedded, decodes the encoded voice code data and outputs reproduced voice from the speaker (step 3104). If advertisement information has been embedded, on the other hand, then the terminal extracts the advertisement information (step 3105) in parallel with the reproduction of voice at step 3104 and displays this advertisement information on the display/key unit DPK (step 3106). The terminal then repeats the above operation until reproduction is. completed (step 3107).

This embodiment has been described with regard to a case where advertisement information is embedded. However, the information is not limited to advertisement information; any information can be embedded. Further, it can be so arranged that by inserting an IP telephone address together with advertisement information, the destination of this IP telephone address can be telephoned to input detailed advertisement information and other detailed information by a single click.

In accordance with the digital voice communication system of FIG. 36, a server apparatus for relaying voice data is provided and the server is capable of providing optional information, such as advertisement information, to end users performing mutual communication of voice data.

(f) Information Storage System

Figure 40:
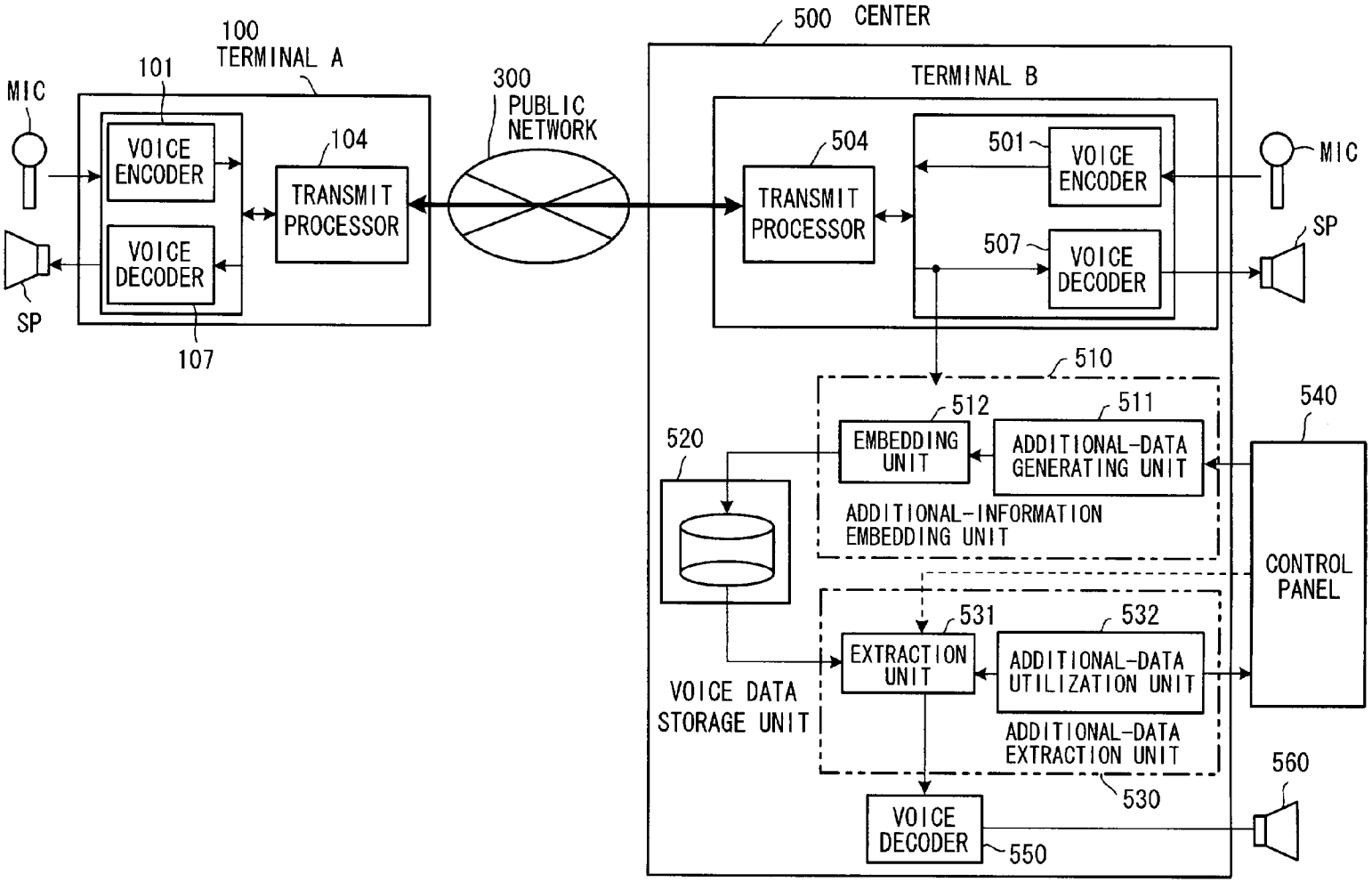
FIG. 40 is a block diagram illustrating the configuration of an information storage system that is linked to a digital voice communication system.
Figure 41:
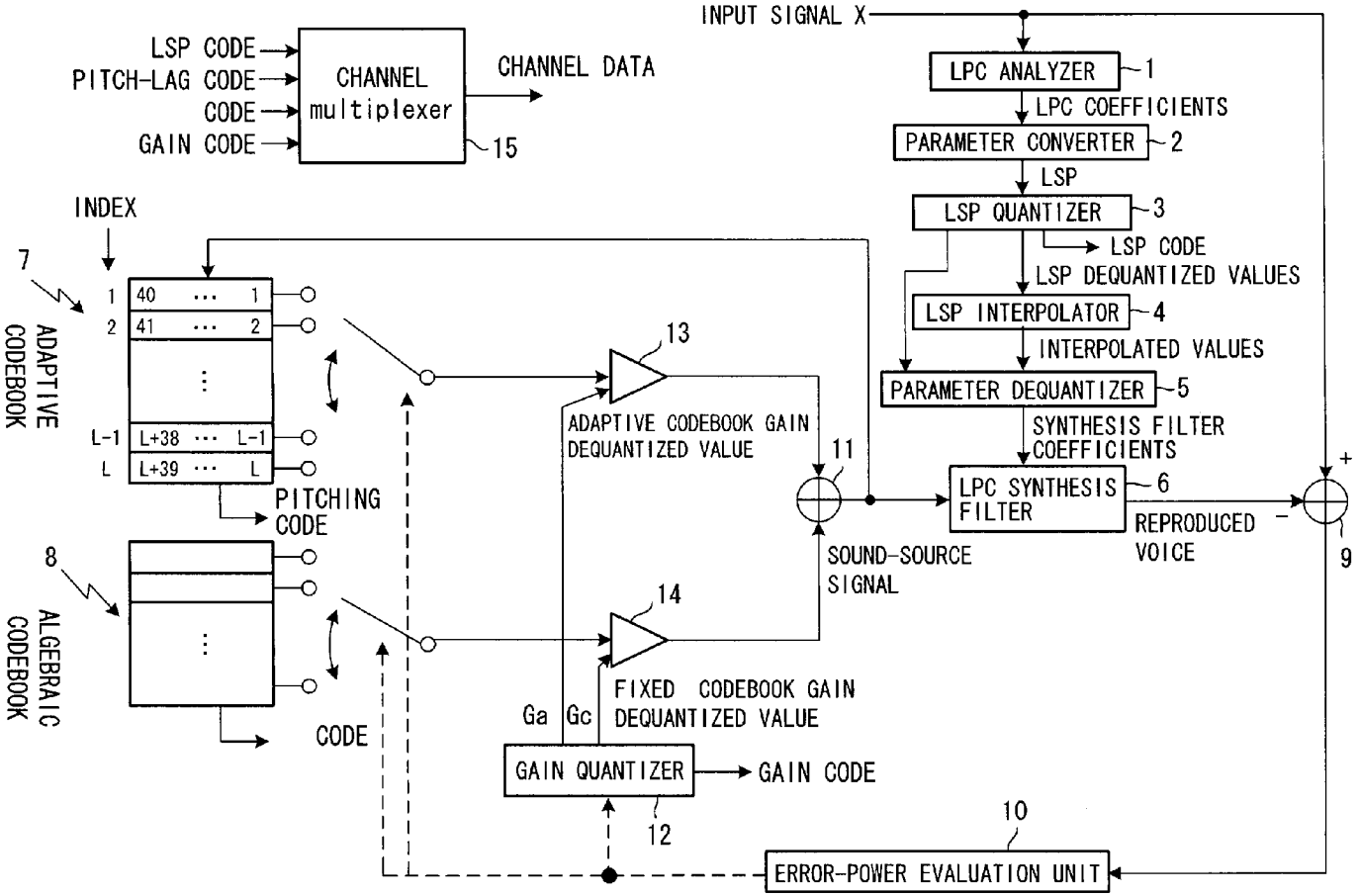
FIG. 41 is a diagram showing the structure of an encoder compliant with ITU-T Recommendation G.729 according to the prior art.
Figure 42:
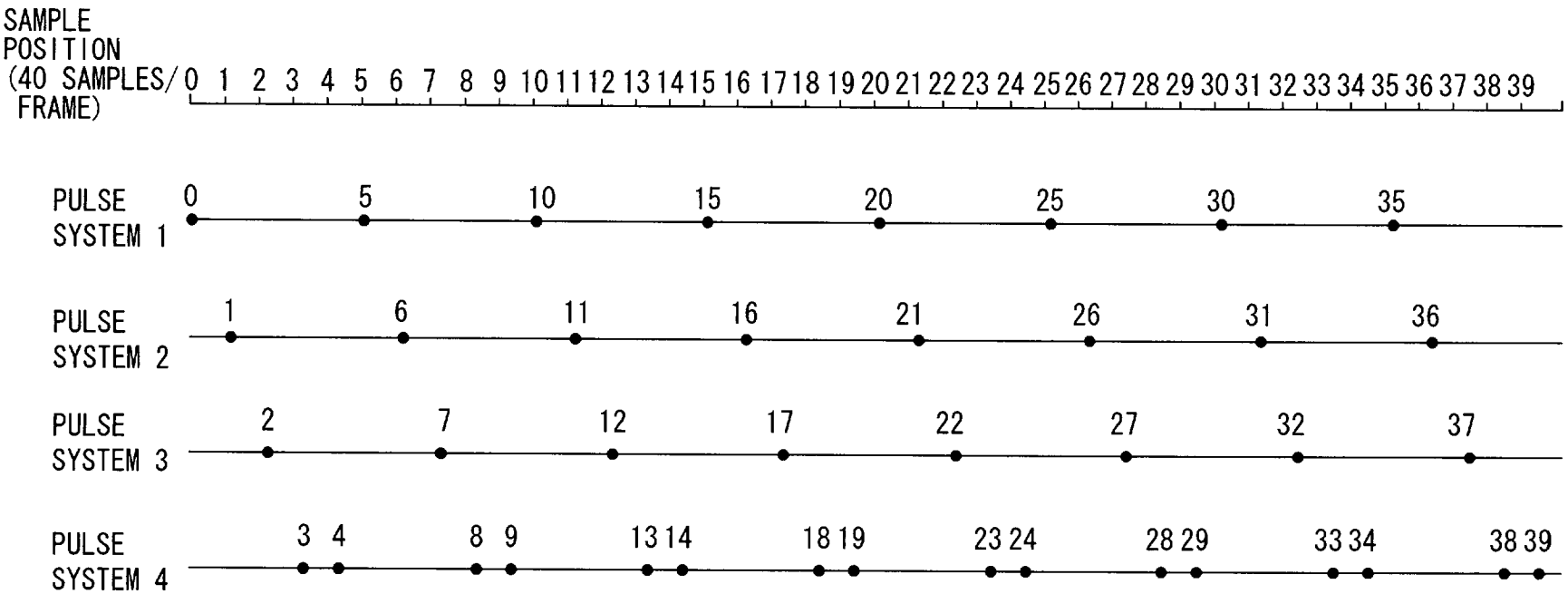
FIG. 42 PRIOR ART
FIG. 42 is a diagram useful in describing sampling points assigned to pulse-system groups according to the prior art.
Figure 43:
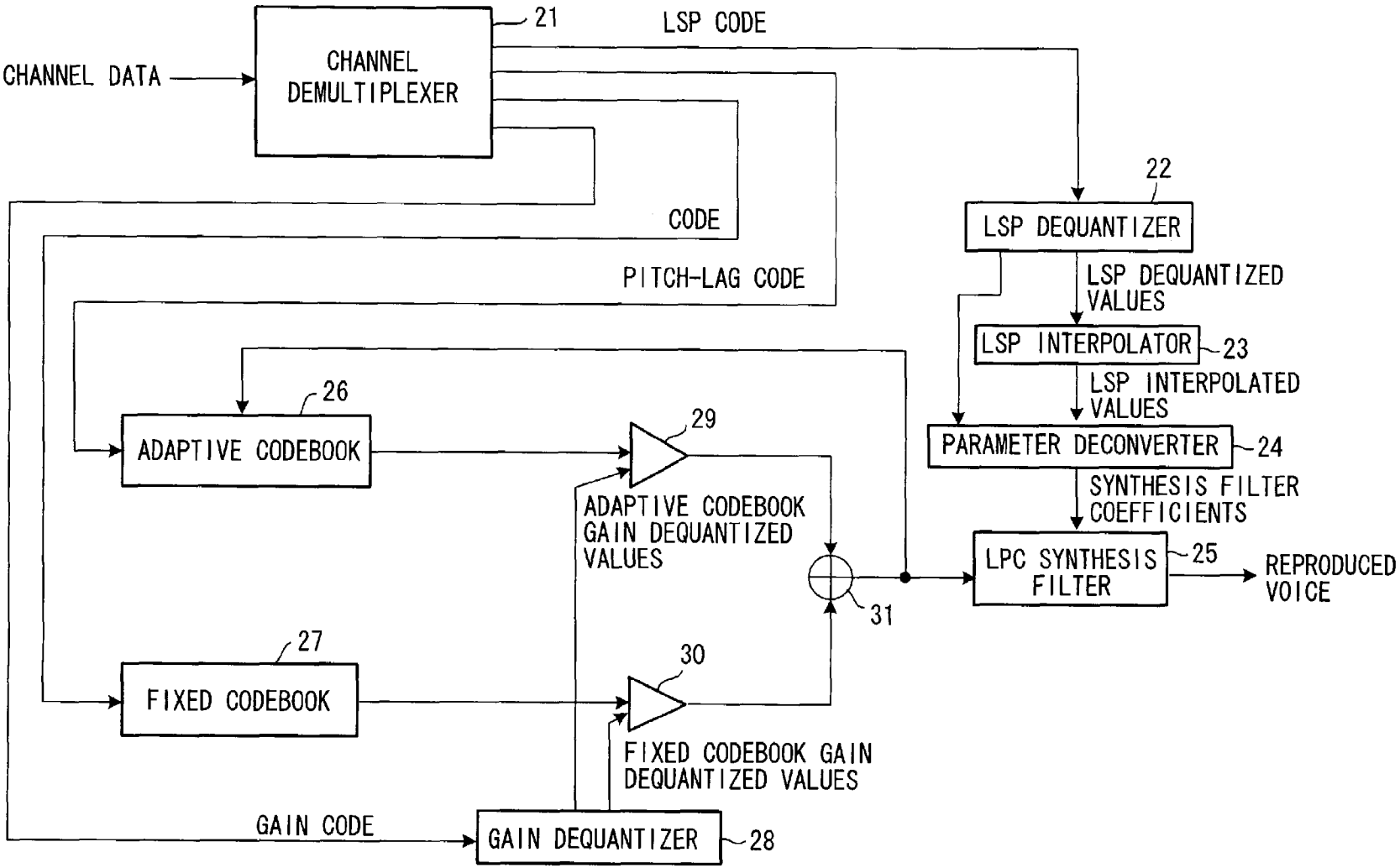
FIG. 43 PRIOR ART
FIG. 43 is a block diagram of a G.729-compliant decoder according to the prior art.
Figure 44:
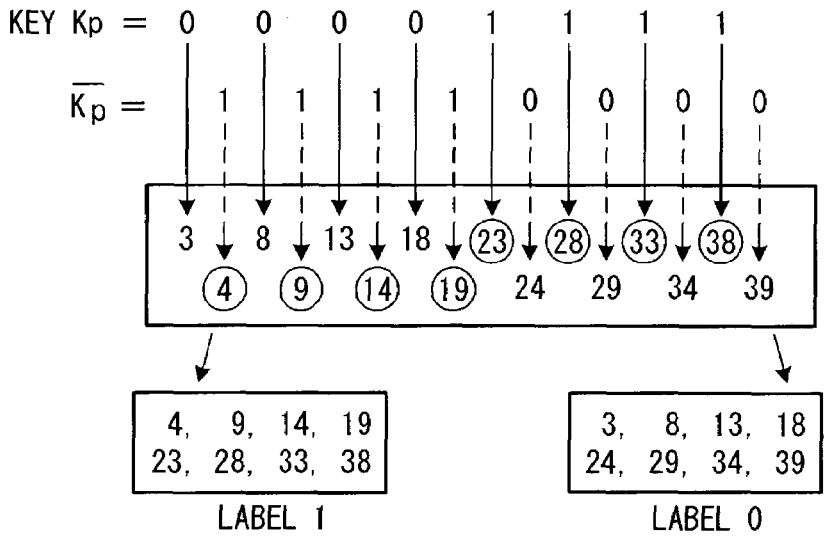
FIG. 44 PRIOR ART
FIG. 44 is a diagram useful in describing an digital watermark technique according to the prior art.
Figure 45:
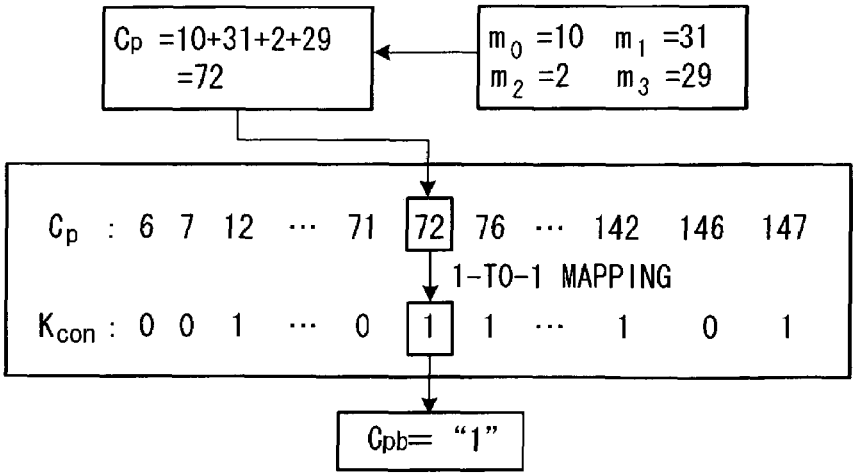
FIG. 45 PRIOR ART
FIG. 45 is another diagram useful in describing an digital watermark technique according to the prior art.

FIG. 40 is a block diagram illustrating the configuration of an information storage system that is linked to a digital voice communication system. Here the terminal A 100 and a center 500 are illustrated as being connected via the public network 300. The center 500 is a business call center, which is a facility that accepts and responds to complaints, repair requests and other user demands. The terminal A 100 includes the voice encoder 101 for encoding voice, which has entered from the microphone MIC, and sending encoded voice to the network 300 via the transmit processor 104, and a voice decoder 107 for decoding encoded voice code data that enters from the network 300 via the transmit processor 104 and outputting reproduced voice from the speaker SP. The center 500 has a voice communication terminal B the structure of which is identical with that of the terminal A. Specifically, the terminal B includes a voice encoder 501 for encoding voice, which has entered from the microphone MIC, and sending the encoded voice data to the network 300 via a transmit processor 504, and a voice decoder 507 for decoding encoded voice code data, which enters from the network 300 via the transmit processor 504, and outputting reproduced voice from the speaker SP. The above arrangement is such that when terminal A (the user) places a telephone call to the center, an operator responds to the user.

The side of the center 500 that is for storing digital voice includes an additional-information embedding unit 510 for embedding additional information in encoded voice code data that has been sent from the terminal A and storing the resultant data in a voice data storage unit 520, and an additional-data extraction unit 530 for extracting embedded information from prescribed encoded voice code data that has been read out of the voice data storage unit 520, displaying the extracted information on the display unit of a control panel 540 and inputting the encoded voice code data to a voice decoder 550. The latter decodes the entered encoded voice code data and outputs reproduced voice from a speaker 560.

The additional-information embedding unit 510 includes an additional-data generating unit 511 for encoding, and inputting to an embedding unit 512 as additional information, the sender name, recipient name, receive time and call category (classified by complaint, consultation and repair request, etc.) that enter from the control panel 540. In accordance with an embedding criterion identical with that of the embodiment of FIG. 3 or FIG. 8, the embedding unit 512 determines whether it is possible to embed the additional information in encoded voice code data sent from the terminal A 100 via the transmit processor 504. If embedding is possible, then the embedding unit 512 embeds the code information, which enters from the additional-data generating unit 511, in the encoded voice code data and stores the resultant encoded voice code data as a voice file in the voice data storage unit 520.

The additional-data extraction unit 530 includes an extraction unit 531. In accordance with an embedding criterion identical with that of the embodiment of FIG. 14 or FIG. 18, the extraction unit 531 determines whether encoded voice code data has been embedded. If encoded voice code data has been embedded, then the extraction unit 531 extracts the embedded code and inputs this code to an additional-data utilization unit 532. The extraction unit 531 also inputs the encoded voice code data to the voice decoder 550. The additional-data utilization unit 532 decodes the extracted code and displays the sender name, recipient name, receive time and call category, etc., on the display unit of the control panel 540. Further, the voice decoder 550 reproduces voice and outputs this voice from the speaker.

Furthermore, when encoded voice code data is read out of the voice data storage unit 520, desired encoded voice code data can be retrieved and output using the embedded information. Specifically, a search keyword, e.g., the sender name, is input from the control panel 540, thereby instructing output of the voice file in which this sender name has been embedded. As a result, the extraction unit 531 retrieves the voice file in which the specified sender name has been embedded, outputs the embedded information, inputs the encoded voice code data to the voice decoder 550 and outputs decoded voice from the speaker.

In accordance with the embodiment of FIG. 40, sender, recipient, receive time and call category, etc., are embedded in encoded voice code data and the encoded voice code data is then stored in storage means. The stored encoded voice code data is read out and reproduced as necessary and the embedded information can be extracted and displayed. Further, it is possible to put voice data into file form using embedded data. Moreover, embedded data can be used as a search keyword to rapidly retrieve, reproduce and output a desired voice file.

Thus, in accordance with the present invention, data can be embedded in encoded voice code on the side of an encoder side and extracted correctly on the side of a decoder without both the encoder and decoder sides possessing a key.

Further, in accordance with the present invention, there is almost no decline in sound quality even if data is embedded in encoded voice code, thereby making the embedding of data concealed to the listener of reproduced voice.

Further, in accordance with the present invention, it is possible to embed and extract data if only an initial value of a threshold value is defined beforehand on both sending and receiving sides.

Further, in accordance with the present invention, if a control code is defined as embedded data, a threshold value can be changed using this control code and the amount of embedded data transmitted can be adjusted without transmitting additional information on another path.

Further, in accordance with the present invention, whether to embed only a data sequence, or whether to embed a data/control code sequence in a format that makes it possible to identify the type of data and control code, is decided in dependence upon a gain value. In a case where only a data sequence is embedded, therefore, it is unnecessary to include data-type information. This makes possible improvements relating to transmission capacity.

Further, in accordance with the present invention, it is possible to embed any data without changing the encoding format. In other words, an ID or other media information can be embedded in voice information and transmitted/stored without sacrificing the compatibility that is essential in communication/storage applications and without the user being aware. In addition, according to the present invention, control specifications are stipulated by parameters common to CELP. This means that the invention is not limited to a specific scheme and can be applied to a wide range of schemes. For example, G.729 suited to VoIP and AMR suited to mobile communications can be supported.

Further, in accordance with a digital voice communication system according to the present invention, it is so arranged that any code is embedded in a specific segment of a portion of compressed voice data at the transmitting end or along the way, and the embedded code is extracted from the specific segment by analyzing transmit voice data at the receiving end or along the way. As a result, additional information can be transmitted at the same time as voice using the ordinary voice transmission protocol as is. Further, since the additional information is embedded under the voice data, there is no auditory overlap, the additional information is not obtrusive and does not result in abnormal sounds. Further, multimedia communication becomes possible by adopting image information (video of present surroundings and map images, etc.) and personal information (a portrait photograph or voice print), etc., as the additional information. Further, by adopting a terminal serial number or voice print, etc., as the additional information, the performance of authentication as to whether or not an individual is an authorized user can be enhanced. Moreover, it is possible to improve the security of voice data.

Further, in accordance with the present invention, a server apparatus for relaying voice data is provided. As a result, optional information such as advertisement information can be provided to end users performing mutual communication of voice data.

Further, in accordance with the present invention, sender, recipient, receive time and call category, etc., are embedded in received voice data, which is then stored in storage means. This makes it possible to put voice data into file form so that subsequent utilization can be. facilitated.

As many apparently widely different embodiments of the present invention can be made without departing from the spirit and scope thereof, it is to be understood that the invention is not limited to the specific embodiments thereof except as defined in the appended claims.

What is claimed is:

1. A data embedding method for embedding optional data in encoded voice code which is obtained by encoding voice by a prescribed voice encoding scheme and consisting of a plurality of element codes, comprising the steps of:

setting a threshold value;

comparing a value of a gain code as a first element code from among said element codes and said threshold value;

determining whether data embedding condition is satisfied based upon result of the comparison; and embedding optional data in the encoded voice code by replacing a second element code with the optional data if the data embedding condition is satisfied wherein said second element code is a noise code, which is index information of a fixed codebook or a pitch-lag code, which is index information of an adaptive codebook.

2. The data embedding method according to claim 1, wherein the first element code is a fixed codebook gain code and the second element code is said noise code; and when a value of the fixed codebook gain code is smaller than the threshold value, it is determined that the data embedding condition is satisfied and the noise code is replaced with optional data, whereby the optional data is embedded in the encoded voice code.

3. The data embedding method according to claim 1, wherein the first element code is a pitch-gain code and the second element code is said pitch-lag code; and when a value of the pitch-gain code is smaller than the threshold value, it is determined that the data embedding condition is satisfied and the pitch-lag code is replaced with optional data, whereby the optional data is embedded in the encoded voice code.

4. The data embedding method according to claim 1, wherein a portion of the embedded data is adopted as data-type identification data, and the type of the embedded data is specified by this data-type identification data.

5. The data embedding method according to claim 1, further comprising steps of:

sorting a plurality of the threshold values;

comparing the value of the gain code and each of said threshold values; and embedding, based upon result of the comparison, the optional data which is a data sequence in its entirety or a data/control code sequence, which is a format that is capable of identifying a distinction between data and a control code.

6. An embedded-data extracting method for extracting data embedded in encoded voice code that has been encoded by a prescribed voice encoding scheme and consisting of a plurality of element codes comprising the steps of:

setting a threshold value;

comparing a value of a gain code as a first element code from among said element codes and said threshold value;

determining whether data embedding condition is satisfied based upon result of the comparison; and if the data embedding condition is satisfied, extracting embedded data that has been embedded in a second element code portion of the encoded voice code wherein said second element code is a noise code, which is index information of a fixed codebook or a pitch-lag code, which is index information of an adaptive codebook.

7. The embedded-data extracting method according to claim 6, wherein the first element code is a fixed codebook gain code and the second element code is said noise code; and when a value of the fixed codebook gain code is smaller than the threshold value, it is determined that optional data has been embedded in the noise code portion and this embedded data is extracted.

8. The embedded-data extracting method according to claim 6, wherein the first element code is a pitch-gain code and the second element code is said pitch-lag code; and when a value of the pitch-gain code is smaller than the threshold value, it is determined that optional data has been embedded in the pitch-lag code portion and this embedded data is extracted.

9. The embedded-data extracting method according to claim 6, wherein a portion of the embedded data is adopted as data-type identification data, and the type of the embedded data is specified by this data-type identification data.

10. The embedded-data extracting method according to claim 6, further comprising steps of:

setting a plurality of the threshold values;

comparing the value of the gain code and each of said threshold values; and distinguishing the embedded data as being a data sequence in its entirety or a data/control code sequence, which is a format that is capable of identifying a distinction between data and a control code.

11. A data embedding/extracting method in a system having a voice encoding apparatus for encoding voice according to a prescribed voice encoding scheme, and embedding optional data in encoded voice code thus obtained and consisting of a plurality of element codes, and a voice reproducing apparatus for extracting embedded data from encoded voice code and reproducing voice from this encoded voice code, comprising the steps of:

defining beforehand a first element code and a threshold value used to determine whether data has been embedded or not, and a second element code in which data will be embedded based upon the result of the determination;

when data is to be embedded, comparing a value of a gain code as the first element code and said threshold value;

determining whether data embedding condition is satisfied based upon result of the comparison; and embedding optional data in the encoded voice code by replacing the second element code with the optional data if the data embedding condition is satisfied wherein said second element code is a noise code, which is index information of a fixed codebook or a pitch-lag code, which is index information of an adaptive codebook; and when data is to be extracted, comparing a value of the gain code as the first element code and said threshold value;

determining whether data embedding condition is satisfied based upon result of the comparison; and if the data embedding condition is satisfied, extracting embedded data that has been embedded in a second element code portion of the encoded voice code.

12. The data embedding/extracting method according to claims 11, wherein the first element code is a fixed codebook gain code and the second element code is said noise code; and when a value of the fixed codebook gain code is smaller than the threshold value, it is determined that the data embedding condition is satisfied and the noise code is replaced with optional data, whereby the optional data is embedded in the encoded voice code, or it is determined that optional data has been embedded in the noise code portion and this embedded data is extracted.

13. The data embedding/extracting method according to claims 11, wherein the first element code is a pitch-gain code and the second element code is said pitch-lag code; and when a value of the pitch-gain code is smaller than the threshold value, it is determined that the data embedding condition is satisfied and the pitch-lag code is replaced with optional data, whereby the optional data is embedded in the encoded voice code, or it is determined that optional data has been embedded in the pitch-lag code portion and this embedded data is extracted.

14. The data embedding/extracting method according to claim 11, wherein a portion of the embedded data is adopted as data-type identification data, and the type of the embedded data is specified by this data-type identification data.

15. The data embedding/extracting method according to claim 11, further comprising steps of:

setting a plurality of the threshold values;

comparing the value of the gain code and each of said threshold values; and embedding, based upon result of the comparison, the optional data which is a data sequence in its entirety or a data/control code sequence, which is a format that is capable of identifying a distinction between data and a control code, or distinguishing the embedded data as being a data sequence in its entirety or a data/control code sequence, which is a format that is capable of identifying a distinction between data and a control code.

16. A data embedding apparatus for embedding optional data in encoded voice code which is obtained by encoding voice according to a prescribed voice encoding scheme and consisting of a plurality of element codes, comprising:

a setting unit for setting a threshold value;

an embedding decision unit for comparing a value of a gain code as a first element code from among said element codes and said threshold value and determining whether data embedding condition is satisfied base upon result of the comparison; and a data embedding unit for embedding optional data in the encoded voice code by replacing a second element code with the optional data if the data embedding condition is satisfied wherein said second clement code is a noise code, which is index information of a fixed codebook or a pitch-lag code, which is index information of an adaptive codebook.

17. The data embedding apparatus according to claim 16, wherein said embedding decision unit includes:

a dequantizer for de-quantizing the gain code;

a comparator for comparing a dequantized value, which is obtained by dequantization by said dequantizer, with the threshold value; and a determination unit for determining whether data embedding condition is satisfied based upon result of the comparison by said comparator.

18. The data embedding apparatus according to claim 16, wherein the first element code is a fixed codebook gain code and the second element code is said noise code; and said embedding decision unit determines that the data embedding condition is satisfied when a value of the fixed codebook gain code is smaller than the threshold value.

19. The data embedding apparatus according to claim 16, wherein the first element code is a pitch-gain code and the second element code is said pitch-lag code; and said embedding decision unit determines that the data embedding condition is satisfied when a value of the pitch-gain code is smaller than the threshold value.

20. The data embedding apparatus according to claim 16, further comprising an embed data generating unit for generating embed data, a portion of which is type information that specifies the type of data.

21. The data embedding apparatus according to claim 16, further comprising:

a setting unit for setting a plurality of the threshold values; and a comparator for comparing the value of the gain code and each of said threshold values, wherein said data embedding unit embeds, based upon result of the comparison, the optional data which is a data sequence in its entirety or a data/control code sequence, which is a format that is capable of identifying a distinction between data and a control code.

22. A data extracting apparatus for extracting data embedded in encoded voice code that has been encoded according to a prescribed voice encoding scheme and consisting of a plurality of element codes, comprising:

a setting unit for setting a threshold value;

a demultiplexer for demultiplexing element codes constituting the encoded voice code;

an embedding decision unit for comparing a value of a gain code as a first element code from among said element codes and said threshold value and determining whether data embedding condition is satisfied based upon result of the comparison; and an embedded-data extracting unit for determining that optional data has been embedded in a second element code portion of the encoded voice code if the data embedding condition is satisfied, and extracting the embedded data wherein said second element code is a noise code, which is index information of a fixed codebook or a pitch-lag code, which is index information of an adaptive codebook.

23. The data extracting apparatus according to claim 22, wherein said embedding decision unit includes:

a dequantizer for dequantizing the gain code;

a comparator for comparing a dequantized value, which is obtained by dequantization by said dequantizer, with the threshold value; and a determination unit for determining whether data embedding condition is satisfied based upon result of the comparison by said comparator.

24. The data extracting apparatus according to claim 22, wherein the first element code is a fixed codebook gain code and die second element code is said noise code; and said embedding decision unit determines that the data embedding condition is satisfied when a value of the fixed codebook gain code is smaller than the threshold value.

25. The data extracting apparatus according to claim 22, wherein the first element code is said pitch-gain code and the second element code is a pitch-lag code; and said embedding decision unit determines that the data embedding condition is satisfied when a value of the pitch-gain code is smaller than the threshold value.

26. A voice encoding/decoding system for encoding voice according to a prescribed voice encoding scheme and embedding optional data in encoded voice code thus obtained, and for extracting embedded data from the encoded voice code and reproducing voice from this encoded voice code, comprising:

a voice encoding apparatus for embedding optional data in encoded voice code which is obtained by encoding voice according to a prescribed voice encoding scheme and consisting of a plurality of element codes; and a voice decoding apparatus for reproducing voice by applying decoding processing to encoded voice code that has been encoded by a prescribed voice encoding scheme, and extracting data that has been embedded in this encoded voice code;

said voice encoding apparatus including;

an encoder for encoding voice according to a prescribed voice encoding scheme;

a setting unit for setting threshold value;

an embedding decision unit for comparing a value of a gain code as a first element code from among said element codes and said threshold value and determining whether data embedding condition is satisfied based upon result of the comparison; and a data embedding unit for embedding optional data in the encoded voice code by replacing a second element code with the optional data if the data embedding condition is satisfied wherein said second element code is a noise code, which is index information of a fixed codebook or a pitch-lap code, which is index information of an adaptive codebook; and said voice decoding apparatus includes;

a setting unit for setting a threshold value;

a demultiplexer for demultiplexing the encoded voice code into element codes;

an embedding decision unit for comparing a value of a gain code as the first element code from among said element codes and said threshold value and determining whether data embedding condition is satisfied based upon result of the comparison;

an embedded-data extracting unit for determining that optional data has been embedded in a second element code portion of the encoded voice code if the data embedding condition is satisfied, and extracting the embedded data; and a decoder for decoding the received encoded voice code and reproducing voice;

wherein the first element code and threshold value used to determine whether data has been embedded or not, and the second element code in which data will be embedded based upon the result of the determination, are defined beforehand in said voice encoding apparatus and said voice decoding apparatus.

27. The voice encoding/decoding system according to claim 26, wherein said embedding decision unit includes:

a dequantizer for dequantizing the gain code;

a comparator for comparing a dequantized value, which is obtained by dequantization by said dequantizer, with the threshold value; and a determination unit for determining whether data embedding condition is satisfied based upon result of the comparison by said comparator.

28. The voice encoding/decoding system according to claim 26, wherein the first element code is a fixed codebook gain code and the second element code is said noise code; and said embedding decision unit determines that the data embedding condition is satisfied when a value of the fixed codebook gain code is smaller than the threshold value.

29. The voice encoding/decoding system according to claim 26, wherein the first element code is a pitch-gain code and the second element code is said pitch-lag code, which is index information of an adaptive codebook; and said embedding decision unit determines that the data embedding condition is satisfied when a value of the pitch-gain code is smaller than the threshold value.

30. A digital voice communication system for encoding voice by a prescribed voice encoding scheme, and transmitting the encoded voice code consisting of a plurality of element codes, comprising:

an encoder for encoding voice according to the prescribed voice encoding scheme;

a setting unit for setting a threshold value;

an embedding decision unit for comparing a value of a gain code as a first element code from among said element codes and said threshold value and determining whether data embedding condition is satisfied based upon result of the comparison;

a data embedding unit for embedding optional data in the encoded voice code by replacing a second element code with the optional data if the data embedding condition is satisfied wherein said second element code is a noise code, which is index information of a fixed codebook or a pitch-lag code, which is index information of an adaptive codebook; and means for transmitting the encoded voice code embedded by the optional data as voice data;

whereby additional data is transmitted at the same time as ordinary voice.

31. A digital voice communication system for receiving transmitted voice data, which has been obtained by encoding voice by a prescribed voice encoding scheme and transmitting the encoded voice code consisting of a plurality of element codes, as the voice data, comprising:

a receiving unit for receiving the encoded voice code as the voice data;

a setting unit for setting a threshold value;

a demultiplexer for demultiplexing the encoded voice code into element codes;

an embedding decision unit for comparing a value of a gain code as the first element code from among said element codes and said threshold value and determining whether data embedding condition is satisfied based upon result of the comparison;

an embedded-data extracting omit for determining that optional data has been embedded in a second element code portion of the encoded voice code if the data embedding condition is satisfied, and extracting the embedded data, wherein said second element code is a noise code, which is index information of a fixed codebook or a pitch-lag code, which is index information of an adaptive codebook; and a decoder for decoding the received encoded voice code and reproducing voice;

whereby additional data is received at the same time as ordinary voice.

32. A digital voice communication system for encoding voice by a prescribed voice encoding scheme and transmitting the encoded voice code consisting of a plurality of element codes, and for receiving transmitted voice data, which has been obtained by encoding voice by a prescribed voice encoding scheme and transmitting the encoded voice code as the voice data, the system having a terminal device comprising a transmitter and a receiver;

said transmitter including;

an encoder for encoding voice according to the prescribed voice encoding scheme;

a setting unit for setting a threshold value;

an embedding decision unit for comparing a value of a gain code as a first element code from among said element codes and said threshold value and determining whether data embedding condition is satisfied based upon result of the comparison;

a data embedding unit for embedding optional data in the encoded voice code by replacing a second element code with the optional data if the data embedding condition is satisfied wherein said second element code is a noise code, which is index information of a fixed codebook or a pitch-lag code, which is index information of an adaptive codebook; and means for transmitting the encoded voice code embedded by the optional data as voice data; and said receiver including;

a receiving unit for receiving the encoded voice code as the voice data;

a setting unit for setting a threshold value;

a demultiplexer for demultiplexing the encoded voice code into element codes;

an embedding decision unit for comparing a value of a gain code as the first element code from among said element codes and said threshold value and determining whether data embedding condition is satisfied based upon result of the comparison;

an embedded-data extracting unit for determining that optional data has been embedded in a second element code portion of the encoded voice code if the data embedding condition is satisfied, and extracting the embedded data; and a decoder for decoding the received encoded voice code and reproducing voice;

whereby additional data is transmitted between terminal devices bi-directionally at the same time as ordinary voice via a network.

33. The system according to claim 32, wherein said transmitter further includes means for generating the optional data for embedding using an image or personal information possessed by a user terminal;

whereby multimedia transmission is made possible in the form of a voice call.

34. The system according to claim 32, wherein said transmitter further includes means for adopting a unique code as the code for embedding, wherein the unique code is that of a terminal employed by the user on the transmitting side or that of the user per se;

wherein said embedded-data extracting unit extracts an embedded code and discriminating its content.

35. The system according to claim 32, wherein said transmitter further includes means for adopting key information as the code for embedding; and said receiver further includes;

means for extracting the key information; and means for enabling only a specific user to decompress voice data using the extracted code information.

36. The system according to claim 32, wherein said transmitter further includes means for adopting relation address information as the code for embedding; and said receiver further includes;

means for extracting the relation address information; and means for telephoning an information provider or transferring a mail to an information provider by a single click using the relation address information.

37. A digital voice communication system for encoding voice by a prescribed voice encoding scheme and transmitting the encoded voice, and for receiving transmitted voice data, which has been obtained by encoding voice by a prescribed voice encoding scheme and transmitting the encoded voice as voice data, the system comprising:

a plurality of terminal devices; and a server device, which is connected to a network, for relaying voice data between terminal devices;

said terminal device including:

voice encoding means for encoding input voice;

means for transmitting encoded voice code data consisting of a plurality of element codes;

means for analyzing received voice data; and means for extracting code from a specific segment of a portion of the voice data in accordance with result of the analysis, said analyzing means having;

a receiving unit for receiving encoded voice code as voice data;

a setting unit for setting a threshold value;

a demultiplexer for demultiplexing the received encoded voice code into element codes; and an embedding decision unit for comparing a value of a gain code as the first element code from among said element codes and said threshold value and determining whether data embedding condition is satisfied based upon result of the comparison;

wherein said extracting means extracts the embedded data from a second element code portion of the encoded voice code if the data embedding condition is satisfied, said second element code being a noise code, which is index information of a fixed codebook or a pitch-lag code, which is index information of an adaptive codebook; and said server device includes:

means for receiving data exchanged mutually between terminal devices and determining whether the data is voice data;

means for analyzing voice data if the received data is voice data; and means for embedding any optional data in a specific segment of a portion of the voice data in accordance with result of the analysis, and transmitting the resultant voice data;

said analyzing means having:

a setting unit for setting a threshold value;

an embedding decision unit for comparing a value of a gain code as the first element code from among said element codes and said threshold value and determining whether data embedding condition is satisfied based upon result of the comparison;

wherein said embedding means determines that optional data has been embedded in a second element code portion of the encoded voice code if the data embedding condition is satisfied, and extracting the embedded data, whereby a terminal device that has received data via said server device extracts and outputs the optional data embedded by said server device.

38. A digital voice storage system for encoding voice by a prescribed voice encoding scheme and storing the encoded voice code consisting of a plurality of element codes, comprising:

means for analyzing voice data obtained by encoding input voice;

means for embedding any optional data in a specific segment of a portion of the voice data in accordance with result of the analysis; and means for storing the embedded data as voice data;

said analyzing means includes:

a setting unit for setting a threshold value; and an embedding decision unit for comparing a value of a gain code as a first element code from among said clement codes and said threshold value and determining whether data embedding condition is satisfied based upon result of the comparison;

wherein said embedding means embeds optional data in the encoded voice code by replacing a second element code with the optional data if the data embedding condition is satisfied wherein said second element code is a noise code, which is index information of a fixed codebook or a pitch-lag code, which is index information of an adaptive codebook, whereby additional information also is stored at the same time that ordinary digital voice is stored.

39. A digital voice storage system for encoding voice by a prescribed voice encoding scheme and storing the encoded voice data consisting of a plurality of element codes, comprising:

means for embedding any optional data in a portion of encoded voice data and storing the resultant voice data;

means for analyzing the stored voice data when the stored voice data is decoded; and means for extracting the embedded code from a specific segment of the stored data in accordance with result of the analysis, said analyzing means includes:

a setting unit for selling a threshold value:

a demultiplexer for demultiplexing element codes constituting the encoded voice data; and an embedding decision unit for comparing a value of a gain code as a first element code from among said element codes and said threshold value and determining whether data embedding condition is satisfied based upon result of the comparison;

wherein said extracting means determines that optional data has been embedded in a second element code portion of the encoded voice code if the data embedding condition is satisfied, and extracting the embedded data, said second element code being a noise code, which is index information of a fixed codebook or a pitch-lag code, which is index information of an adaptive codebook.

40. A digital voice storage system for encoding voice by a prescribed voice encoding scheme and storing the encoded voice data consisting of a plurality of element codes, comprising:

first means for analyzing voice data obtained by encoding input voice;

means for embedding any optional data in a specific segment of a portion of the voice data in accordance with result of the analysis;

means for storing the embedded data as voice data;

second means for analyzing the voice data when the stored voice data is decoded; and means for extracting the embedded optional data from the specific segment of the voice data in accordance with result of the analysis;

said first analyzing means includes:

a setting unit for setting a threshold value; and an embedding decision unit for comparing a value of a gain code as a first element code from among said element codes and said threshold value and determining whether data embedding condition is satisfied based upon result of the comparison;

wherein said embedding means embeds optional data in the encoded voice code by replacing a second element code with the optional data if the data embedding condition is satisfied wherein said second element code is a noise code, which is index information of a fixed codebook or a pitch-lag code, which is index information of an adaptive codebook, said second analyzing means includes:

a setting unit for setting a threshold value;

a demultiplexer for demultiplexing element codes constituting the encoded voice data; and an embedding decision unit for comparing a value of a gain code as a first element code from among said element codes and said threshold value and determining whether data embedding condition is satisfied based upon result of the comparison;

wherein said extracting means determines that optional data has been embedded in a second element code portion of the encoded voice code if the data embedding condition is satisfied, and extracting the embedded data.

41. The system according to claim 40, wherein the embedded code is speaking-party identifying information or storage-date information;

said system further comprising means for retrieving stored voice data, which is to be decompressed, using this information.

* * * * *